US009759030B2

(12) United States Patent
McAfee et al.

(10) Patent No.: US 9,759,030 B2
(45) Date of Patent: Sep. 12, 2017

(54) METHOD AND APPARATUS FOR CONTROLLED OR PROGRAMMABLE CUTTING OF MULTIPLE NESTED TUBULARS

(75) Inventors: Wesley Mark McAfee, Montgomery, TX (US); Mark Franklin Alley, The Woodlands, TX (US)

(73) Assignee: TETRA Applied Technologies, LLC, The Woodlands, TX (US)

( * ) Notice: Subject to any disclaimer, the term of this patent is extended or adjusted under 35 U.S.C. 154(b) by 1123 days.

(21) Appl. No.: 14/381,184

(22) PCT Filed: Dec. 15, 2011

(86) PCT No.: PCT/US2011/065148

§ 371 (c)(1),
(2), (4) Date: Jan. 12, 2015

(87) PCT Pub. No.: WO2012/083016

PCT Pub. Date: Jun. 21, 2012

(65) Prior Publication Data

US 2015/0211314 A1 Jul. 30, 2015

Related U.S. Application Data

(60) Provisional application No. 61/423,950, filed on Dec. 16, 2010, provisional application No. 61/423,961, filed on Dec. 16, 2010.

(51) Int. Cl.

| | |
|---|---|
| ***E21B 29/00*** | (2006.01) |
| ***E21B 43/11*** | (2006.01) |
| ***E21B 47/09*** | (2012.01) |

(52) U.S. Cl.
CPC ..... *E21B 29/005* (2013.01); *E21B 29/00* (2013.01); *E21B 43/11* (2013.01); *E21B 47/09* (2013.01)

(58) Field of Classification Search
CPC ..... E21B 29/005; E21B 29/00; E21B 43/11; E21B 47/09
See application file for complete search history.

(56) References Cited

U.S. PATENT DOCUMENTS

| | | | |
|---|---|---|---|
| 2,216,963 | A | 10/1940 | Sinclair |
| 2,709,490 | A | 5/1955 | Trimble |

(Continued)

FOREIGN PATENT DOCUMENTS

| | | |
|---|---|---|
| JP | 52036391 | 3/1977 |
| JP | 52071789 | 6/1977 |

*Primary Examiner* — Yong-Suk (Philip) Ro
(74) *Attorney, Agent, or Firm* — Brett A. North

(57) ABSTRACT

A methodology and apparatus for cutting shape(s) or profile(s) through well tubular(s), or for completely circumferentially severing through multiple tubulars, including all tubing, pipe, casing, liners, cement, other material encountered in tubular annuli. This rigless apparatus utilizes a computer-controlled, downhole robotic three-axis rotary mill to effectively generate a shape(s) or profile(s) through, or to completely sever in a 360 degree horizontal plane wells with multiple, nested strings of tubulars whether the tubulars are concentrically aligned or eccentrically aligned. This is useful for well abandonment and decommissioning where complete severance is necessitated and explosives are prohibited, or in situations requiring a precise window or other shape to be cut through a single tubular or plurality of tubulars.

11 Claims, 36 Drawing Sheets

(56) References Cited

U.S. PATENT DOCUMENTS

| | | | |
|---|---|---|---|
| 3,195,636 | A | 7/1965 | Cordary et al. |
| 3,331,439 | A | 7/1967 | Sanford |
| 4,366,988 | A | 1/1983 | Bodine |
| 4,368,786 | A | 1/1983 | Cousins |
| 4,479,541 | A | 10/1984 | Wang |
| 4,809,775 | A | 3/1989 | Fortin |
| 4,887,668 | A | 12/1989 | Lynde et al. |
| RE33,660 | E | 8/1991 | Jelsma |
| 5,150,755 | A | 9/1992 | Cassel et al. |
| 5,183,111 | A | 2/1993 | Schellstede |
| 5,197,783 | A | 3/1993 | Theimer et al. |
| 5,368,423 | A | 11/1994 | Hanna |
| 5,810,079 | A | 9/1998 | Lynde et al. |
| 5,857,530 | A | 1/1999 | Gronseth |
| 6,595,301 | B1 | 7/2003 | Diamond et al. |
| 6,821,063 | B2 | 11/2004 | Debat et al. |
| 6,868,901 | B2 | 3/2005 | Mason et al. |
| 6,889,781 | B2 | 5/2005 | Mazorow |
| 7,370,710 | B2 | 5/2008 | Trueman et al. |
| 7,478,982 | B2 | 1/2009 | Fuhst et al. |
| 7,527,092 | B2 | 5/2009 | McAfee |
| 7,537,055 | B2 | 5/2009 | Head et al. |
| 7,562,700 | B2 | 7/2009 | Lewis et al. |
| 7,575,056 | B2 | 8/2009 | Fuhst et al. |
| 7,823,632 | B2 | 11/2010 | McAfee et al. |
| 2002/0020562 | A1 | 2/2002 | Baird |
| 2002/0150436 | A1 | 10/2002 | Mason et al. |
| 2003/0015322 | A1 | 1/2003 | Fotland et al. |
| 2003/0098152 | A1 | 5/2003 | Kennedy et al. |
| 2005/0067166 | A1 | 3/2005 | Trueman et al. |
| 2005/0133224 | A1 | 6/2005 | Ruttley |
| 2005/0205305 | A1 | 9/2005 | Stout et al. |
| 2005/0247451 | A1 | 11/2005 | Hunt et al. |
| 2006/0137877 | A1 | 6/2006 | Watson et al. |
| 2006/0231258 | A1 | 10/2006 | Head et al. |
| 2008/0236893 | A1 | 10/2008 | Peter |
| 2009/0308605 | A1* | 12/2009 | McAfee ..... E21B 44/00 166/255.1 |
| 2010/0038080 | A1 | 2/2010 | McAfee et al. |

* cited by examiner

METHOD AND APPARATUS FOR CONTROLLED OR PROGRAMMABLE CUTTING OF MULTIPLE NESTED TUBULARS

CROSS-REFERENCE TO RELATED APPLICATIONS

Priority is claimed to the following applications, which are incorporated herein by reference:

U.S. provisional patent application Ser. No. 61/423,961, filed Dec. 16, 2010, entitled "METHOD AND APPARATUS FOR CONTROLLED OR PROGRAMMABLE CUTTING OF MULTIPLE NESTED TUBULARS;"

U.S. provisional patent application Ser. No. 61/423,950, filed Dec. 16, 2010, entitled "METHOD AND APPARATUS FOR PROGRAMMABLE ROBOTIC ROTARY MILL CUTTING OF MULTIPLE NESTED TUBULARS."

The following applications are incorporated herein by reference:

U.S. patent application Ser. No. 12/540,924, filed Aug. 13, 2009, entitled "Method and Apparatus For Programmable Robotic Rotary Mill Cutting Of Multiple Nested Tubulars";

U.S. patent application Ser. No. 12/484,211, filed Jun. 14, 2009, entitled "Method and Apparatus For Programmable Robotic Rotary Mill Cutting Of Multiple Nested Tubulars";

U.S. provisional patent application Ser. No. 61/131,874, filed Jun. 14, 2008, entitled "Rotary Milling Casing Cutter."

FIELD

The present disclosure generally relates to methods and apparatus for mill cutting through wellbore tubulars, including casing or similar structures.

BACKGROUND

When oil and gas wells are no longer commercially viable, they must be abandoned in accord with government regulations. Abandonment requires that the wellbore tubulars, including all strings of tubing, pipe, casing or liners that comprise the multiple, nested tubulars be severed below the surface or the mud line to a specified depth, and removed.

When cutting multiple, nested tubulars of significant diameters, for example 9⅝ inches outside diameter through 42 inches outside diameter, with at least two other nested tubulars of different sizes dispersed in between (e.g., 13⅝", 24", and 30").

Mechanical expanding and retracting blade cutters must be brought back to the surface where successively larger cutting blades are exchanged for smaller cutting blades. Exchanging the smaller blades for larger blades allows the downhole cutting of successively larger diameter multiple, nested tubulars.

To access the downhole mechanical blade cutter, the user must trip out or pull the entire work string out of the wellbore and unscrew each work string joint until the mechanical blade cutter is removed from the bottom of the work string. After exchanging the mechanical blade cutter for a larger cutting blade, the work string joints are screwed back together, one after another, and tripped back into the wellbore. The mechanical blade cutter trip back into the wellbore to the previous tubular cut location for additional cutting is compromised because the length of the work string varies due to temperature changes or occasionally human error in marking or counting work string joints. Consequently, it is difficult to precisely align successive cuts with earlier cuts.

Additionally, many installed multiple, nested tubular strings in wells are non-concentric, meaning that the nested tubulars are positioned off center in relation to the innermost tubular. As a result of the multiple, nested tubulars being stacked or clustered to one side, i.e. non-concentric to each other, the density or amount of material being cut will vary in a radial direction from the center of the innermost tubular during cutting. Mechanical cutter blades sometimes experience breakage when cutting multiple, nested tubulars positioned non-concentrically in relation to each other. The blade cutter often breaks from the contact with the leading edge of a partial segment of the casing that remains after another segment of that casing has been cut away. The remaining portion of the casing forms a "C" or horseshoe-type shape when viewed from above. The blade cutter extends to its fullest open cut position after moving across a less dense material or open space (because that material has been cut away) and when the blade cutter impacts the leading edge of the "C" shaped tubular, the force may break off the blade. The breaking of a cutter blade requires again tripping out and then back into the well and starting over at a different location in the wellbore in order to attempt severing of the multiple, nested tubulars. Non-concentric, multiple, nested tubulars present serious difficulties for mechanical blade cutters. Severing non-concentric multiple, nested tubulars may take a period of days for mechanical blade cutters.

Additionally, existing abrasive waterjet cutters also experience difficulties and failures to make cuts through multiple, nested tubulars. Primarily, existing solutions relate to abrasive waterjet cutting utilizing rotational movement in a substantially horizontal plane to produce a circumferential cut in downhole tubulars. However, the prior art in abrasive waterjet cutters for casing severance often results in spiraling cuts with narrow kerfs in which the end point of the attempted circumferential cut fails to meet the beginning point of the cut after the cutting tool has made a full 360 degree turn. In other words, the cut does not maintain an accurate horizontal plane throughout the 360 degree turn, and complete severance fails to be achieved. Another problem encountered by existing abrasive waterjet cutting is the inability to cut all the way through the thicker, more widely spaced mass of non-concentrically positioned tubulars. In this situation, the cut fails to penetrate all the way through on a 360 degree circumferential turn.

A further disadvantage of traditional abrasive waterjet cutting is that in order to successfully cut multiple, nested tubulars downhole, air must be pumped into the well bore to create an "air pocket" around the area where the cutting is to take place, such that the abrasive waterjet tool is not impeded by water or wellbore fluid. The presence of fluid in the cutting environment greatly limits the effectiveness of existing abrasive waterjet cutting.

Additionally, existing cutting systems fail to provide the operator with direct confirmation of a complete cut being made. Instead, existing provide indirect verification such as verification of severance by welding "ears" on the outside of the top portion of the tubulars under the platform, attaching hydraulic lift cylinders, heavy lift beams, and then lifting the entire conductor (all tubulars) to verify complete detachment has been achieved. Basically, if the tubulars are able to be lifted from the well bore, it is assumed the severance was successful. When working offshore, this lifting verification process occurs before even more costly heavy lift boats are deployed to the site. This method of verification is both time-consuming and expensive.

There exist methods to mill windows via longitudinal, vertical travel in casing. However, these milling methods do not completely sever multiple, nested non-concentric tubulars for well abandonment. One such rotary milling method uses a whipstock, which must be deployed before the window milling process can begin. A rotary mill is then actuated against one side of a tubular along with a means of vertical travel, enabling a window to be cut through the tubular. However, this method does not permit 360 degree circumferential severance of multiple, nested tubulars and is not suited for the purpose of well abandonment.

Conventionally available severing technology requires multiple trips of the cutting equipment when cutting multiple nested tubulars, and/or uses explosive shape charges to sever multiple, nested tubulars in order to remove. These conventionally available systems either take excessive times in cutting, and/or have negative environmental impacts.

A need exists for effective alternatives to conventionally available cutting systems for multiple nested tubular severance in well abandonment.

One embodiment provides a safe and environmentally benign means of completely severing multiple, nested tubulars for well abandonment including overcoming the difficulties encountered by mechanical blade cutting, abrasive waterjet cutting or other means of tubular milling currently available.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

When oil and gas wells are no longer commercially viable, they must be abandoned in accord with government regulations. Abandonment requires that the installed tubulars, including all strings of tubing, pipe, casing or liners that comprise the multiple, nested tubulars that have been installed in the wellbore, must be severed below the surface of the earth, or severed below the ocean floor, and removed. Using explosive shape charges to sever multiple, nested tubulars in order to remove them has negative environmental impacts, and regulators worldwide are limiting the use of explosives. Therefore, a need exists for effective alternatives to the use of explosives for tubular severance in well abandonment.

Mechanical blade cutting and abrasive waterjet cutting have been implemented in response to new restrictive environmental regulations limiting the use of explosives.

Existing mechanical blade cutters utilized from the inside of the innermost casing, cutting out through each successive tubular of the multiple nested tubulars, requires multiple trips in and out of the wellbore. Such mechanical blade cutters require a rotary rig or some means of rotary drive in order to rotate the work string to which the mechanical blade cutter is attached. Rotary drive systems are both cumbersome and expensive to have at the work site. Existing mechanical blade cutters are deficient because, among other reasons, the mechanical blade cutters may break when they encounter non-concentric tubulars. Another deficiency is the limitation on the number of nested tubulars that may be severed by the mechanical blade cutter at one time or trip into the wellbore. An "inner" and "outer" string may be severable, if generally concentrically positioned in relation to each other. However, there is no current capability for severing a multiple non-concentrically (eccentrically) nested tubulars that provides consistent time and cost results in a single trip into the wellbore.

Most advances in the mechanical blade cutting art have focused on cut chip control and efficiency, rather than focusing on the fundamental issues of blade breakage and required, multiple, undesired trips of the apparatus in and out of a well. Thus these fundamental problems of existing mechanical blade cutting persist.

When cutting multiple, nested tubulars of significant diameters, for example 9⅝ inches outside diameter through 36 inches outside diameter, with at least two other nested tubulars of different sizes dispersed in between, the mechanical blade cutter must be brought back to the surface where successive larger cutting blades are exchanged for smaller cutting blades. Exchanging the smaller blades for larger blades allows the downhole cutting of successively larger diameter multiple, nested tubulars.

To access the downhole mechanical blade cutter, the user must pull the entire work string out of the wellbore and unscrew each work string joint until the mechanical blade cutter is removed from the bottom of the work string. After exchanging the mechanical blade cutter for a larger cutting blade, the work string joints are screwed back together, one after another, and tripped back into the wellbore. The mechanical blade cutter trip back into the wellbore to the previous tubular cut location for additional cutting is compromised because the length of the work string varies due to temperature changes or occasionally human error in marking or counting work string joints. Consequently, it is difficult to precisely align successive cuts with earlier cuts.

Many installed multiple, nested tubular strings in wells are non-concentric, meaning that the nested tubulars are positioned off center in relation to the innermost tubular. This is often the case because the outer tubulars do not have the same center diameter as the inner tubular. As a result of the multiple, nested tubulars being stacked or clustered to one side, i.e. non-concentric to each other, the density or amount of material being cut will vary circumferentially during cutting. Mechanical cutter blades sometimes experience breakage when cutting multiple, nested tubulars positioned non-concentrically in relation to each other. The blade cutter often breaks from the contact with the leading edge of a partial segment of the casing that remains after another segment of that casing has been cut away. The remaining portion of the casing forms a "C" or horseshoe-type shape when viewed from above. The blade cutter extends to its fullest open cut position after moving across a less dense material or open space (because that material has been cut away) and when the blade cutter impacts the leading edge of the "C" shaped tubular, the force may break off the blade. The breaking of a cutter blade requires again tripping out and then back into the well and starting over at a different location in the wellbore in order to attempt severing of the multiple, nested tubulars. Non-concentric, multiple, nested tubulars present serious difficulties for mechanical blade cutters. Severing non-concentric multiple, nested tubulars may take a period of days for mechanical blade cutters.

Existing abrasive waterjet cutters also experience difficulties and failures to make cuts through multiple, nested tubulars. Primarily, existing solutions relate to abrasive waterjet cutting utilizing rotational movement in a substantially horizontal plane to produce a circumferential cut in downhole tubulars. However, the prior art in abrasive waterjet cutters for casing severance often results in spiraling cuts with narrow kerfs in which the end point of the attempted circumferential cut fails to meet the beginning point of the cut after the cutting tool has made a full 360-degree turn. In other words, the cut does not maintain an accurate horizontal plane throughout the 360-degree turn, and complete severance fails to be achieved. Another problem encountered by existing abrasive waterjet cutting is the inability to cut all the way through the thicker, more widely spaced mass of non-concentrically positioned tubulars. In this situation, the cut fails to penetrate all the way through on a 360-degree circumferential turn. A further disadvantage of traditional abrasive waterjet cutting is that in order to successfully cut multiple, nested tubulars downhole, air must be pumped into the well bore to create an "air pocket" around the area where the cutting is to take place, such that the abrasive waterjet tool is not impeded by water or wellbore fluid. The presence of fluid in the cutting environment greatly limits the effectiveness of existing abrasive waterjet cutting.

Existing systems provide, verification of severance by welding "ears" on the outside of the top portion of the tubulars under the platform, attaching hydraulic lift cylinders, heavy lift beams, and then lifting the entire conductor (all tubulars) to verify complete detachment has been achieved. Basically, if the tubulars can be lifted from the well bore; it is assumed the severance was successful. When working offshore, this lifting verification process occurs before even more costly heavy lift boats are deployed to the site. This method of verification is both time-consuming and expensive.

There exist methods to mill windows via longitudinal, vertical travel in casing. However, these milling methods do not completely sever multiple, nested non-concentric tubulars for well abandonment. One such rotary milling method uses a whipstock, which must be deployed before the window milling process can begin. A rotary mill is then actuated against one side of a tubular along with a means of vertical travel, enabling a window to be cut through the tubular. However, this method does not permit 360 degree circumferential severance of multiple, nested tubulars and is not suited for the purpose of well abandonment.

This invention provides a safe and environmentally benign means of completely severing multiple, nested tubulars for well abandonment including overcoming the difficulties encountered by mechanical blade cutting, abrasive waterjet cutting or other means of tubular milling currently available.

BRIEF SUMMARY

The apparatus of the present invention solves the problems confronted in the art in a simple and straightforward manner. These and other objects are attained in accordance with the concepts of the present invention through the provision of a controllable downhole cutter.

In one embodiment a predefined cutting pathway for the cutting member in the multiple nested tubulars is programmed in the controller.

In one embodiment a separate predefined cutting pathway is defined for each of the tubulars in the multiple nested tubulars.

In one embodiment the predefined cutting pathway includes relative movement of the cutting member in the W, Y, and Z axes.

In one embodiment the predefined cutting pathway includes relative and sequential movement of the cutting member in the W, Y, and Z axes.

First Cut Tubular

In one embodiment, cutting member is moved in the Y axis from the home position to a first cutting position of the first nested tubular, the first cutting position being closer to the W-axis than the home cutting position.

In one embodiment, while in the first cutting position, the cutting member is rotated at least 360 degrees in the W-axis while remaining in the first cutting position. In various embodiments at least 1, 2, 3, 4, 5, 6, 7, 8, 9, 10, 12, 14, 15, 16, 18, 20, 22, 24, 26, 28, and 30 revolutions are made in the W-axis while cutting member is maintained in the first cutting position of the Y-axis. In various embodiments any amount of W-axis revolutions between any two of the above specified number of revolutions in this paragraph are made while the cutting member is in the first cutting position for cutting the first tubular.

In one embodiment during W-axis rotations, the cutting member is also moved in the Z-axis. In one embodiment movement is upwardly in the Z-axis between first and second Z-axis positions for cutting the first tubular. In one embodiment this upward movement in the Z-axis causes the cutting member to move in a spiral pathway (or helical pathway) as the cutting member also moves in the W-axis simultaneously with the Z-axis. In one embodiment the vertical movement in the Z-axis is such that the vertical movement for any one revolution is greater than zero but less than the vertical height of material cut from the first tubular being cut by cutting member. In this way, although a spiral or helical pathway is being made by cutting member a complete cut about the first tubular is also made.

In one embodiment the cutting member is moved in the vertical Z-axis between a first height and a second height for the first tubular.

In one embodiment multiple W-axis revolutions of the cutting member are made causing the height of the overall cut in the first tubular to be greater than the height made by the cutting member during one complete W-axis revolution.

In one embodiment the height of the cut in the first tubular is equal to the height of a cut made by the cutting member made in the first tubular with a single W-axis rotation (e.g., when there is not Z-axis movement of cutting member during W-axis rotation), plus the difference in heights between the Z-axis position at the start of the cut of the first tubular to the Z-axis position at the finish of the cut of the first tubular.

Second Cut Tubular

In one embodiment, cutting member is moved in the Y axis to a second cutting position for the second tubular, the second tubular having a larger diameter than the first tubular, the second cutting position being closer to the W-axis than the first cutting position.

In one embodiment, before the second tubular is cut, the cutting member is moved from the second height for the first tubular to the first height for the second tubular, the first height for the second tubular being between lower than the second height for the first tubular. In one embodiment the first height for the second tubular is also lower than the first height for the first tubular (this can occur where the Y-axis position of the cutting member for cutting the second tubular is closer to the W-axis than the Y-axis position for the first tubular, such as when the second tubular has a larger diameter than the first tubular).

In one embodiment, while in the second cutting position, the cutting member is rotated at least 360 degrees in the W-axis while remaining in the second cutting position. In various embodiments at least 1, 2, 3, 4, 5, 6, 7, 8, 9, 10, 12, 14, 15, 16, 18, 20, 22, 24, 26, 28, and 30 revolutions are made in the W-axis while cutting member is maintained in the second cutting position of the Y-axis. In various embodiments any amount of W-axis revolutions between any two of the above specified number of revolutions in this paragraph are made while the cutting member is in the second cutting position for cutting the second tubular.

In one embodiment during W-axis rotations, the cutting member is also moved in the Z-axis. In one embodiment movement is upwardly in the Z-axis between first and second Z-axis positions for cutting the second tubular. In one embodiment this upward movement in the Z-axis causes the cutting member to move in a spiral pathway (or helical pathway) as the cutting member also moves in the W-axis simultaneously with the Z-axis. In one embodiment the vertical movement in the Z-axis is such that the vertical movement for any one revolution is greater than zero but less than the vertical height of material cut from the second tubular being cut by cutting member. In this way, although a spiral or helical pathway is being made by cutting member a complete cut about the second tubular is also made.

In one embodiment multiple W-axis revolutions of the cutting member are made causing the height of the overall cut in the second tubular to be greater than the height made by the cutting member during one complete W-axis revolution.

In one embodiment the height of the cut in the second tubular is equal to the height of a cut made in the second tubular by the cutting member made with a single W-axis rotation (e.g., when there is not Z-axis movement of cutting member during W-axis rotation), plus the difference in heights between the Z-axis position at the start of the cut of the second tubular to the Z-axis position at the finish of the cut of the second tubular.

In one embodiment the height of the cut in the second tubular is less than the height of the cut in the first tubular.

Third Cut Tubular

In one embodiment, cutting member is moved in the Y axis to a third cutting position for the third tubular, the third tubular having a larger diameter than the second and first tubulars, the third cutting position being closer to the W-axis than the second cutting position.

In one embodiment, before the third tubular is cut, the cutting member is moved from the second height for the second tubular to the first height for the third tubular, the first height for the third tubular being lower than the second height for the second tubular. In one embodiment the first height for the third tubular is also lower than the first height for the second tubular (this can occur where the Y-axis position of the cutting member for cutting the third tubular is closer to the W-axis than the Y-axis position for the second tubular, such as when the third tubular has a larger diameter than the second tubular).

In one embodiment, while in the third cutting position, the cutting member is rotated at least 360 degrees in the W-axis while remaining in the third cutting position. In various embodiments at least 1, 2, 3, 4, 5, 6, 7, 8, 9, 10, 12, 14, 15, 16, 18, 20, 22, 24, 26, 28, and 30 revolutions are made in the W-axis while cutting member is maintained in the third cutting position of the Y-axis. In various embodiments any amount of W-axis revolutions between any two of the above specified number of revolutions in this paragraph are made while the cutting member is in the third cutting position for cutting the third tubular.

In one embodiment during W-axis rotations, the cutting member is also moved in the Z-axis. In one embodiment movement is upwardly in the Z-axis between first and second Z-axis positions for cutting the third tubular. In one embodiment this upward movement in the Z-axis causes the cutting member to move in a spiral pathway (or helical pathway) as the cutting member also moves in the W-axis simultaneously with the Z-axis. In one embodiment the vertical movement in the Z-axis is such that the vertical movement for any one revolution is greater than zero but less than the vertical height of material cut from the third tubular being cut by cutting member. In this way, although a spiral or helical pathway is being made by cutting member a complete cut about the third tubular is also made.

In one embodiment multiple W-axis revolutions of the cutting member are made causing the height of the overall cut in the third tubular to be greater than the height made by the cutting member during one complete W-axis revolution.

In one embodiment the height of the cut in the third tubular is equal to the height of a cut made in the third tubular by the cutting member made with a single W-axis rotation (e.g., when there is not Z-axis movement of cutting member during W-axis rotation), plus the difference in heights between the Z-axis position at the start of the cut of the third tubular to the Z-axis position at the finish of the cut of the third tubular.

In one embodiment the height of the cut in the third tubular is less than the height of the cut in the second tubular which is less than the height of the cut in the first tubular.

Fourth Cut Tubular

In one embodiment, cutting member is moved in the Y axis to a fourth cutting position for the fourth tubular, the fourth tubular having a larger diameter than the third, second, and first tubulars, the fourth cutting position being closer to the W-axis than the third cutting position.

In one embodiment, before the fourth tubular is cut, the cutting member is moved from the second height for the third tubular to the first height for the fourth tubular, the first height for the fourth tubular being lower than the second height for the third tubular. In one embodiment the first height for the fourth tubular is also lower than the first height for the third tubular (this can occur where the Y-axis position of the cutting member for cutting the fourth tubular is closer to the W-axis than the Y-axis position for the third tubular, such as when the fourth tubular has a larger diameter than the third tubular).

In one embodiment, while in the fourth cutting position, the cutting member is rotated at least 360 degrees in the W-axis while remaining in the fourth cutting position. In various embodiments at least 1, 2, 3, 4, 5, 6, 7, 8, 9, 10, 12, 14, 15, 16, 18, 20, 22, 24, 26, 28, and 30 revolutions are made in the W-axis while cutting member is maintained in the fourth cutting position of the Y-axis. In various embodiments any amount of W-axis revolutions between any two of the above specified number of revolutions in this paragraph are made while the cutting member is in the fourth cutting position for cutting the fourth tubular.

In one embodiment during W-axis rotations, the cutting member is also moved in the Z-axis. In one embodiment movement is upwardly in the Z-axis between first and second Z-axis positions for cutting the fourth tubular. In one embodiment this upward movement in the Z-axis causes the cutting member to move in a spiral pathway (or helical pathway) as the cutting member also moves in the W-axis simultaneously with the Z-axis. In one embodiment the vertical movement in the Z-axis is such that the vertical movement for any one revolution is greater than zero but less than the vertical height of material cut from the fourth tubular being cut by cutting member. In this way, although a spiral or helical pathway is being made by cutting member a complete cut about the fourth tubular is also made.

In one embodiment multiple W-axis revolutions of the cutting member are made causing the height of the overall cut in the fourth tubular to be greater than the height made by the cutting member during one complete W-axis revolution.

In one embodiment the height of the cut in the fourth tubular is equal to the height of a cut made in the fourth tubular by the cutting member made with a single W-axis rotation (e.g., when there is not Z-axis movement of cutting member during W-axis rotation), plus the difference in heights between the Z-axis position at the start of the cut of the fourth tubular to the Z-axis position at the finish of the cut of the fourth tubular.

In one embodiment the height of the cut in the fourth tubular is less than the height of the cut in the third tubular, which is less than the height of the cut in the second tubular, which is less than the height of the cut in the first tubular.

Nth Cut Tubular

The method for higher numbers of tubulars than 4 is similar with similar changes to the procedure as shown between the methodologies for cuts of the $3^{rd}$ and $4^{th}$ tubulars.

Multiple Tubulars Cut Simultaneously or Sequentially

In various embodiments, for a particular Y axis position, elongated cutting member can cut multiple tubulars simultaneously, instead of sequentially.

In one embodiment a first nested tubular is cut individually, and the next two nested tubulars are cut simultaneously.

In one embodiment the first two nested tubulars are cut simultaneously, and the next larger tubular is cut by sequentially.

In one embodiment a first two nested tubulars are cut simultaneously, and the next two nested tubulars are cut sequentially.

In one embodiment a first two nested tubulars are cut simultaneously, and in a separate step the next two nested tubulars are cut simultaneously.

Information Provided on Cutting Variables

One embodiment includes a remote display which includes a rendering of the nested tubulars, the cutting head, along with a substantially real time display of the cut made in the tubulars by the cutting head.

Display represents cut made through one tubular, a second tubular, a third tubular, a fourth tubular, etc.

Display represents cut not yet made through one tubular, a second tubular, a third tubular, a fourth tubular, etc.

In one embodiment the cut made in one or more of the tubulars is shown on the remote display as a graphically removed portion of the tubular cut, and the remaining portion of the tubular is shown as not being cut.

In one embodiment the tubulars and/or cut made are shown in perspective or three dimensional views.

In one embodiment a depiction of the cutting member is shown on the remote display. In one embodiment the depiction of the cutting member on the display corresponds to the orientation (e.g., W and Y axis orientations) of the elongated cutting member actually making the cut.

In one embodiment a depiction of the cutting member is shown on the remote display. In one embodiment the depiction of the cutting member on the display corresponds to the vertical position (e.g., Z axis position) of the elongated cutting member actually making the cut.

In one embodiment the orientation and/or position of the depiction of the cutting member on the display is shown relative to pre-selected home positions for starting W, Z, and/or Y axes position(s).

In one embodiment sensors are operably attached to the apparatus, and one or more of these sensors send the controller positional information relative to the cutting member's W, Z, and/or Y axes positions, and at least some of this information is used to display information on the remote display regarding the cutting member's W, Z, and/or Y axial positions.

In one embodiment information relative to the cutting members W, Z, and/or Y axes positions is displayed on the remote display. In one embodiment it is graphically displayed through pictorial representations of the cutting member. In one embodiment information relative to the cutting members W, Z, and/or Y axes positions is graphically displayed on the remote display. In one embodiment information relative to the cutting members W, Z, and/or Y axes positions is numerically displayed on the remote display.

In one embodiment sensors are operably attached to the apparatus, and one or more of these sensors send the controller speed information regarding the cutting member's rotational speed in the W axis, and at least some of this information is used to display information on the remote display regarding the cutting member's rotational speed in the W axis.

In one embodiment sensors are operably attached to the apparatus, and one or more of these sensors send the controller speed information regarding the cutting member's angular/rotational speed in the Y axis, and at least some of this information is used to display information on the remote display regarding the cutting member's angular/rotational speed in the Y axis.

In one embodiment sensors are operably attached to the apparatus, and one or more of these sensors send the controller speed information regarding the cutting member's linear speed in the Z axis, and at least some of this information is used to display information on the remote display regarding the cutting member's linear speed in the Z axis.

In one embodiment sensors are operably attached to the apparatus, and one or more of these sensors send the controller speed information regarding the cutting member's rotational speed of the cutting member about the cutting member's rotational axis, and at least some of this information is used to display information on the remote display regarding the cutting member's rotational speed about the cutting member's rotational axis.

Remote Display

In one embodiment a remote display is provided providing substantially real time information to an operator. In one embodiment the display is remote from the tool and located on a vessel close to a control panel for the tool. In one embodiment the display can be the screen of a computer. In one embodiment the display can be the screen of a portable computing device such as laptop, notebook, I-Pad, etc.

In one embodiment a numeral value is provided for the value being displayed. In one embodiment an X-Y Cartesian graphical component is provided for the value being displayed. In one embodiment a pictorial representation is provided for the value being displayed. In various embodiments combinations of two or more of these display options are provided for the value being displayed. In one embodiment a user is provide the option to select between one or more of these display options for one or more of the values being displayed.

Rotation of Elongated Cutting Member about its Longitudinal Axis of Rotation ("ECMLAR") Display In one embodiment an indicator is displayed relating to rotation of the elongated cutting member about its longitudinal axis of rotation ("ECMLACM"). In one embodiment the display is on the remote display. In one embodiment the display corresponds to the total amount of translated angular rotation of the elongated cutting member in the ECMLAR from a pre-selected home position for movement in the ECMLAR. In one embodiment the display corresponds to the relative amount of angular rotation of the elongated cutting member in the ECMLAR from a pre-selected home position for movement in the ECMLAR. In one embodiment the display corresponds to the amount of translated angular rotation of the elongated cutting member in the ECMLAR. In one the display corresponds to the speed of angular rotation of the elongated cutting member in the ECMLAR (e.g., degrees per second, radians per second, and/or revolutions per minute). In one the display corresponds to the amount of force applied by the elongated cutting member in the ECMLAR. In one the display corresponds to the amount of reaction force applied to the elongated cutting member in the ECMLAR.

W-Axis

In one embodiment an indicator is displayed relating to W-axis rotation of the cutting head. In one embodiment the amount of W-axis rotation of the cutting head is about equal to the amount of W-axis rotation of the cutting member. In one embodiment the display is on the remote display. In one embodiment the display corresponds to the amount of translated angular rotation of the cutting head in the W-axis from a pre-selected home position for movement in the W-axis. In one embodiment the display corresponds to the relative amount of angular rotation of the cutting head in the W-axis from a pre-selected home position for movement in the W-axis. In one embodiment the display corresponds to the amount of translated angular rotation of the cutting head in the W-axis. In one the display corresponds to the speed of angular rotation of the cutting head in the W-axis (e.g., degrees per second, radians per second, and/or revolutions per minute). In one the display corresponds to the amount of force applied by the cutting head in the W-axis. In one the display corresponds to the amount of reaction force applied to the cutting head in the W-axis.

Y-Axis Display

In one embodiment an indicator is displayed relating to Y-axis pivoting of the cutting member relative to the cutting head. In one embodiment the display is on the remote display. In one embodiment the display corresponds to the total amount of translated angular pivoting rotation of the cutting member in the Y-axis from a pre-selected home position for pivoting in the Y-axis. In one embodiment the display corresponds to the relative amount of angular pivoting of the cutting member in the Y-axis from a pre-selected home position for movement in the Y-axis. In one embodiment the display corresponds to the total amount of translated angular pivoting of the cutting member in the Y-axis. In one the display corresponds to the speed of angular pivoting of the cutting member in the Y-axis (e.g., degrees per second, radians per second, and/or revolutions per minute). In one the display corresponds to the amount of force applied by the cutting member in the Y-axis. In one the display corresponds to the amount of reaction force applied to the cutting member in the Y-axis.

Z-Axis Display

In one embodiment an indicator is displayed relating to Z-axis linear movement of the cutting head relative to the body of the system. In one embodiment the amount of Z-axis linear movement of the cutting head is about equal to the amount of Z-axis linear movement of the cutting member. In one embodiment the display is on the remote display. In one embodiment the display corresponds to the amount of translated linear movement of the cutting head in the Z-axis from a pre-selected home position for movement in the Z-axis. In one embodiment the display corresponds to the relative amount of linear movement of the cutting head in the Z-axis from a pre-selected home position for movement in the Z-axis. In one embodiment the display corresponds to the amount of translated linear movement of the cutting head in the Z-axis. In one the display corresponds to the speed of linear movement of the cutting head in the Z-axis (e.g., length per unit time such as cm/sec). In one the display corresponds to the amount of force applied by the cutting head in the Z-axis. In one the display corresponds to the amount of reaction force applied to the cutting head in the Z-axis.

In one embodiment time for a cut of a first tubular in a plurality of nested tubulars is displayed on a display. In one embodiment time for a cut of a second tubular in a plurality of nested tubulars is displayed on a display. In one embodiment time for a cut of a third tubular in a plurality of nested tubulars is displayed on a display. In one embodiment time for a cut of a fourth tubular in a plurality of nested tubulars is displayed on a display. In one embodiment time for a cut of an $n^{th}$ tubular in a plurality of "n" nested tubulars is displayed on a display.

In one embodiment total time from start of cut of the first tubular to the time elapsed from the cut on the current cut of the $n^{th}$ tubular in a plurality of "n" nested tubulars is displayed.

Warnings or Alarms

In one embodiment the method and apparatus can provide one or more alarms depending on the conditions being monitored on the method and apparatus. In various embodiments the one or more alarms can be audible and/or visual.

In various embodiments described in this section an alarm can be provided if a particular quantity being monitored exceeds or falls below a predefined value, or fails to meet or exceed a predefined value within a predefined period of time.

In various embodiments the predefined period of time can be 0.1, 0.5, 1, 2, 3, 4, 5, 10, 15, 20, 30, and/or 60 seconds. In various embodiments the predefined period of time can be the range between any two of these predefined periods of time.

In various embodiments an alarm is provided where a quantity being monitored exceeds or falls below the following percentage of the predefined value by 0.1, 0.25, 0.5, 0.75, 1, 2, 3, 4, 5, 6, 7, 8, 9, 10, 15, 20, 25, 30, 35, 40, 45, and/or 50 percent. In various embodiments the predefined period of time can be the range between any two of these predefined periods of time.

Alarm for Rotation of Elongated Cutting Member about its

Longitudinal Axis of Rotation ("ECMLAR")

In one embodiment, for a particular nested tubular to be cut, an alarm can be provided where the total amount of translated angular rotation of the elongated cutting member in the ECMLAR from a pre-selected home position for movement in the ECMLAR when cutting a particular tubular fails to reach a preselected target amount within a predefined period of time. In one an alarm can be provided where the relative amount of translated angular rotation of the elongated cutting member in the ECMLAR from a pre-selected home position for movement in the ECMLAR when cutting a particular tubular fails to reach a preselected target amount within a predefined period of time. In one embodiment an alarm is provided when the speed of angular rotation of the elongated cutting member in the ECMLAR (e.g., degrees per second, radians per second, and/or revolutions per minute) falls below or exceeds a predefined percentage (or range) of a preselected target value of angular rotation. In one embodiment an alarm is provided when the amount of applied force by the elongated cutting member in the ECMLAR falls below or exceeds a predefined percentage (or range) of a preselected target value of force. In one embodiment an alarm is provided when the amount of reaction force applied on the elongated cutting member in the ECMLAR falls below or exceeds a predefined percentage (or range) of a preselected target value of force.

In various embodiments pressure of hydraulic fluid powering to the elongated cutting member is considered standard at a pressure of 2,000 psi. In various embodiments the supply pressure is standard at 1,500, 1,600, 1,700, 1,800, 1,900, 2,000, 2,100, 2,200, 2,300, 2,400, 2,500, 2,600, 2,700, 2,800, 2,900, 3,000, 3,500, 4,000, 4,500, and/or 5,000 psi. In various embodiments the standard pressure can be within a range between any two of the specified pressures.

In various embodiments an alarm is provided where the pressure of fluid powering the elongated cutting member exceeds or falls below the following percentage of the standard pressures by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

In various embodiments the torque applied by the elongated cutting member by rotation about its longitudinal axis is considered standard at 350 ft-lbs. In various embodiments the applied torque by rotation is standard at 100, 150, 200, 250, 300, 350, 400, 450, 500, 700, 750, 800, 900, 1,000, 1,100, 1,200, 1,300, 1,400, 1,500, 1,600, 1,700, 1,800, 1,900, 2,000, 2,500, and/or 3,000 ft-lbs. In various embodiments the standard torque by rotation can be within a range between any two of the specified torques.

In various embodiments an alarm is provided where the torque applied by rotation of the elongated cutting member exceeds or falls below the following percentage of the standard torques by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

In various embodiments the rotational speed of the elongated cutting member about its longitudinal axis is considered standard at 350 rpms. In various embodiments the standard rotational speed is 100, 150, 200, 250, 300, 350, 400, 450, 500, 600, 700, 800, 900, 1,000, and/or 1,500 rpms. In various embodiments the standard rotational speed can be within a range between any two of the specified rotational speeds.

In various embodiments an alarm is provided where the rotational speed of the elongated cutting member exceeds or falls below the following percentage of the standard rotational speed by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

W-Axis Alarm

In one embodiment, for a particular nested tubular to be cut, an alarm can be provided where the total amount of translated rotation of the cutting head in the W-axis from a pre-selected home position for movement in the W-axis fails to reach a preselected target amount within a predefined period of time. In one an alarm can be provided where the relative amount of rotation of the cutting head in the W-axis from a pre-selected home position for movement in the W-axis, during a particular cut of a particular nested tubular, fails to reach a preselected target amount within a predefined period of time. In one embodiment an alarm is provided when the speed of angular rotation of the cutting head in the W-axis (e.g., degrees per second, radians per second, and/or revolutions per minute) falls below or exceeds a predefined percentage (or range) of a preselected target value of angular rotation. In one embodiment an alarm is provided when the amount of applied force by cutting head in the W-axis falls below or exceeds a predefined percentage (or range) of a preselected target value of force. In one embodiment an alarm is provided when the amount of reaction force applied on the cutting head in the W-axis falls below or exceeds a predefined percentage (or range) of a preselected target value of force.

In various embodiments pressure of hydraulic fluid powering rotation of the cutting head about the W-axis is considered standard at a pressure of 1,000 psi. In various embodiments the supply pressure is standard at 500, 600, 700, 800, 900, 1,000, 1,100, 1,200, 1,300, 1,400, 1,500, 1,600, 1,700, 1,800, 1,900, 2,000, and/or 2,500 psi. In various embodiments the standard pressure can be within a range between any two of the specified pressures.

In various embodiments an alarm is provided where the pressure of fluid powering rotation of the cutting head about the W-axis exceeds or falls below the following percentage of the standard pressures by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

In various embodiments the torque applied by rotation of the cutting head in the W-axis is considered standard at 750 ft-lbs. In various embodiments the applied torque by rotation is standard at 50, 100, 150, 200, 250, 300, 350, 400, 450, 500, 600, 700, 750, 800, 900, 1,000, 1,500, and/or 2,000 ft-lbs. In various embodiments the standard torque by rotation of cutting head in the W-axis can be within a range between any two of the specified torques.

In various embodiments an alarm is provided where the torque applied by rotation of the cutting head in the W-axis exceeds or falls below the following percentage of the standard torques by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

In various embodiments the rotational speed of the cutting head in the W-axis is considered standard at 1 rpm. In various embodiments the standard rotational speed is 0.1, 0.2, 0.3, 0.4, 0.5, 0.75, 1, 1.25, 1.5, 1.75, 2, 2.5, 3, 3.5, 4, 4.5 and/or 5 rpms. In various embodiments the standard rotational speed can be within a range between any two of the specified rotational speeds.

In various embodiments an alarm is provided where the rotational speed of the cutting head in the W-axis exceeds or falls below the following percentage of the standard rotational speed by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

Y-Axis Alarm

In one embodiment, for a particular nested tubular to be cut, an alarm can be provided where the cutting member, from a pre-selected home position in the Y-axis, fails to reach a preselected target Y-axis cutting position, within a predefined period of time. In one embodiment an alarm is provided when the amount of applied force by the cutting member in the Y-axis falls below or exceeds a predefined percentage (or range) of a preselected target value of force.

In one embodiment an alarm is provided when the amount of reaction force applied on the cutting member in the Y-axis falls below or exceeds a predefined percentage (or range) of a preselected target value of force.

In various embodiments pressure of hydraulic fluid powering pivoting of the elongated cutting member in the Y-axis is considered standard at a pressure of 1,000 psi. In various embodiments the supply pressure is standard at 100, 200, 300, 400, 500, 600, 700, 800, 900, 1,000, 1,100, 1,200, 1,300, 1,400, 1,500, 1,600, 1,700, 1,800, 1,900, 2,000, 2,500, 2,600, 2,700, 2,800, 2,900 and/or 3,000 psi. In various embodiments the standard pressure can be within a range between any two of the specified pressures.

In various embodiments an alarm is provided where the pressure of fluid powering pivoting of the elongated cutting member in the Y-axis exceeds or falls below the following percentage of the standard pressures by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

In various embodiments the force applied by the elongated cutting head being pivoted in the Y-axis is considered standard at 2000 lbs. In various embodiments the applied torque by rotation is standard at 100, 200, 300, 400, 500, 600, 700, 800, 900, 1,000, 1,500, 2,000, 2,500, 3,000, 3,500, 4,000, 4,500 and/or 5,000 lbs. In various embodiments the standard force applied in the Y-axis can be within a range between any two of the specified applied forces.

In various embodiments an alarm is provided where the force applied in the Y-axis exceeds or falls below the following percentage of the standard torques by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

In various embodiments the pivoting speed of the elongated cutting member in the Y-axis is considered standard at 1 rpm. In various embodiments the standard pivoting speed is 0.1, 0.2, 0.3, 0.4, 0.5, 0.75, 1, 1.25, 1.5, 1.75, 2, 2.5, 3, 3.5, 4, 4.5 and/or 5 rpms. In various embodiments the standard rotational speed can be within a range between any two of the specified rotational speeds. It is understood that the elongated cutting member only pivots in the Y-axis (and does not complete rotate so that rpms can be converted to radians per second or degrees per second).

In various embodiments an alarm is provided where the pivoting speed of the elongated cutting member in the Y-axis exceeds or falls below the following percentage of the standard rotational speed by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

Z-Axis Alarm

In one embodiment, for a particular nested tubular to be cut, an alarm can be provided where the cutting head, from a pre-selected home position in the Z-axis, fails to reach a preselected target starting Z-axis cutting position, within a predefined period of time. In one embodiment the amount of Z-axis linear movement of the cutting head is about equal to the amount of Z-axis linear movement of the cutting member. In one embodiment, for a particular nested tubular to be cut, an alarm can be provided where the cutting head, from a pre-selected home position in the Z-axis, fails to reach a preselected target finishing Z-axis cutting position, within a predefined period of time. In one embodiment the predefined period of time for achieving the Z-axis finishing time starts immediately after reaching the preselected target starting Z-axis cutting position. In one embodiment the predetermined period of time for achieving the Z-axis target starting position for the next tubular in a chain of nested tubulars starts immediately after reaching the preselected target finishing Z-axis cutting position of the last cut tubular. In one embodiment an alarm is provided when the linear speed of motion of the cutting head in the Z-axis falls below or exceeds a predefined percentage (or range) of a preselected target value of linear speed. In one embodiment an alarm is provided when the amount of applied force by the cutting head in the Z-axis falls below or exceeds a predefined percentage (or range) of a preselected target value of force. In one embodiment an alarm is provided when the amount of reaction force applied on the cutting head in the Z-axis falls below or exceeds a predefined percentage (or range) of a preselected target value of force.

In various embodiments pressure of hydraulic fluid powering movement of the cutting head in the Z-axis is considered standard at a pressure of 1,100 psi. In various embodiments the supply pressure is standard at 500, 600, 700, 800, 900, 1,000, 1,100, 1,200, 1,300, 1,400, 1,500, 1,600, 1,700, 1,800, 1,900, 2,000, and/or 2,500 psi. In various embodiments the standard pressure can be within a range between any two of the specified pressures.

In various embodiments an alarm is provided where the pressure of fluid powering movement of the cutting head in the Z-axis exceeds or falls below the following percentage of the standard pressures by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

In various embodiments the force applied by movement of the cutting head in the Z-axis is considered standard at 500 lbs (above the weight of the cutting head). In various embodiments the applied torque by rotation is standard at 50, 100, 150, 200, 250, 300, 350, 400, 450, 500, 600, 700, 800, 900, 1,000, 1,500, 2,000, 2,500 and/or 3,000 lbs. In various embodiments the standard linear force by movement of cutting head in the Z-axis can be within a range between any two of the specified forces.

In various embodiments an alarm is provided where the linear force applied by movement of the cutting head in the Z-axis exceeds or falls below the following percentage of the standard torques by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

In various embodiments the linear speed of the cutting head in the Z-axis is considered standard at 1 inch per minute. In various embodiments the standard linear speed is 0.1, 0.2, 0.3, 0.4, 0.5, 0.75, 1, 1.25, 1.5, 1.75, 2, 2.5, 3, 3.5, 4, 4.5 and/or 5 inches per minute. In various embodiments the standard linear speed can be within a range between any two of the specified linear speeds.

In various embodiments an alarm is provided where the linear speed of the cutting head in the Z-axis exceeds or falls below the following percentage of the standard linear speed by 0.1, 0.25, 0.5, 0.75, 1, 2, 3, 4, 5, 6, 7, 8, 9, 10, 15, 20, 25, 30, 35, 40, 45, and/or 50 percent. In various embodiments the warning range be between any two of these percentages.

Alarm for Loss of Hydraulic Fluid

Occasionally a tear or other obstruction or flow anomaly may occur in the fluid delivery lines of a downhole cutter. Traditionally, the level of a large fluid tank, for example hydraulic fluid, would be monitored. If the level started decreasing, then the operators knew there was a problem. Unfortunately, this routinely occurs only after some significant amount of fluid is lost downhole (e.g. 20-30 gallons).

Furthermore, the operators only know there is a problem, they have no idea which hose had the leak.

In one embodiment, contrary to traditional models, in addition to the traditional "level" monitoring, hoses to and from the tool are fitted with turbine flow meters to continuously monitor the flow of fluid through each hose. Continuous monitoring of flow into and out of the tool provides a very early warning system to alert operators to any flow anomalies. For example, should a hose develop a tear and begin leaking fluid into the wellbore, the "delivery" hose would have a flow rate in excess of the "return" hose. If the difference in the flow meters exceeded a defined threshold, an operator could be alerted. This is an improvement over traditional fluid "level" monitoring which could only detect tears after a significant amount of fluid was lost downhole, wasting money and creating potential environmental hazards. Further, traditional "level" monitoring could only detect flow anomalies that resulted in the loss of fluid. By utilizing turbine flow meters, pinched, partially blocked/clogged, and/or completely blocked/clogged hoses can be detected. Also, because each hose has its own turbine flow meter, the operator can immediately identify which hose is having the flow anomaly and how serious the flow anomaly is.

In various embodiments an alarm is provided where the amount of fluid flow entering the tool exceeds the amount of fluid flow returning from the tool by a predefined limit (e.g., 1 gallon per minute). In various embodiments the standard for discrepancies between inlet and returning flows about 0.1, 0.2, 0.3, 0.4, 0.5, 0.75, 1, 1.25, 1.5, 1.75, 2, 2.5, 3, 3.5, 4, 4.5, 5, 6, 7, 8, 9, 10, 12, 14, 15, 16, 18, 20, 25, and/or 30 gallons per minute. In various embodiments the standard for discrepancy in fluid flow can be a range between any two of the specified flow standards, and an alarm is sent when the discrepancy falls above the range (or outside the range).

In various embodiments the standard for discrepancies between inlet and returning flows about exceeds (or falls below) the following percentage of the standard discrepancies by 0.1, 0.25, 0.5, 0.75, 1, 2, 3, 4, 5, 6, 7, 8, 9, 10, 15, 20, 25, 30, 35, 40, 45, and/or 50 percent.

Programming Profile for Plurality of N Tubulars to be Cut

In one embodiment, while onsite for a cut to be made in a plurality of n nested tubulars, a user can input into the method and apparatus size and quantity information for one or more of n tubulars to be cut by the method and apparatus. In one embodiment the user can input cross sectional size and thickness data for one or more of n tubulars to be cut by the method and apparatus (for example 12 inch diameter with a 1 inch wall thickness).

In one embodiment the user can input cross sectional size and thickness data for each of n tubulars to be cut by the method and apparatus (for example 12 inch diameter with a 1 inch wall thickness).

In one embodiment the user can input estimated offset information (relative to the smallest diameter tubular) for each of n tubulars to be cut by the method and apparatus (e.g., the amount of offset of tubular 2 compared to the innermost or smallest diameter tubular, such as a ½ inch offset).

In one embodiment, based on the size and thickness information for one or more of the plurality of N nested tubulars the method and apparatus will determine, for the cut of each nested tubular:

(a) a target Y-axis cutting position of the elongated cutting member relative to a preselected Y-axis home position, and (b) target starting and finishing Z-axis cutting positions for the cutting head (e.g., for the tubular being cut to provide a desired finished gap or swath or cut), relative to a preselected Z-axis home position.

In one embodiment the method and apparatus will also determine a target amount of total W-axis rotation or the cutting head relative to a preselected W-axis home position. These determinations can be made by the method and apparatus based on the calculated amount of cut which will be made by the elongated cutting member (based on the elongated cutting member's size and length), along with the relative sizes and positions of each of the plurality of n nested tubulars to be cut.

In one embodiment, based on the size and thickness information for one or more of the plurality of n nested tubulars, the method and apparatus will determine, for the cut of each nested tubular, a target speed (e.g., degrees per second, radians per second, and/or revolutions per minute) for the elongated cutting member's rotation about the ECMLAR.

In one embodiment the absolute value of the differences between the target starting and finishing Z-axis cutting positions for the cutting head decrease as the diameter of the tubular being cut increases.

In one embodiment the body of the apparatus remains anchored in a single longitudinal position in the innermost nested tubular. In this embodiment, for a $n^{th}$ nested tubular to be cut, the cutting head if lowered longitudinally the starting Z-axis position for the particular $n^{th}$ nested tubular to be cut, and during the cut the cutting head is moved upwardly to the finishing Z-axis position for the particular $n^{th}$ nested tubular being cut. In this embodiment the Z-axis finishing position for the first or innermost nested tubular to be cut is higher than the Z-axis finishing position for the next nested tubular to be cut (e.g., tubular 2), which is higher than the Z-axis finishing position for the next nested tubular to be cut (e.g., tubular 3), which is higher than the Z-axis finishing position for the next nested tubular to be cut (e.g., tubular 4), and so on in this manner. Also in this embodiment the absolute value of the differences between the target starting and finishing Z-axis cutting positions for the cutting head decrease with the higher numbered tubulars. This embodiment will see a series of gaps or cuts in the nested tubulars which decrease in size with each successive numbered tubular, and which are spaced between the cut or gap of each of the smaller number/diameter nested tubulars.

In one embodiment the Z-axis starting position for the first or innermost nested tubular to be cut is about equal to the Z-axis starting position for the next nested tubular to be cut (e.g., tubular 2), which is about equal to the Z-axis starting position for the next nested tubular to be cut (e.g., tubular 3), which is about equal to the Z-axis starting position for the next nested tubular to be cut (e.g., tubular 4), and so on in this manner.

In one embodiment the Z-axis starting position for the first or innermost nested tubular to be cut is lower than the Z-axis starting position for the next nested tubular to be cut (e.g., tubular 2), which is lower than the Z-axis starting position for the next nested tubular to be cut (e.g., tubular 3), which is lower than the Z-axis starting position for the next nested tubular to be cut (e.g., tubular 4), and so on in this manner.

In one embodiment the user can input information on the annular spaces between the plurality of n nested tubulars to be cut by the method and apparatus (e.g., between tubular 1 and 2 is cement, between tubular 2 and 3 is open space, etc.).

In various embodiments, for one or more of the nested tubulars to be cut, a pictorial display can be provided on a tubular by tubular basis (e.g., the proposed cut to be made in the innermost tubular can be pictorially displayed as complete, and then the cuts to be made in the first two innermost tubulars can be pictorially displayed as complete, and so on).

In various embodiments, for one or more of the nested tubulars to be cut, the user can override one or more target values for movements in Y-axis (e.g., target cutting position for a particular tubular), Z-axis (e.g., starting and finishing Z-axis locations for a particular tubular), W-axis (e.g., angular rotational speed), and/or ECMLAR (e.g., angular rotational speed). In various embodiments, based on particular programming overrides by the user, the user can be provided on the display a pictorial representation of the cuts which will be made in the plurality of nested tubulars by the method and apparatus with the programmed changes. In various embodiments the pictorial display can be done an a tubular by tubular basis (e.g., the proposed cut to be made in the innermost tubular can be pictorially displayed as complete, and then the cuts to be made in the first two innermost tubulars can be pictorially displayed as complete, and so on. In this way the user can be provided with a pictorial depiction of the cuts which will be made based on his programmed override.

Warnings or Alarms

In one embodiment the method and apparatus can provide one or more alarms depending on the conditions being monitored on the method and apparatus. In various embodiments the one or more alarms can be audible and/or visual.

In various embodiments the method and apparatus can be used in different applications, including but not limited to:

(a) Land based down hole cutting for the removing of a wellbore.

(b) Down hole window cutting for access to additional casing strings for well plug and abandonment.

(c) Down hole window cutting for well relief

The drawings constitute a part of this specification and include exemplary embodiments to the invention, which may be embodied in various forms.

This invention provides methodology and apparatus for efficiently severing installed multiple, nested strings of tubulars, either concentric or eccentric, as well as cement or other material in the annuli between the tubulars, in a single trip into a well bore in an environmentally sensitive manner without the need for a rig.

The invention utilizes a computer-controlled robotic downhole rotary mill to effectively generate a shape(s) or profile(s) through, or completely sever in a 360 degree horizontal circumferential plane, the installed tubing, pipe, casing and liners as well as cement or other material that may be encountered in the annuli between the tubulars. This process occurs under programmable robotic, computerized control, making extensive use of digital and or analogue sensor data to enable algorithmic, robotic actuation of the downhole assembly and robotic rotary mill cutter.

The robotic rotary mill (downhole assembly) is deployed inside the innermost tubular to a predetermined location and, the downhole assembly is locked securely into the innermost tubular and under computer control, a rotary mill cuts outward and radially and vertically, cutting away tubulars and cement thus creating a void (or swath) while completely severing the installed tubing, pipe, casing and liners as well as cement or other material that may be encountered in the annuli between the tubulars. The complete severance process occurs during one trip into the well bore.

Although this system is designed for precise W-axis movement in a 360 degree horizontal plane, due to the wide swath or void it generates when removing material in said horizontal plane, it does not require the exact alignment of the starting and ending points in the 360 degree cut that are otherwise required by traditional waterjet systems. Traditional narrow-kerfs abrasive waterjet systems often create a "spiral" cut because of an inability to maintain perfect alignment from the starting point to the ending point. This "spiral" cut causes severance attempts to fail because the starting point of the cut and the ending point of the cut did not meet.

Additionally, by cutting a void (or swath) into the tubulars, the severed casing will drop vertically at the surface platform, providing visual verification of the severance. The reach of the cutting device is designed to extend beyond the length of the cutting device to the outermost casing with any number of additional tubulars inside this outermost casing being extremely eccentrically positioned. This solves the cutting "reach" problems that are encountered with saw and mill cutters that cannot extend beyond the length or diameter of the cutter.

The programmable computer-controlled, feedback sensor-actuated rotary milling process will take less time to complete severance than mechanical blade cutters or existing abrasive waterjet cutting. The actively adjusted rotary milling, profile generation process prevents the impact breakage that plagues mechanical blade cutters encountering non-concentric, multiple, nested tubulars. Furthermore, this invention's capability of being deployed and completing the severance in one trip downhole provides a significant advantage over prior art.

Therefore, a technical advantage of the disclosed subject matter is the complete severing of tubing, pipe, casing and liners, as well as cement or other material that may be encountered in the annuli between the tubulars in a single trip down hole.

Another technical advantage of the disclosed subject matter is providing visual verification of severance without employing additional equipment.

Yet another technical advantage of the disclosed subject matter is creating a wide void (or swatch) thereby removing substantial material such that the start point and end point of the void (or swath) do not have to precisely align for complete severance.

An additional technical advantage of the disclosed subject matter is avoiding repeat trips down hole because of cutter breakage.

Another technical advantage of the disclosed subject matter is efficiently severing non-concentrically (eccentrically) aligned nested tubulars.

Yet another technical advantage of the disclosed subject matter is accomplishing severance in less time and in an environmentally benign manner.

Still another technical advantage is providing three axis real time electronic feedback showing cutter position and severance progress graphically on the operator's monitor.

These and other features and advantages will be readily apparent to those with skill in the art in conjunction with this disclosure.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 3A:
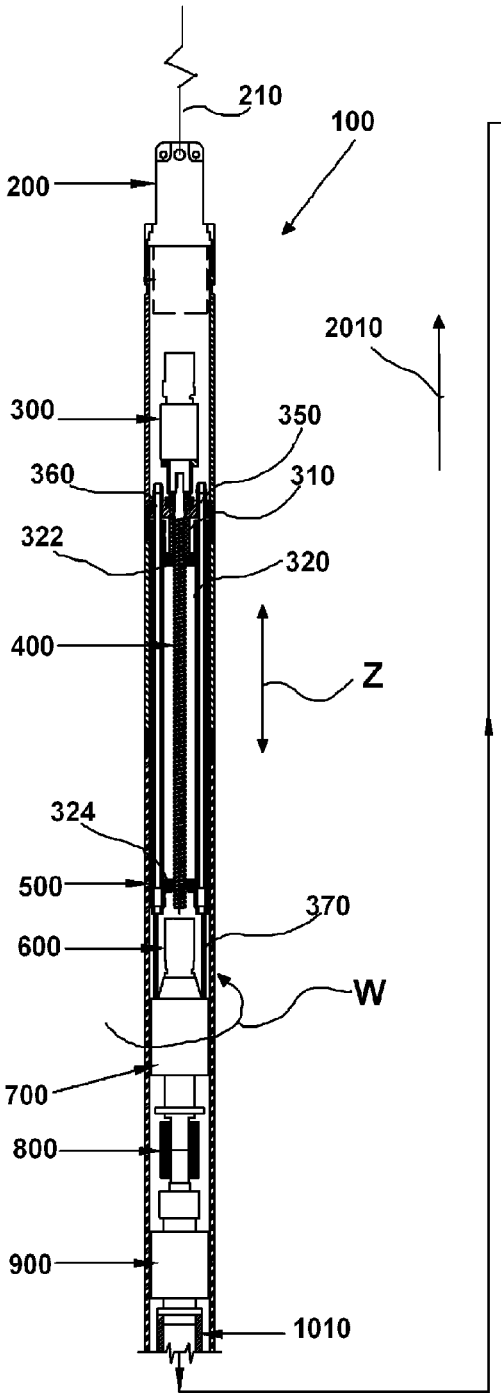
FIGS. 3A and 3B are sectional diagrams of one embodiment of controlled cutting apparatus which can be used in the method and apparatus.
Figure 3B:
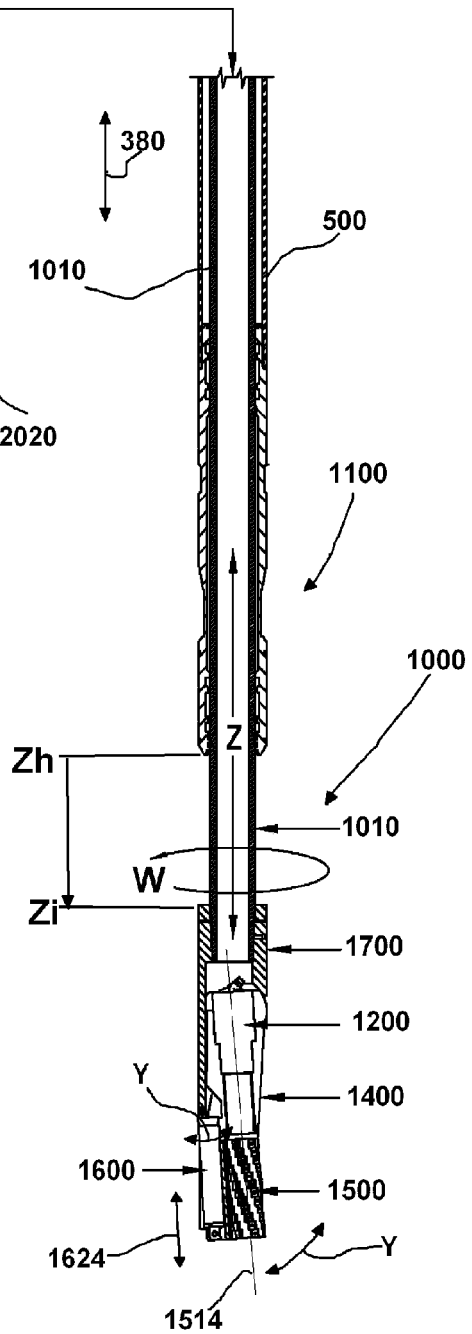
Figure 4:
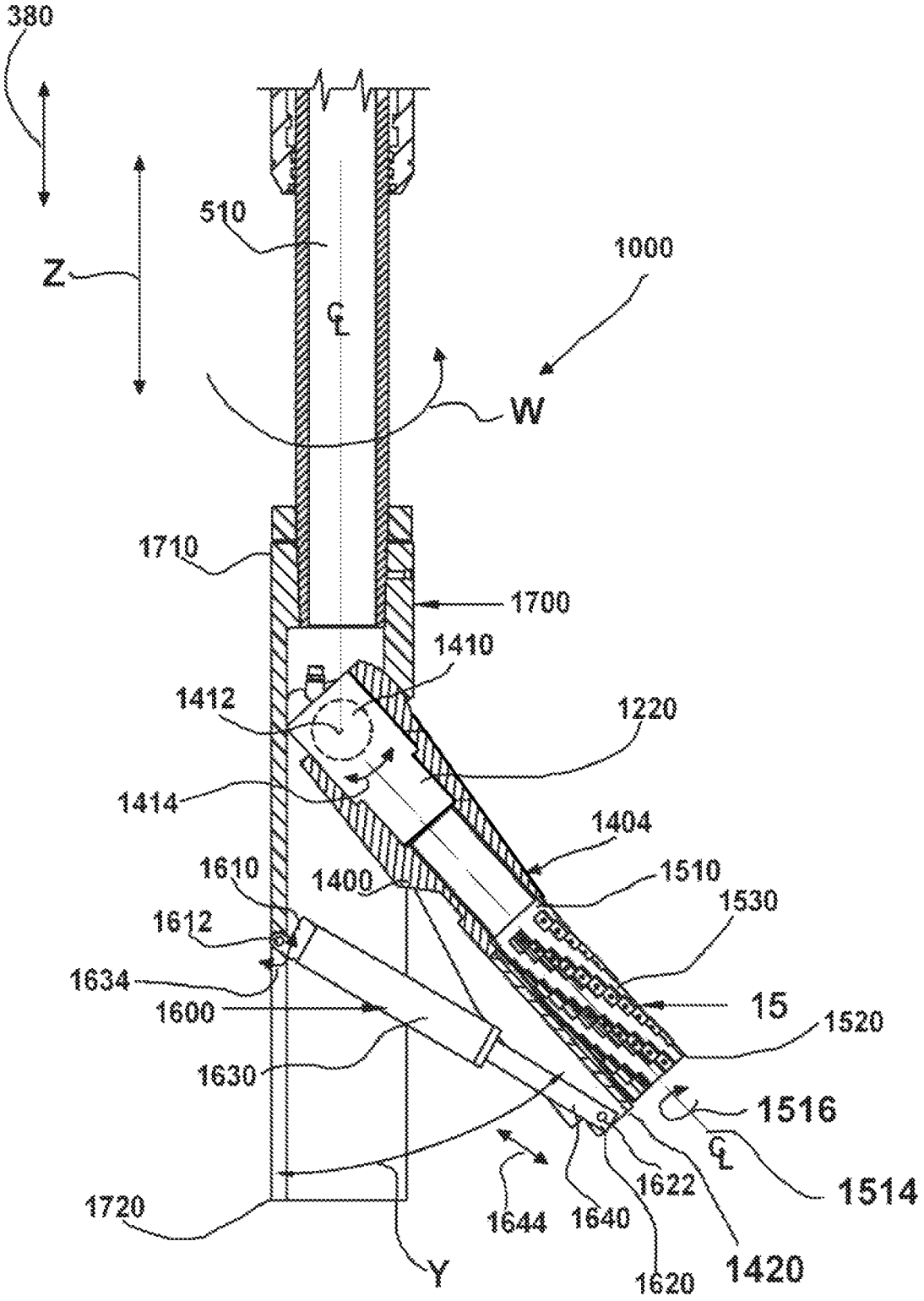
FIG. 4 is an enlarged view of the cutting head of the cutting apparatus of FIG. 1.

FIGS. 3A and 3B are sectional diagrams of one embodiment of controlled cutting apparatus 100 which can be used in the method and apparatus 10. FIG. 4 is an enlarged view of the cutting head 1000 of cutting apparatus 100.

Generally cutting apparatus 100 can comprise body 500, cutting head 1000, and elongated cutting member 1500. Tool body 500 can support a supporting a drive system that includes a first motor W-axis drive 600 and a second motor Z-axis drive 300.

Cutting apparatus 100 can include a reaction member 1800 which is attached to cutting head 1000. Reaction member 1800 can include a reaction bar having first 1810 and second ends 1820. On the second end can include a contact member 1830 which preferably is comprised of a material adequate to hand reaction forces expected to be encountered by the cutting member 1500 when cutting tubulars. Contact member 1830 is also preferably comprised of a material having a relatively small coefficient of friction to reduce reactional frictional forces on cutting head 1000 when the cutting head (and connected reaction member 1800) are moved in the Z axis direction during a cut. The length of reaction member 1800 (e.g., the length between first end 1810 and contact member 1830) is preferably long enough such that contact member 1830 will be below the lower end 77 of the cut in the first nested tubular.

Cutting apparatus 100 can have, operably connected thereto, a remote control 4000 having a display 4100 from which an operator can program, initiate, control, and/or override one or more of the operations/functions of cutting apparatus 100, cutting head 1000, and/or cutting member 1500. Remote control 4000 can have one or more controls 190 operatively connected thereto.

A collar 200 can be attached to body 500 of cutting apparatus 100. Referring to FIG. 3A, a collar 200 can be used to attach the umbilical cord, wireline, and other connecting items to the body of controlled cutting apparatus 100. Collar 200 may be exchanged to adapt to different size work strings (not shown). Additionally, collar 200 provides a quick disconnect point in case emergency removal of controlled cutting apparatus is necessary.

The anchoring system 1100 can have engaged and non-engaged conditions (e.g., see expanded packer condition 1110), wherein during the engaged condition the tool body 500 is anchored relative to the tubular, and during the non-engaged position the tool body is not anchored relative to the tubular. After cutting apparatus 100 is lowered to a selected cutting location, an anchoring system, such as a hydraulic packer 1100, can be energized to anchor body 500 of cutter 100 into well bore 60. Other types of conventionally available anchoring systems can be used in place of or in addition to packer 1100. For example expandable and retractable arms can be used which expand from body 500 to contact the interior of the innermost nested tubular of a plurality of nested tubulars. An anchoring system 1100 allows controlled Z and W axis movement of cutting head 1000 (along with cutting member 1500). An anchoring system 1100 also allows controlled Y axis movement of cutting member 1500. An anchoring system also tends minimize harmful vibrations to cutting member 1500 during cuts.

Elongated cutting member 1500 (for example, a carbide cutter) can be mounted to the milling spindle swing arm 1400, and can be pivoted out in the Y-axis by Y-axis hydraulic cylinder 1600 into the cut of a tubular member.

Controllable Movement in Z-Axis

Cutting head 1000 can be operably connected to body 500 such that cutting head 1000 can be controllably moved along a Z-axis. The cutting head 1000 can be coupled to the second motor drive 300, wherein the second motor drive 300 causes the cutting head 1000 to be selectively moved in the Z-axis relative to the tool body 500.

The Z-axis control unit can comprise Z-axis motor 300 and controls, drive cylinder 320 having upper and/or lower threaded areas 322,324, and driving screw 400. In one embodiment motor 300 is attached to body 500 via mounting plate 350, and motor 300 rotates screw 400. Because screw 400 is threadably connected to drive cylinder 320 rotation of screw 400 will cause cylinder 320 to move in the direction of the Z-axis (in the direction of arrow 2010 or arrow 2020 depending on the direction of rotation of screw 400). Additionally depending on the speed of rotation of screw 400 (along with the pitch of the threads of screw 400 the speed of movement in the Z-axis can be controlled).

Support bracket 370 connects drive cylinder 320 to W-axis motor 600. W-axis motor 600 is operably connected to cutting head tube 1010 through transmission 700, coupling 800 and rotary hydraulic coupling 900. Cutting head tube is connected to cutting head 1000. Cutting head tube 1010 is slidably connected to body 500 such that cutting head tube can, in the interior space of body 500, slide in the Z-axis (extending and retracting as desired) along with rotating in the W-axis relative to body 500. Cutting head 1000 can include elongated cutting member 1500 and Y-axis actuator 1600.

In one embodiment transmission 700 can be a step down transmission with a 126:1 ration.

Telescoping tubing 360 allow, during the extension and retraction of drive cylinder 320 an extending and retracting connection for fluid and/or electrical controls and/or sensor data to for components lower than mounting plate 350.

Controllable Movement about W-Axis

Cutting head 1000 can be operably connected to body 500 such that cutting head 1000 can be controllably rotated about a W-axis. The cutting head 1000 can be coupled to the first motor drive 600, wherein the first motor drive 600 causes the cutting head 1000 to be moved in the W-axis of rotation relative to the tool body 500.

Controllable Movement in Y-Axis

Elongated cutting member 1500 can be operably connected to cutting head such that cutting member 1500 can be controllably pivoted about a Y-axis. An arcuate actuator 1600 can be operatively connected to the spindle housing 1700, the actuator 1600 having actuator first 1610 and second 1620 end portions, the first end portion 1610 being mounted to the cutting head 1000 at an elevational position (at pivot 1612) which is below the first elevation (at pivot 1412), and at the other of its end portions 1620 being mounted (at pivot 1622) to the spindle housing 1400 at a position also below the first elevation (at pivot 1412), the actuator 1600 moving the spindle housing 1400 and elongated cutting member 1500 between first and second extreme arcuate positions (FIG. 3B and FIG. 4).

Controllable Movement about Longitudinal Axis of Cutting Member

Elongated cutting member 1500 can be operably connected to cutting head 1000 such that cutting member 1500 can be controllably rotated about an elongated cutting member's 1500 longitudinal axis. A third motor drive 1220 can be operably connected to the elongated cutting member 1500 causing the elongated cutting member 1500 to rotate about the elongated cutting member's longitudinal axis 1514 and relative to the spindle housing 1400. The speed of rotation and force of rotation can be controlled by motor 1220.

The cutting head 1000 can include: a spindle housing 1400 pivotally connected to the cutting head 1000 at a pivot 1412, the pivot 1412 being located at a first elevation, the spindle housing 1400 having: (1) an elongated cutting member 1500 with distal 1520 and proximal ends 1510, and the elongated cutting member 1500 being rotationally connected to the spindle housing 14, the elongated cutting member 1500 having a longitudinal axis (axis of rotation 1514) spanning between its first 1510 and second 1520 ends, (2) the spindle housing 14 having a second lower distal end portion 1420 and first upper proximal end portion 1410, the upper proximal end portion 1410 being connected to the cutting head 1000 at the pivot 1412, the spindle housing 1400 and elongated cutting member 1500 being able to travel through an arcuate path (Y-axis) having first and second extreme arcuate positions, wherein the first extreme arcuate position (FIG. 3B) is more closely aligned with the Z-axis compared to the second extreme arcuate position (FIG. 4), and the second extreme arcuate position (FIG. 4) is more closely aligned with the W-axis compared to the first extreme arcuate position (FIG. 3B). Arrows 1414 schematically indicating pivoting about pivot 1412.

Figure 4A:
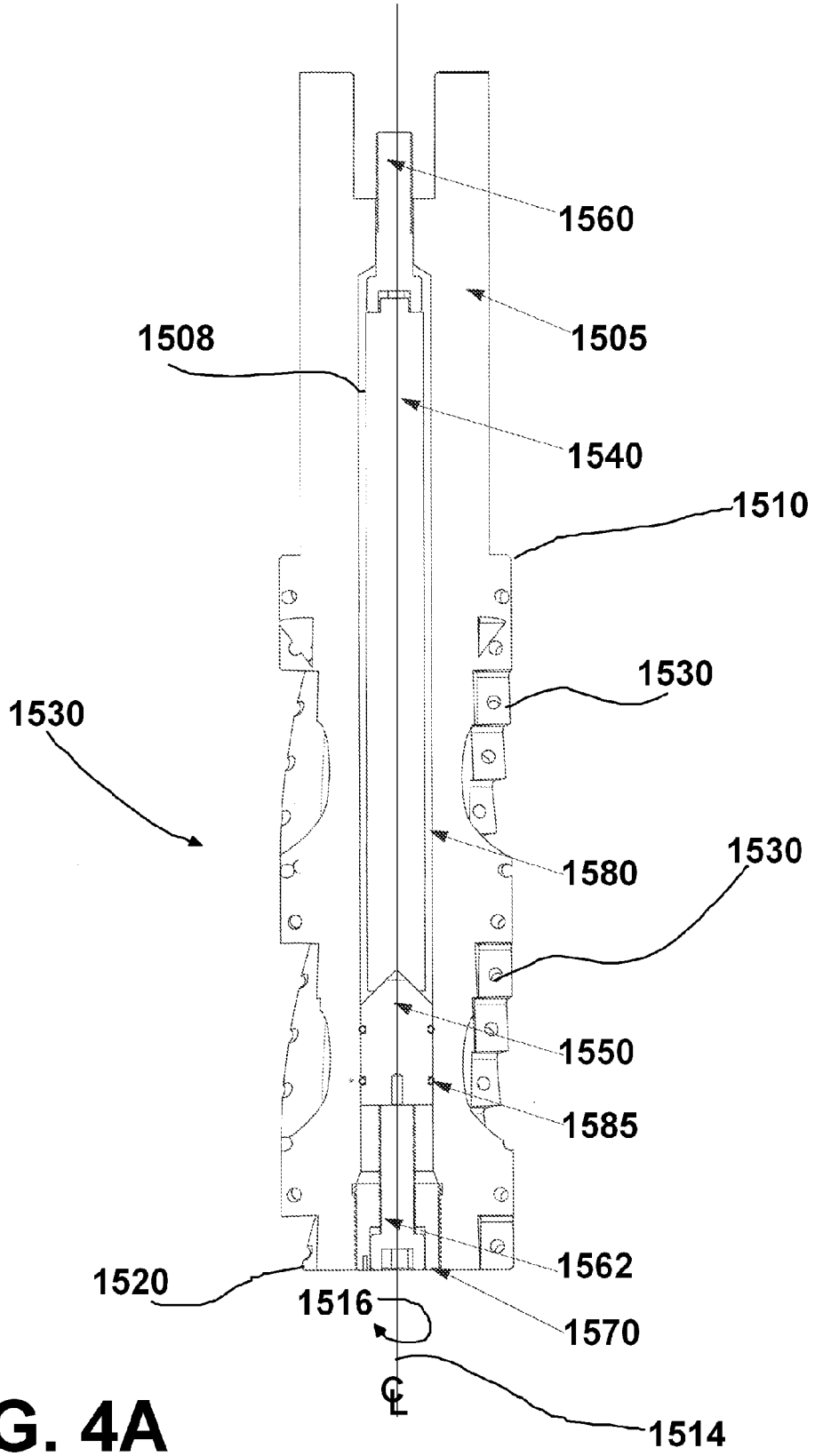
FIG. 4A is a schematic view of the milling bit from the cutting head of FIG. 4.

FIG. 4A is a sectional view of the cutting bit 1500 separated from the cutting head 1000. Cutting bit 1500 comprises body 1505 having first end 1510 and second end 1520. Between first and second ends are a plurality of teeth 1530 which can spin about axis of rotation 1514 (arrow 1516 schematically indicating rotation about axis of rotation 1514, and spinning can occur in the opposite direction of arrow 1516).

A vibration reduction system can be included in cutting bit 1500 which can comprise an opening 1508 in body 1505, wherein such opening 1508 is filled with heavy oil 1580. Cap 1570 can be threadably connected to body 1505 at second end 1520. Screw 1560 can be threadably connected to body 1505 at first end 1510. Screw 1562 can be threadably connected to cap 1570.

Spanning opening 1508 can be bar 1540 (which can be kept under tension between screw 1560 and screw 1560) causing body 1505 of cutting bit 1500 to be kept under compression. Opening. Opening 1508 can be sealed by plunger 1550 having O-ring seals 1585 keeping heavy oil 1580 in opening 1508. The combination of heavy oil 1508 and tension of bar 1540 assists in reducing vibrations in cutting bit 1500 during cutting.

In one embodiment body 1505 can be an alloy steel, bar 1540 can be tungsten, and plunger 1550 and cap 1570 can be aluminum bronze.

One Embodiment of Method and Apparatus

Below is included one embodiment of a method for using of cutting apparatus 100 for severing a plurality of nested tubulars 70 (which can be concentrically or eccentrically nested relative to each other), each tubular having a tubular bore, the nested tubulars being disposed in a well bore and wherein there is an outer tubular and an inner tubular inside the bore of the outer tubular, method comprising the steps of:

(a) providing a cutting tool, the cutting tool including:

(i) a tool body 500 configured to be lowered (such as by wireline 210) into the tubular bore of the innermost nested tubular, the tool body 5 having a longitudinal Z-axis, a W-axis of rotation generally perpendicular to the Z-axis, and an anchoring system 1100 attached to the tool body, the anchoring system 1100 having engaged and non-engaged conditions (e.g., see expanded packer condition 1110), wherein during the engaged condition the tool body 500 is anchored relative to the tubular, and during the non-engaged position the tool body is not anchored relative to the tubular;

(ii) the tool body 500 including a cutting head 1000 movably connected to the tool body 500 in both the Z and W axes, the tool body 500 supporting a drive system that includes a first motor W-axis drive 600 and a second motor Z-axis drive 300;

(iii) the cutting head 1000 being coupled to the first motor drive 600, wherein the first motor drive 600 causing the cutting head 1000 to be moved in the W-axis of rotation relative to the tool body 500;

(iv) the cutting head 1000 being coupled to the second motor drive 300, wherein the second motor drive 300 causing the cutting head 1000 to be moved in the Z-axis relative to the tool body 500;

(v) the cutting head 1000 including: a spindle housing 1400 pivotally connected to the cutting head 1000 at a pivot 1412, the pivot 1412 being located at a first elevation, the spindle housing 1400 having: (1) an elongated cutting member 1500 with distal 1520 and proximal ends 1510, and the elongated cutting member 1500 being rotationally connected to the spindle housing 14, the elongated cutting member 1500 having a longitudinal axis (axis of rotation 1514) spanning between its first 1510 and second 1520 ends, (2) the spindle housing 14 having a second lower distal end portion 1420 and first upper proximal end portion 1410, the upper proximal end portion 1410 being connected to the cutting head 1000 at the pivot 1412, the spindle housing 1400 and elongated cutting member 1500 being able to travel through an arcuate path (Y-axis) having first and second extreme arcuate positions, wherein the first extreme arcuate position (FIG. 3B) is more closely aligned with the Z-axis compared to the second extreme arcuate position (FIG. 4), and the second extreme arcuate position (FIG. 4) is more closely aligned with the W-axis compared to the first extreme arcuate position (FIG. 3B);

(vi) an arcuate actuator 1600 operatively connected to the spindle housing 1700, the actuator having 1600 actuator first 1610 and second 1620 end portions, the first end portion 1610 being mounted to the cutting head 1000 at an elevational position (at pivot 1612) which is below the first elevation (at pivot 1412), and at the other of its end portions 1620 being mounted (at pivot 1622) to the spindle housing 1400 at a position also below the first elevation (at pivot 1412), the actuator 1600 moving the spindle housing 1400 and elongated cutting member 1500 between first and second extreme arcuate positions (FIG. 3B and FIG. 4); and (vii) a third motor drive 1220 operably connected to the elongated cutting member 1500 causing the elongated cutting member 1500 to rotate about the elongated cutting member's longitudinal axis 1514 and relative to the spindle housing 1400;

(b) from a surface location lowering the cutting tool into an innermost tubular of a plurality of nested tubulars;

(c) the third drive motor 1220 causing the elongated cutting member 15 to rotate about the rotational cutting axis 1514;

(d) the actuator 1600 causing the rotational cutting axis 1514 to move between the first and second extreme arcuate angles (FIGS. 3B and 4 with rod 1640 respectively in retracted and extended conditions);

(e) the second drive motor 600 rotating the cutting head 1000 in the W-axis;

(f) after step "b" and before step "g" the third drive motor 300 moving the cutting head 17 in the Z axis (in the direction of arrow 380 either upwardly 2010 or downwardly 2020 by turning driving screw 400 to move driving nut 310); and (g) before raising the tool body 500 to the surface location 30, completely severing the plurality of the nested tubulars 70 with the elongated cutting member 1500.

In the preferred embodiment, after anchoring body 500 of cutter 100, Z-axis motor 300 causes cutting head 1000 to move in the direction of arrow 2020 to a down position. Such initial downward movement of cutting head 1000 permits elongated cutting member 1500 to begin cutting at the lowest point of the cut (e.g., point 77 in tubular 75) and be raised (in the direction of arrow 2010) as needed to cause a depth of cut (e.g., depth 78 in tubular 75) sufficient to allow elongated cutting member 1500 access to make cuts in the larger nested tubulars (e.g., tubular 80, 85, etc.) of a plurality of nested tubulars 70.

Figure 1:
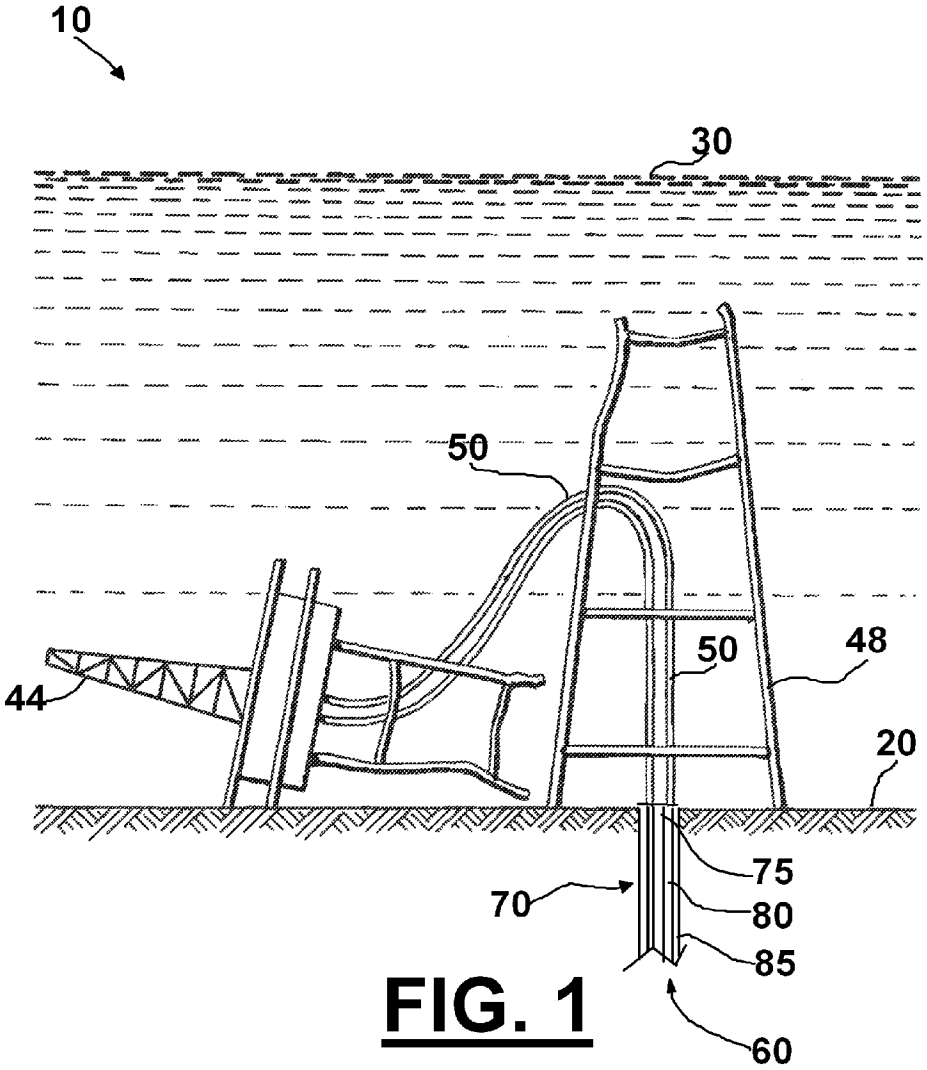
FIG. 1 shows a schematic view of a rig which has collapsed with a wellbore that will be abandoned.

FIG. 1 shows a schematic view of a rig 40 which has collapsed with a wellbore 60 (along with a plurality of nested tubulars 70) that will be abandoned. Tubular is intended to be broadly construed to include pipe, tubing, casing, conduit, along with other cylindrical items that can be installed in a wellbore 60.

Figure 2:
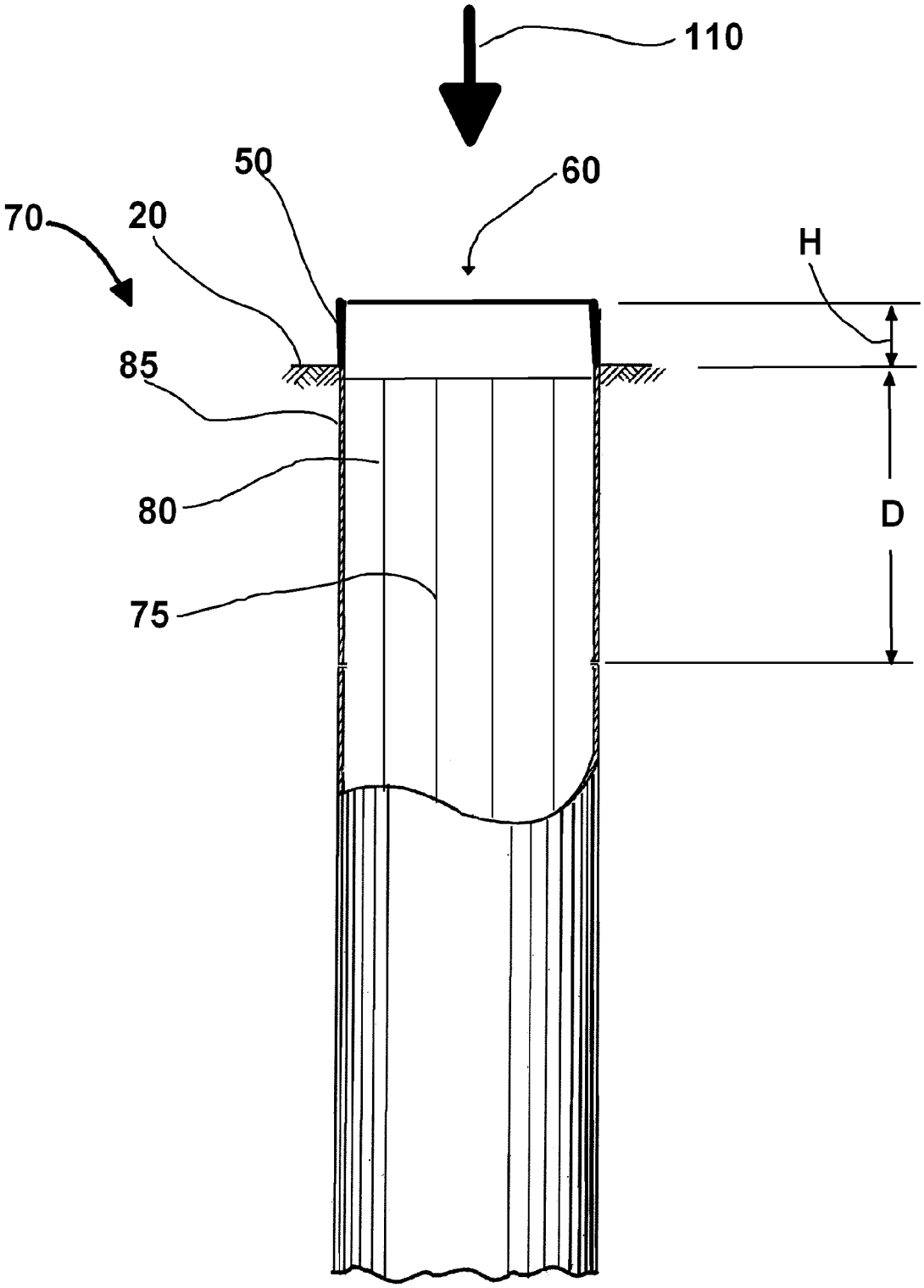
FIG. 2 shows a plurality of nested tubulars from the wellbore of FIG. 1.

FIG. 2 shows three nested tubulars 75, 80, and 85 of a plurality of nested tubulars 70 which are to be cut by cutting apparatus 100 (where these tubulars are concentrically positioned relative to each other). In various embodiments the tubulars can have in their annuluses between them combinations of cement and/or formation rock (although such is not shown in FIG. 2).

In FIG. 2, riser 50 shown in FIG. 1 has been previously cut to a height "H" above sea floor 20 by conventionally available methods (such as wireline) to provide easy access to the interior of the innermost nested tubular 75. To properly abandon wellbore 60 the plurality of nested tubulars 70 must be cut to a depth D below sea floor 20 which exceeds regulatory requirements.

FIGS. 3A and 3B are sectional diagrams of one embodiment of controlled cutting apparatus 100 which can be used in the method and apparatus 10.

FIG. 4 is an enlarged view of the cutting head 1000 of cutting apparatus 100.

Figure 5:
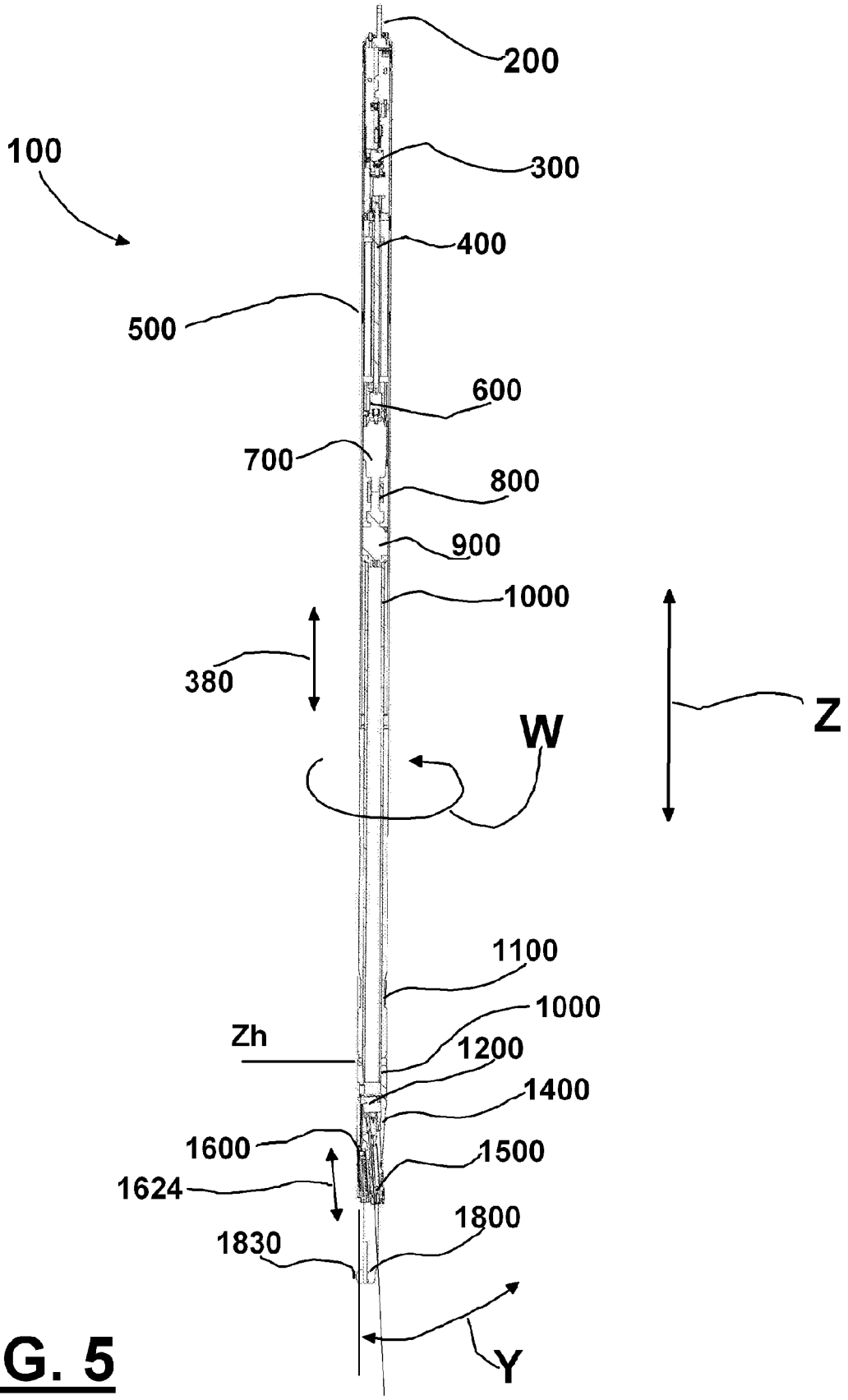
FIG. 5 is a side view of one embodiment of a controlled cutting apparatus which can be used in the method and apparatus

FIG. 5 is a side view of one embodiment of a controlled cutting apparatus 100 which can be used in the method and apparatus 10. Cutting apparatus is shown in the state at which it will be lowered into the innermost nested tubular 75 for a cut. In this state cutting member 1500 is in its home position or the smallest Y-axis position (compared to the Z-axis). However, it should be noted that the home Y-axis position of cutting member 1500 is not zero degrees. Preferably, this home Y-axis position can 1, 2, 3, 4, 5, 6, 7, 8, 9, or 10 degrees from the Z-axis. In various embodiments the home Y-axis position can be a range between any two of the above stated home Y-axis positions. The cutting head is also shown in the home Z-axis position—where tube 1010 is maximally retracted into body 500 of cutting apparatus 100. The cutting head is also shown in the home W-axis which can be an arbitrarily chosen position in the W-axis because cutting apparatus 1000 will be lowered on line 210 by vessel 300, and while being lowered, cutting apparatus 1000 itself can rotate somewhat freely in the W-axis. After cutting apparatus has been put in the anchored state (such as by inflation of packer 1100 in tubular 75), relative movement of cutting head 1000 in the W-axis can be monitored and measured (i.e., when cutting apparatus is in place and anchored for a cut). In FIG. 5 hydraulic packer 1100 is shown deflated or in the non-anchored state.

Figure 6:
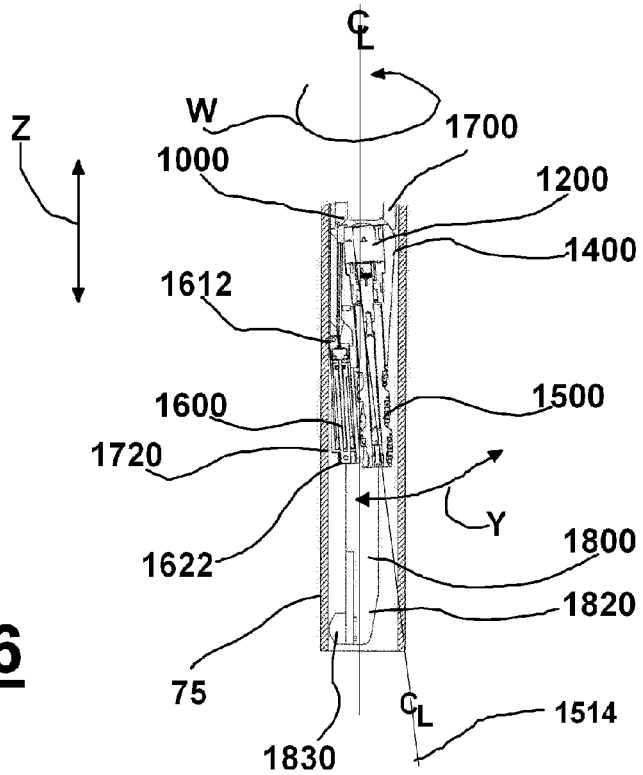
FIG. 6 is an enlarged side sectional view of the cutting head of the cutting apparatus of FIG. 5.
Figure 7:
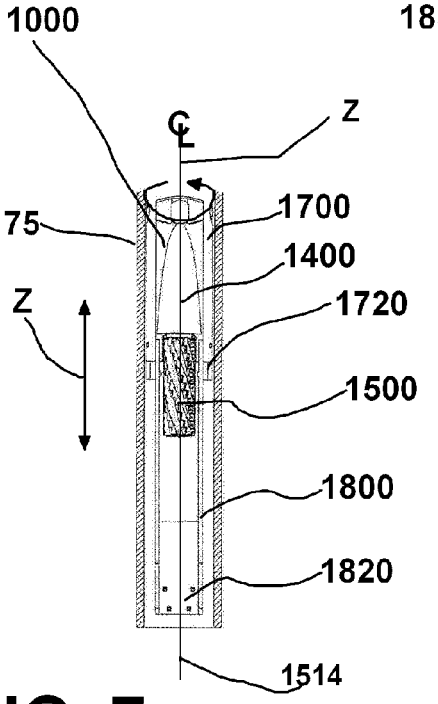
FIG. 7 is an enlarged front view of the cutting head of the cutting apparatus of FIG. 5.
Figure 8:
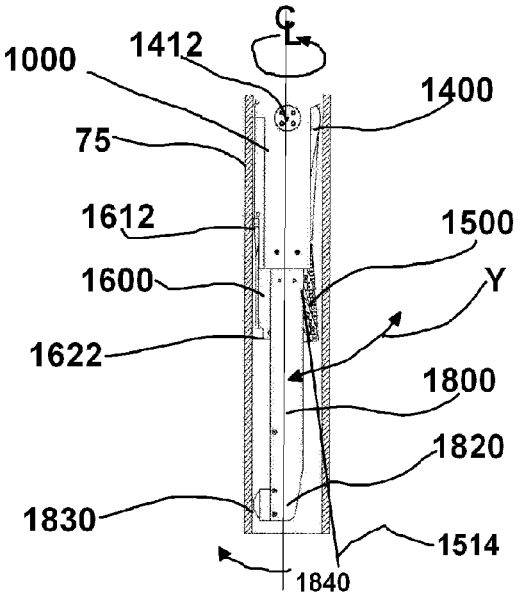
FIG. 8 is an enlarged side view of the cutting head of the cutting apparatus of FIG. 5, taken from the opposing side as that shown in FIG. 6.

FIG. 6 is an enlarged side sectional view of cutting head 1000 of cutting apparatus 100 where cutting member 1100 is shown in the home or Y-axis retracted state. FIG. 7 is an enlarged front view of cutting head 1000 of cutting apparatus 100. FIG. 8 is an enlarged side view of cutting head 1000 of cutting apparatus 100 taken from the opposing side as that shown in FIG. 6. Arrow 1840 schematically indicates reaction force being placed on cutting head 1000 when cutting member 1500 moves out in the Y-axis direction. Such reaction force will tend to cause the body 500 of cutting apparatus to pivot about its anchor point (e.g., the place of anchor by packer 1100) in the direction of arrow 1840. Such pivoting is limited by contact surface 1830 of reaction member 1800 contacting innermost tubular 75 where such contact will cause an equal and opposing reaction force to be applied to contact member 1830 and body 500. In this manner reaction member 1800 helps stabilizing cutting apparatus 100 during a cut.

Figure 9:
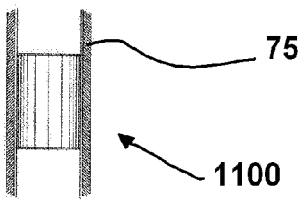
FIG. 9 is a schematic view of packer system which can be used by the cutting apparatus of FIG. 5 (shown in the collapsed or non-anchored condition)
Figure 10:
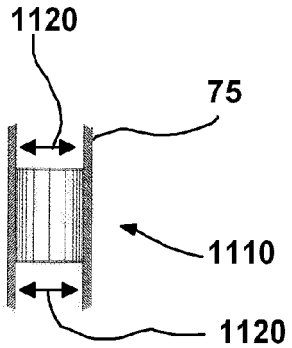
FIG. 10 is a schematic view of packer system which can be used by the cutting apparatus of FIG. 5 (shown in the expanded or anchored condition)

FIG. 9 is a schematic view of packer system 1100 which can be used by cutting apparatus 100 (shown in the collapsed or non-anchored condition) to place cutting apparatus 100 in anchored and non-anchored states relative to the innermost nested tubular 75. FIG. 10 is a schematic view of packer system 1100 shown in the expanded or anchored condition.

Figure 11:
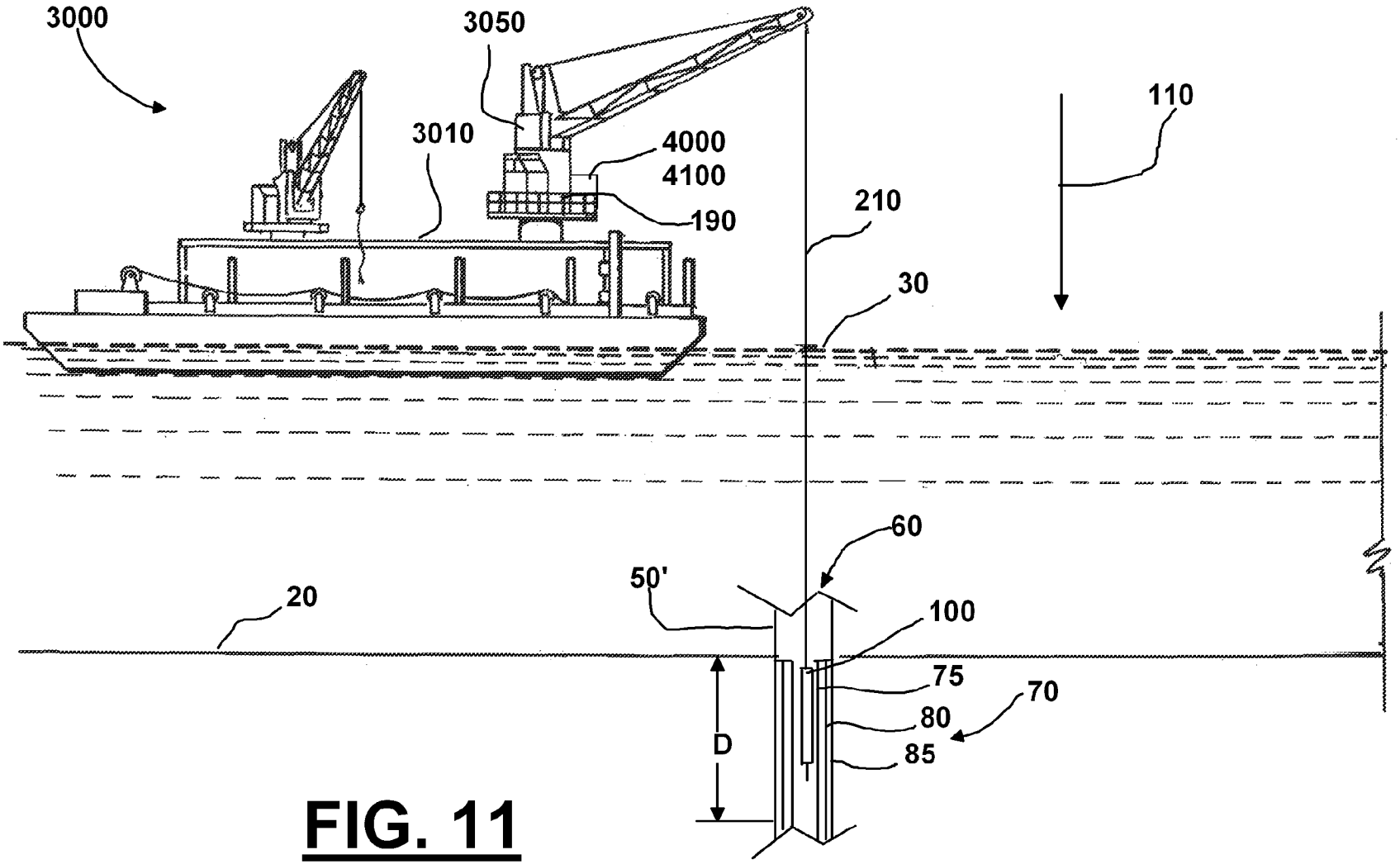
FIG. 11 is a schematic view of a vessel lowering the controlled cutting apparatus of FIG. 5 into a plurality of nested tubulars to be cut at least a specified depth below the sea floor.

FIG. 11 is a schematic view of a vessel 3000 using crane 3050 to lower (schematically indicated by arrow 110) controlled cutting apparatus 100 into a plurality of nested tubulars 70 to be cut at least a specified depth "D" below sea floor 20. This is a schematic figure and not to scale. An operator can control cutting apparatus 100 using remote controller 4000, with controller having a display 4100 for ease of operation.

Figure 12:
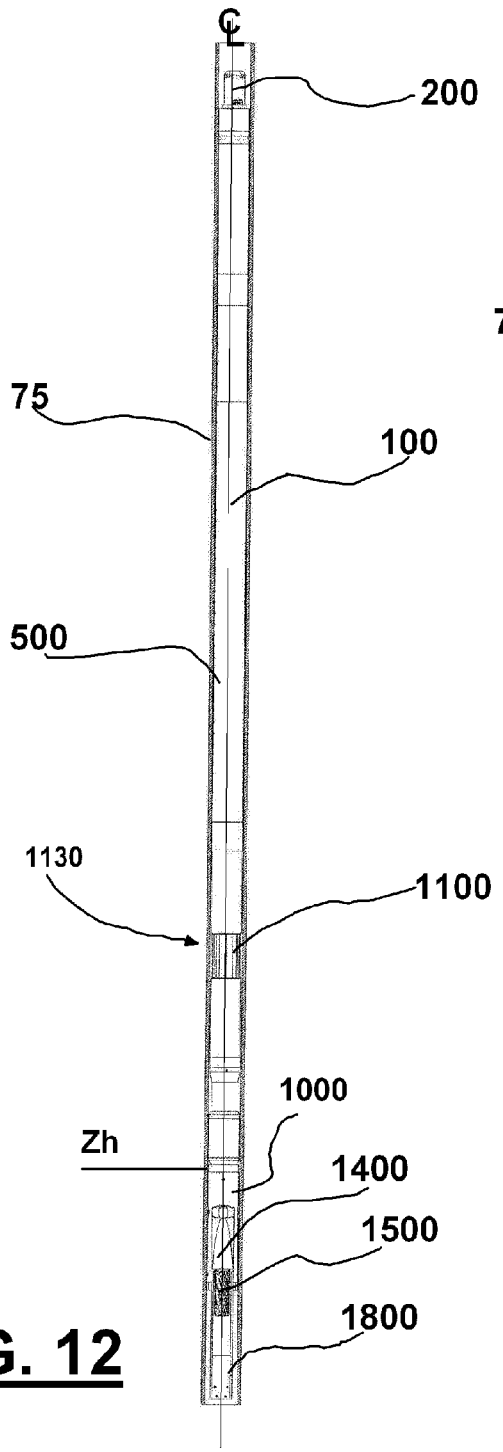
FIG. 12 is a schematic front view of the controlled cutting apparatus of FIG. 11 after being lowered into an anchoring position for a plurality of nested tubulars of FIG. 1 (only one tubular shown for clarity) to be cut at least a specified depth below the sea floor.
Figure 13:
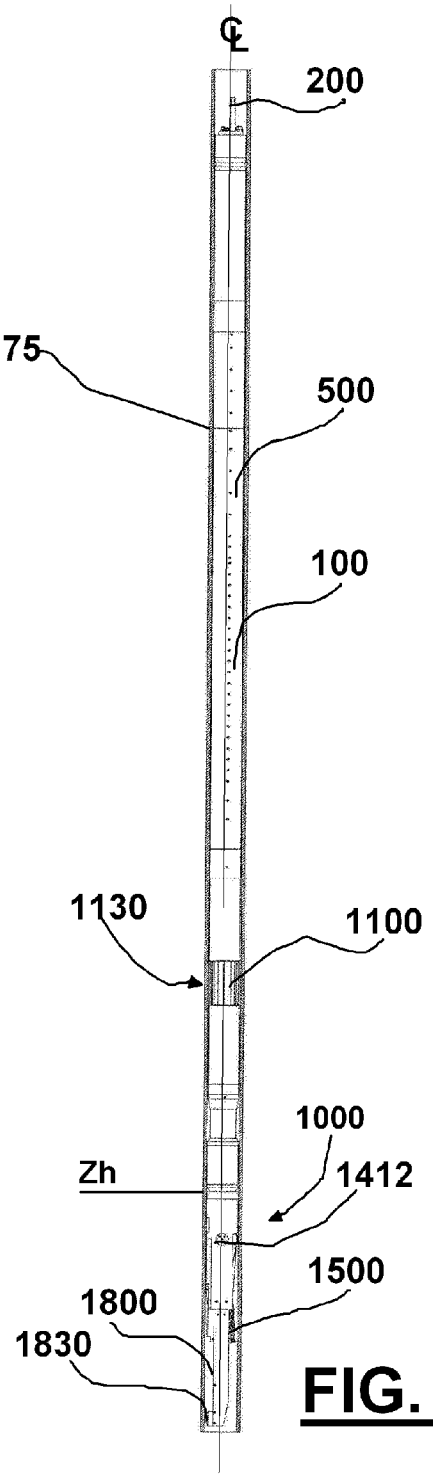
FIG. 13 is a schematic side view of the controlled cutting apparatus of FIG. 11 after being lowered into an anchoring position for a plurality of nested tubulars of FIG. 1 (only one tubular shown for clarity) to be cut at least a specified depth below the sea floor.
Figure 14:
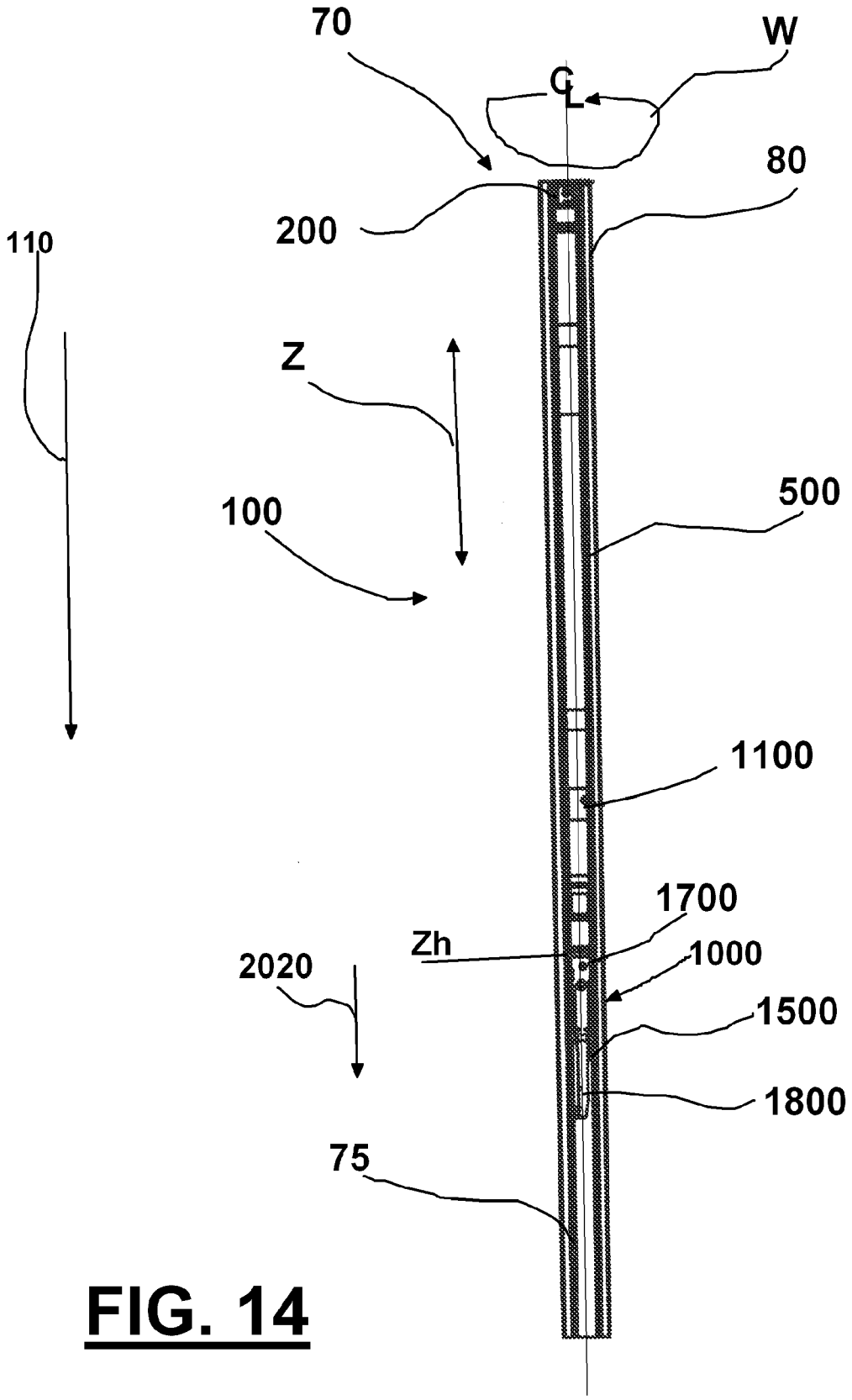
FIG. 14 is a schematic front view of the controlled cutting apparatus of FIG. 11 after being lowered into an anchoring position for a plurality of nested tubulars of FIG. 1 (now with all three of the tubulars showny) to be cut at least a specified depth below the sea floor.

FIG. 12 is a schematic front view of controlled cutting apparatus 100 after being lowered into an anchoring position for cutting a plurality of nested tubulars 70 (however, for clarity only one tubular 75 is shown for clarity) to be cut at least a specified depth "D" below sea floor 20. FIG. 13 is a schematic side view of controlled cutting apparatus 100 after being lowered into an anchoring position for cutting a plurality of nested tubulars 70 (however, for clarity only one tubular 75 is shown for clarity) to be cut at least a specified depth "D" below sea floor 20. FIG. 14 is a schematic front view of controlled cutting apparatus 100 after being lowered into an anchoring position for cutting a plurality of nested tubulars 70 (now with all three of the tubulars 75, 80, and 85 shown) to be cut at least a specified depth "D" below the sea floor 20. In these figures cutting head 1000 is fully retracted and in the home position in the Z axis (schematically indicated by Zh). Cutting head 1000 is also in the home position for the W axis; and cutting member 1500 is in the home position in the Y-axis FIGS. 15 through 18 schematically illustrate various steps using cutting apparatus 100 to make a cut in the first nested tubular 75 of the plurality of nested tubulars 70.

Figure 15:
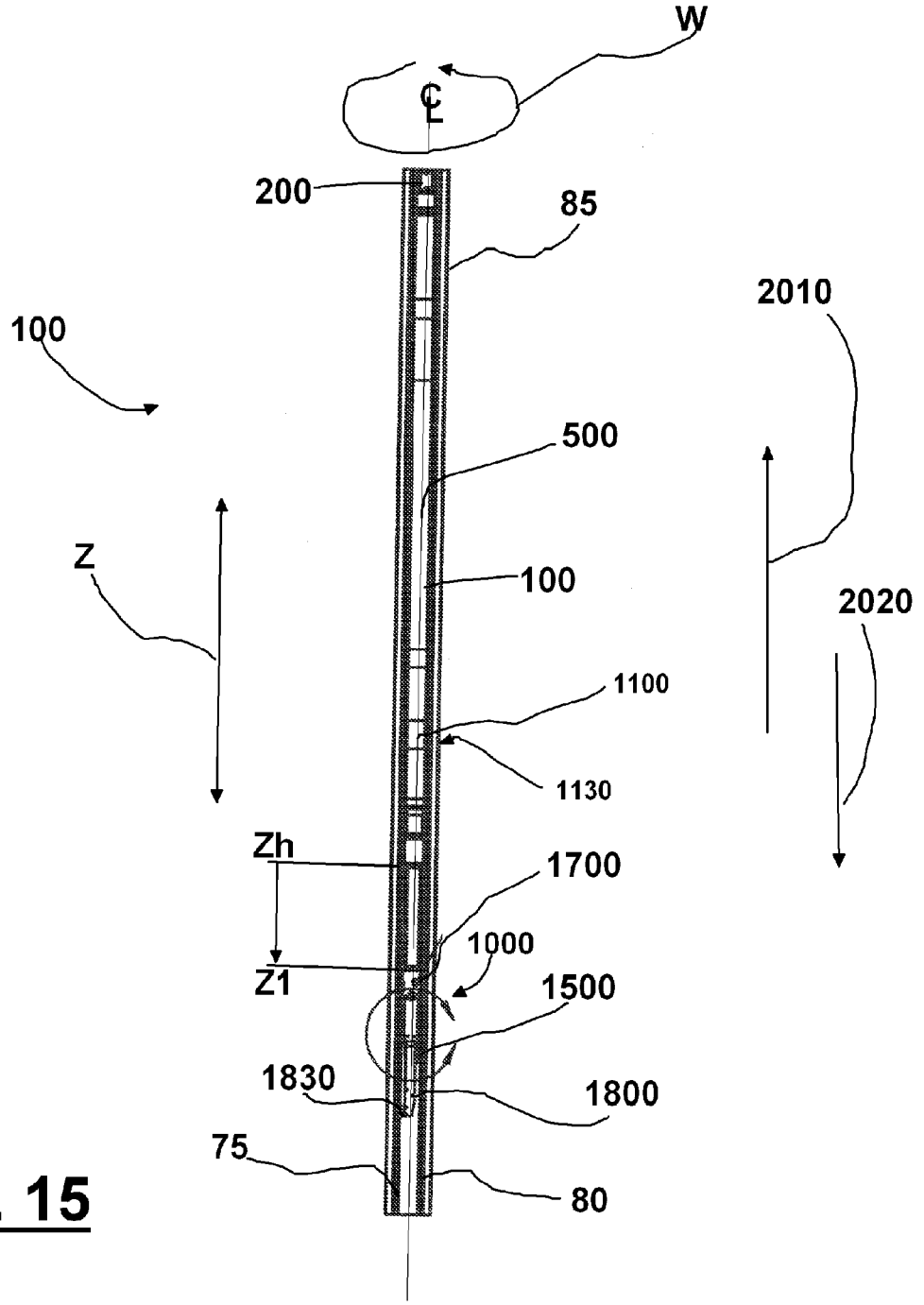
FIG. 15 is a view schematically showing the beginning of the cut made by the cutting apparatus of FIG. 11 in the first tubular.
Figure 16:
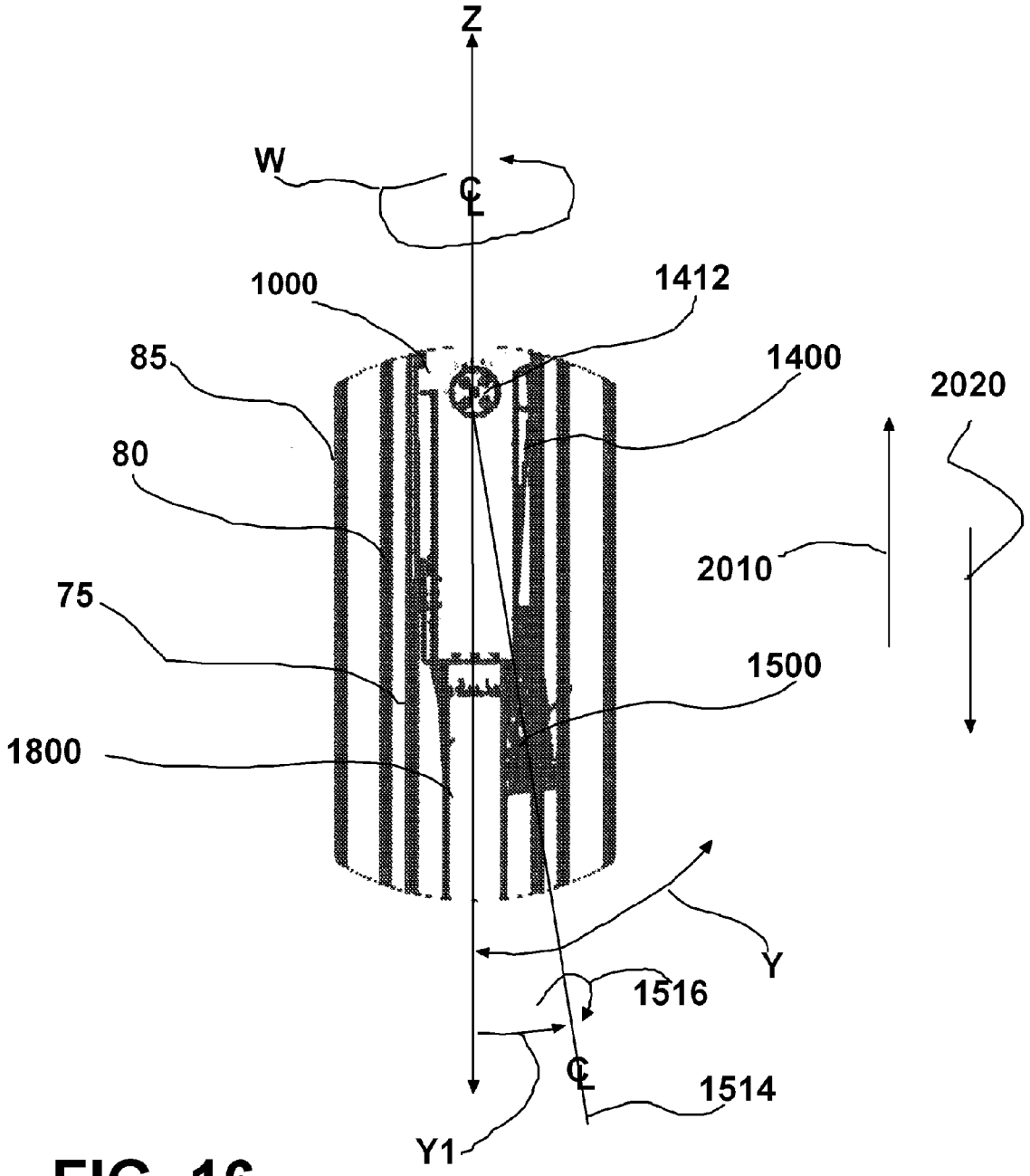
FIG. 16 is an enlarged view of the cutting head portion of the cutting apparatus shown in FIG. 15.

FIG. 15 is a view which schematically shows the beginning of a cut being made by cutting apparatus 100 in first tubular 75. FIG. 16 is an enlarged view of cutting head portion 1000 of cutting apparatus 100 in the position shown in FIG. 15. In these figures cutting head 1000 has extended in the Z-axis from the home position (Zh) to the position to start the first cut (Z1). Also in these figures cutting member 1500 has pivoted from the home position in the Y axis to the Y-axis position Y1 to make the first cut (schematically indicated by Y1). While making the cut cutting member 1500 will be rotated about its longitudinal axis 1514 (schematically indicated by the arrow about axis 1514) at a controlled rotational speed. Also while making the cut cutting head 1000 will be rotated in the W-axis at a controlled rotational speed (schematically indicated by the W-arrow). Also while making this cut, cutting head 1000 will be pulled up in the direction of arrow 2010 along the Z-axis from Z-axis location Z1 to Z-axis location Z2. In this manner cutting member 1500 will traverse an upward helical or spiral pathway cutting a swath in the tubular.

Figure 17:
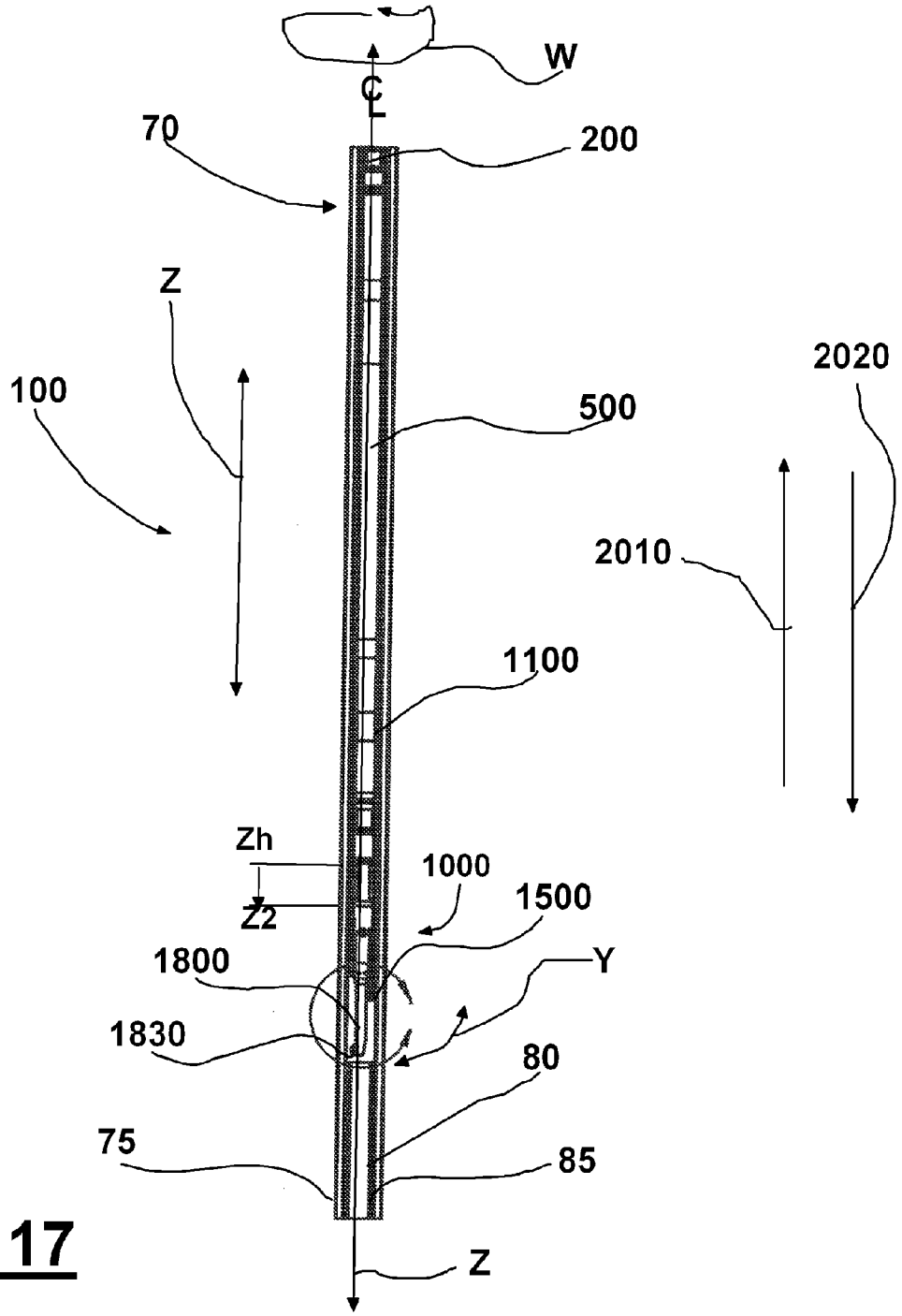
FIG. 17 is a view schematically showing the end of the cut made by the cutting apparatus of FIG. 11 in the first tubular.
Figure 18:
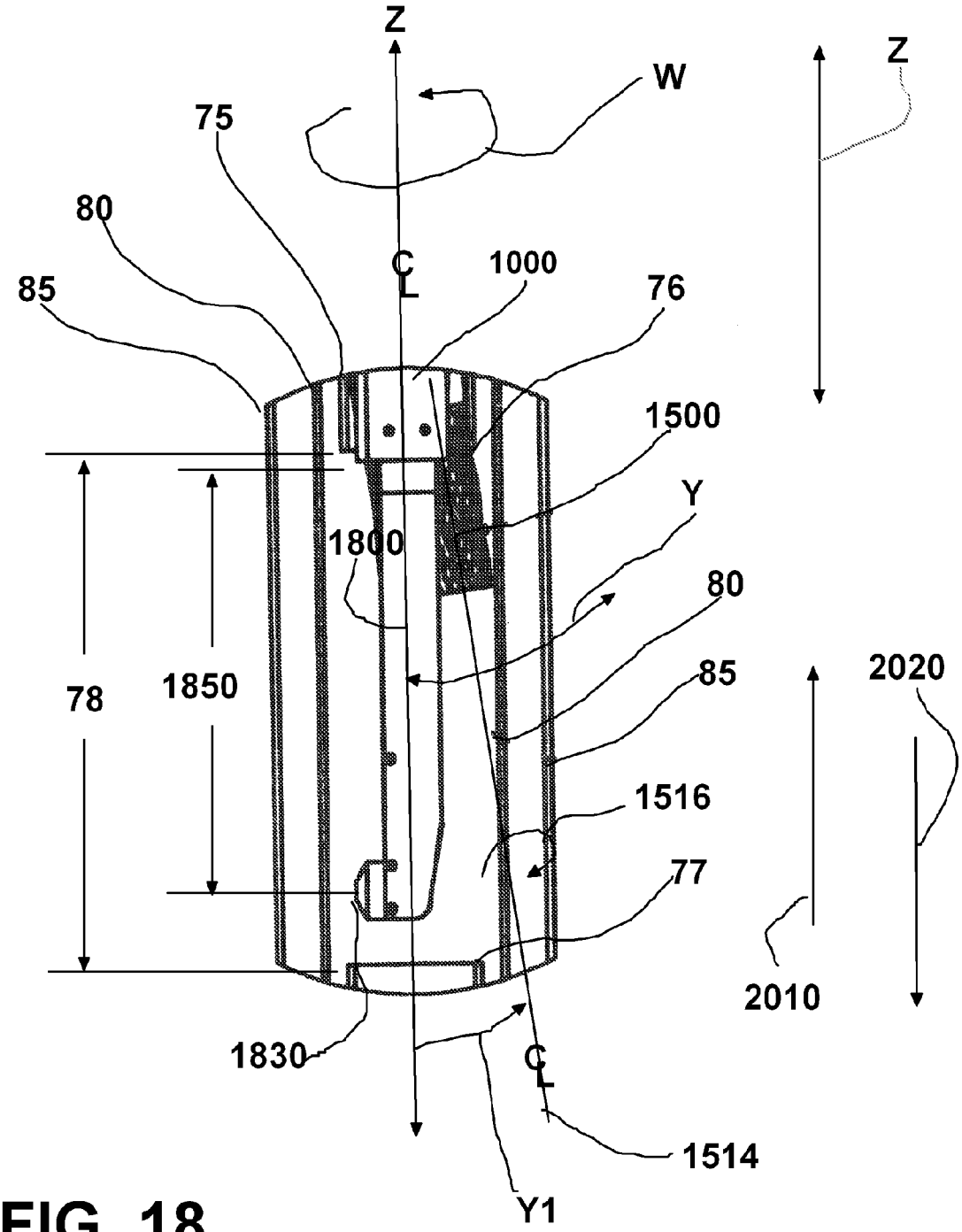
FIG. 18 is an enlarged view of the cutting head portion of the cutting apparatus shown in FIG. 17.

FIG. 17 is a view schematically showing the end of a cut being made by cutting apparatus 100 in the first tubular 75. FIG. 18 is an enlarged view of cutting head 1000 portion of cutting apparatus 100 in the position shown in FIG. 17. While making this cut, cutting head 1000 was pulled up in the direction of arrow 2010 along the Z-axis from Z-axis location Z1 to Z-axis location Z2 (which is more retracted compared to position Z1). Now a swath or cut has been made in nested tubular 75 from bottom 77 to top 76 making a gap 78. It is noted that in FIG. 18 length 1850 of reaction arm 1800 is shown where contact member 1830 loses contact with tubular 75 as cutting head 1000 is retracted along the Z-axis (to position Z2). It is preferable that length 1850 is long enough so that contact member will maintain contact during the retracting process of the first cut. However, continuous contact of contact member 1830 may not be as important (compared to tubulars 80, 85, etc) for cutting the first tubular 75 because the first tubular will have the smallest diameter and the smallest vibration issues (compared to larger tubulars 80, 85, etc).

FIGS. 19 through 22 schematically illustrate various steps using cutting apparatus 100 to make a cut in the second nested tubular 80 of the plurality of nested tubulars 70.

Figure 19:
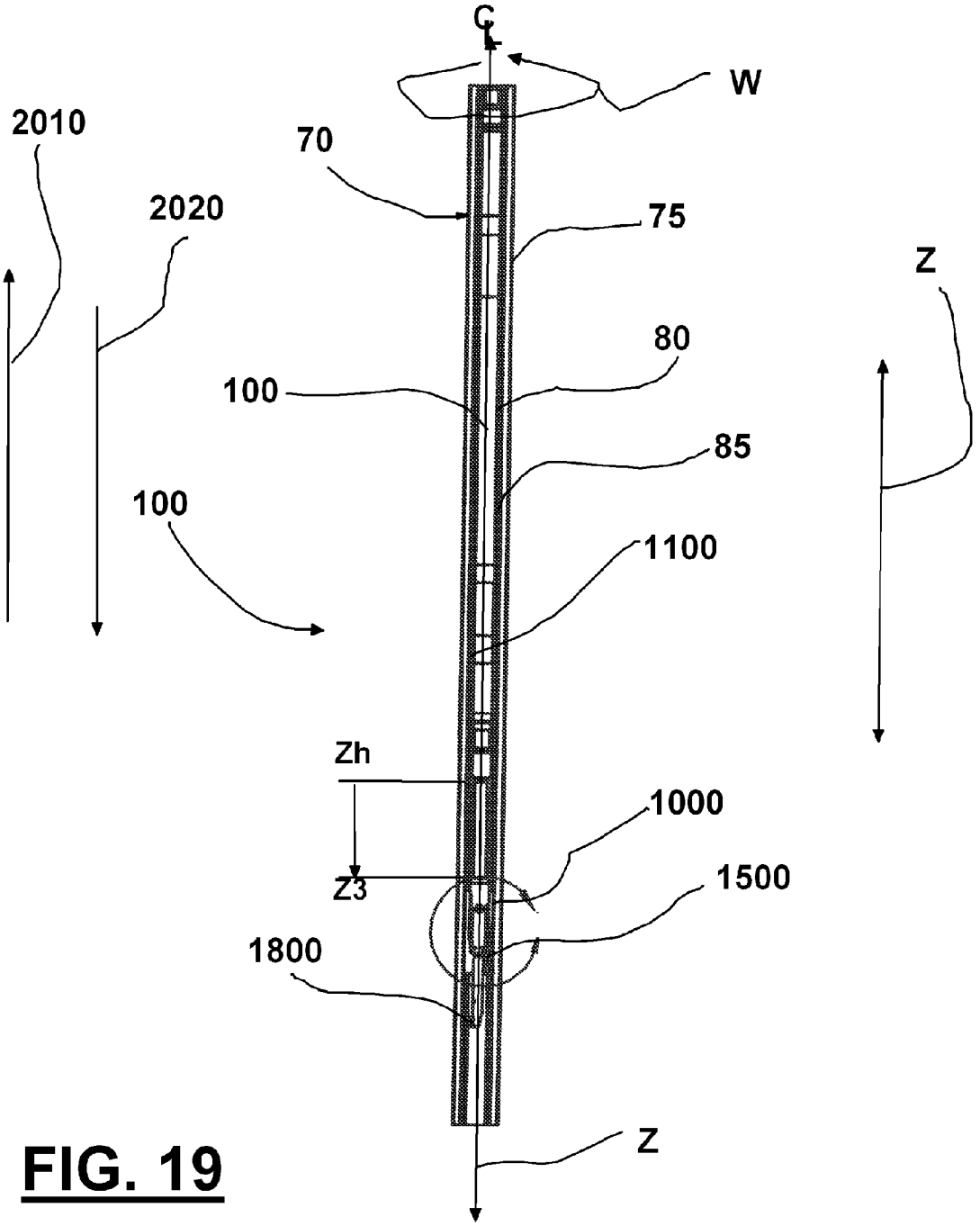
FIG. 19 is a view schematically showing the beginning of the cut made by the cutting apparatus of FIG. 11 in the second tubular, after having completed the cut in the first tubular.
Figure 20:
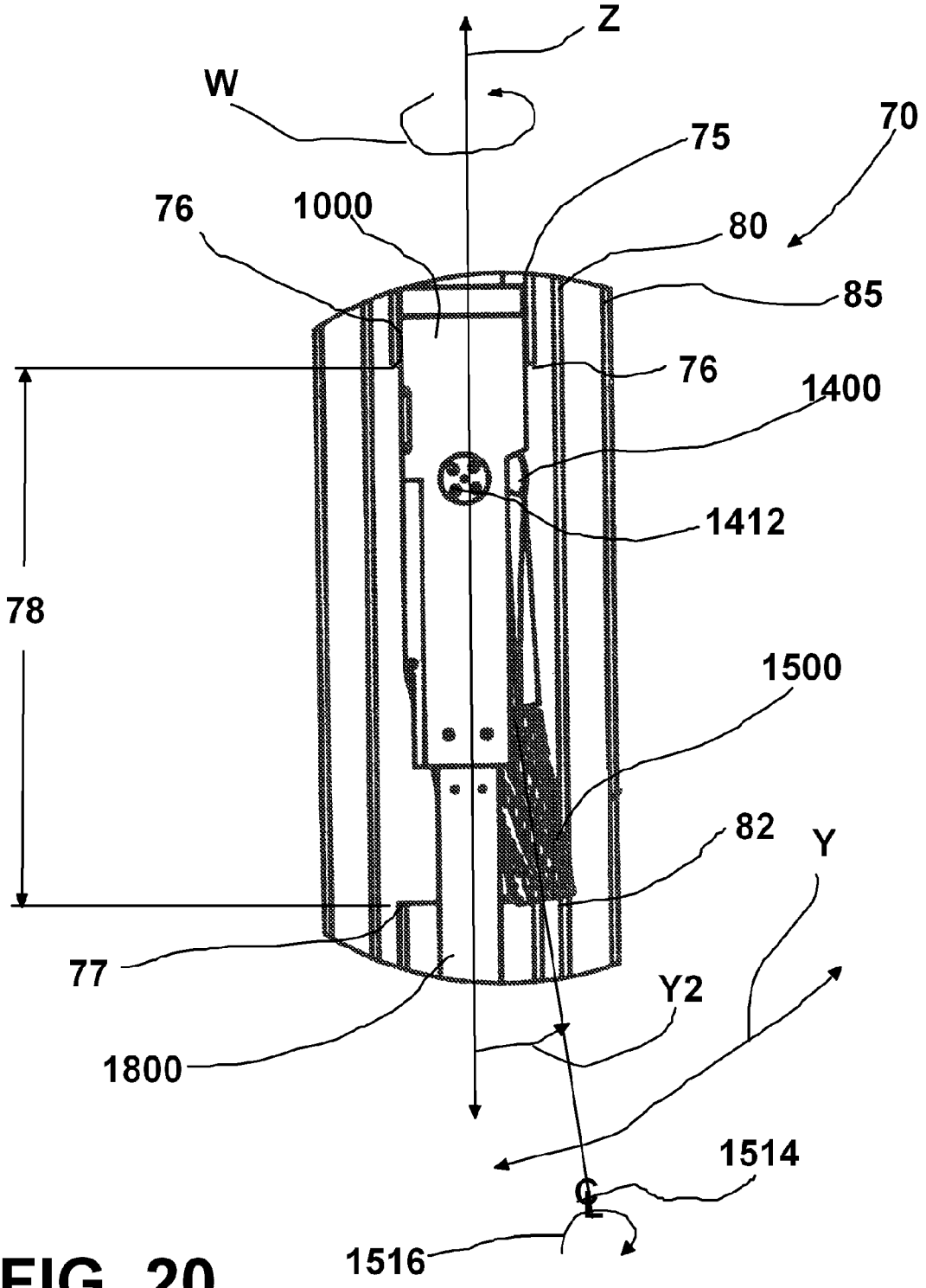
FIG. 20 is an enlarged view of the cutting head portion of the cutting apparatus shown in FIG. 19.

FIG. 19 is a view which schematically showing the beginning of a cut being made by cutting apparatus 100 in second tubular 80, after having completed the cut in the first tubular 75 (with a cut depth 78 in the first tubular 75). FIG. 20 is an enlarged view of cutting head 1000 portion of cutting apparatus 100 in the position shown in FIG. 19. In these figures cutting head 1000 has extended in the Z-axis from the home position (Zh) to the position to start the first cut (Z3). Also in these figures cutting member 1500 has pivoted to the Y-axis position Y2 to make the second cut (schematically indicated by Y2). While making the cut cutting member 1500 will be rotated about its longitudinal axis 1514 (schematically indicated by the arrow about axis 1514) at a controlled rotational speed. Also while making the cut cutting head 1000 will be rotated in the W-axis at a controlled rotational speed (schematically indicated by the W-arrow). Also while making this cut, cutting head 1000 will be pulled up in the direction of arrow 2010 along the Z-axis from Z-axis location Z3 to Z-axis location Z4. In this manner cutting member 1500 will traverse an upward helical or spiral pathway cutting a swath in tubular 80.

Figure 21:
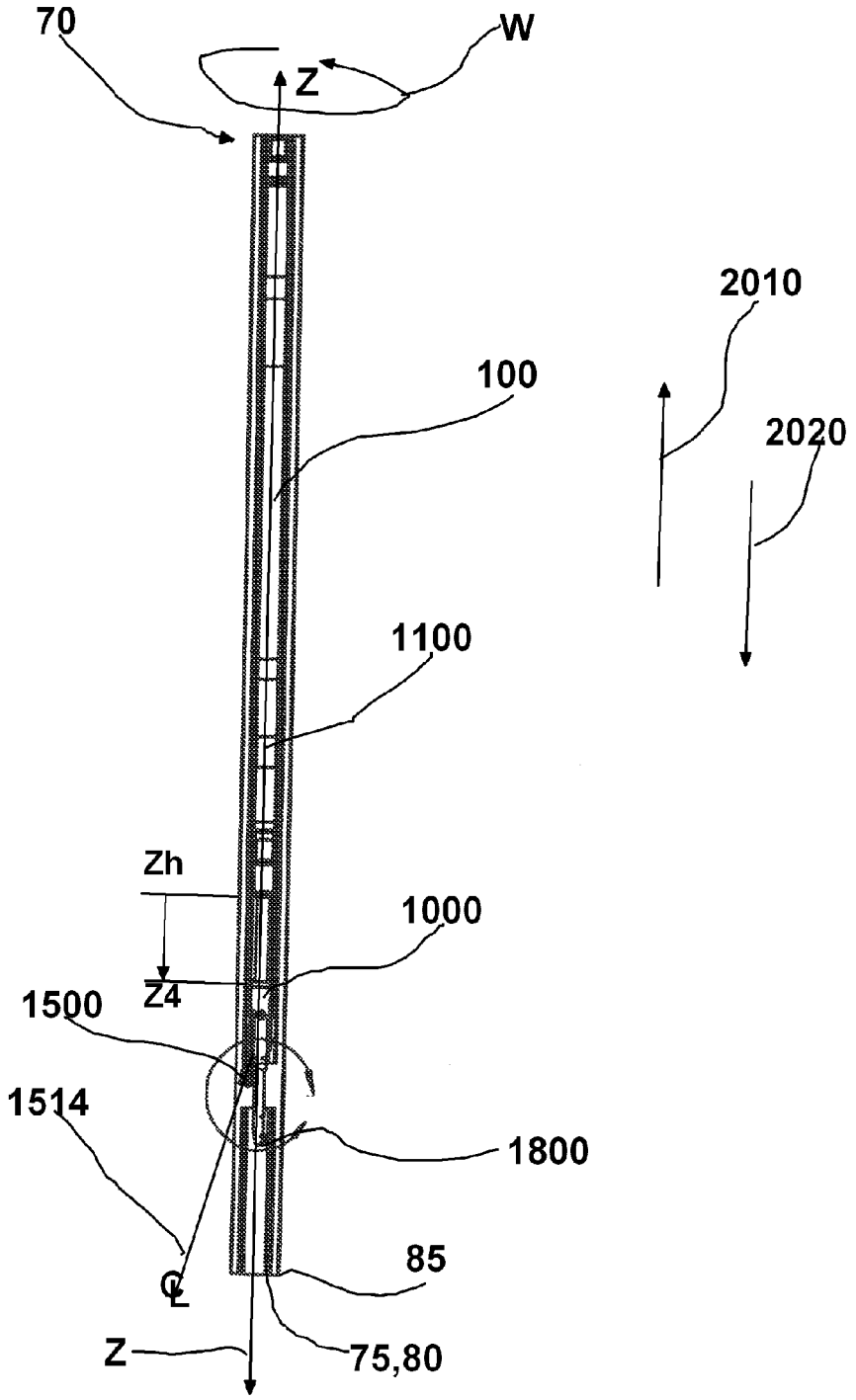
FIG. 21 is a view schematically showing the end of the cut made by the cutting apparatus of FIG. 11 in the second tubular, after having completed the cut in the first tubular.
Figure 22:
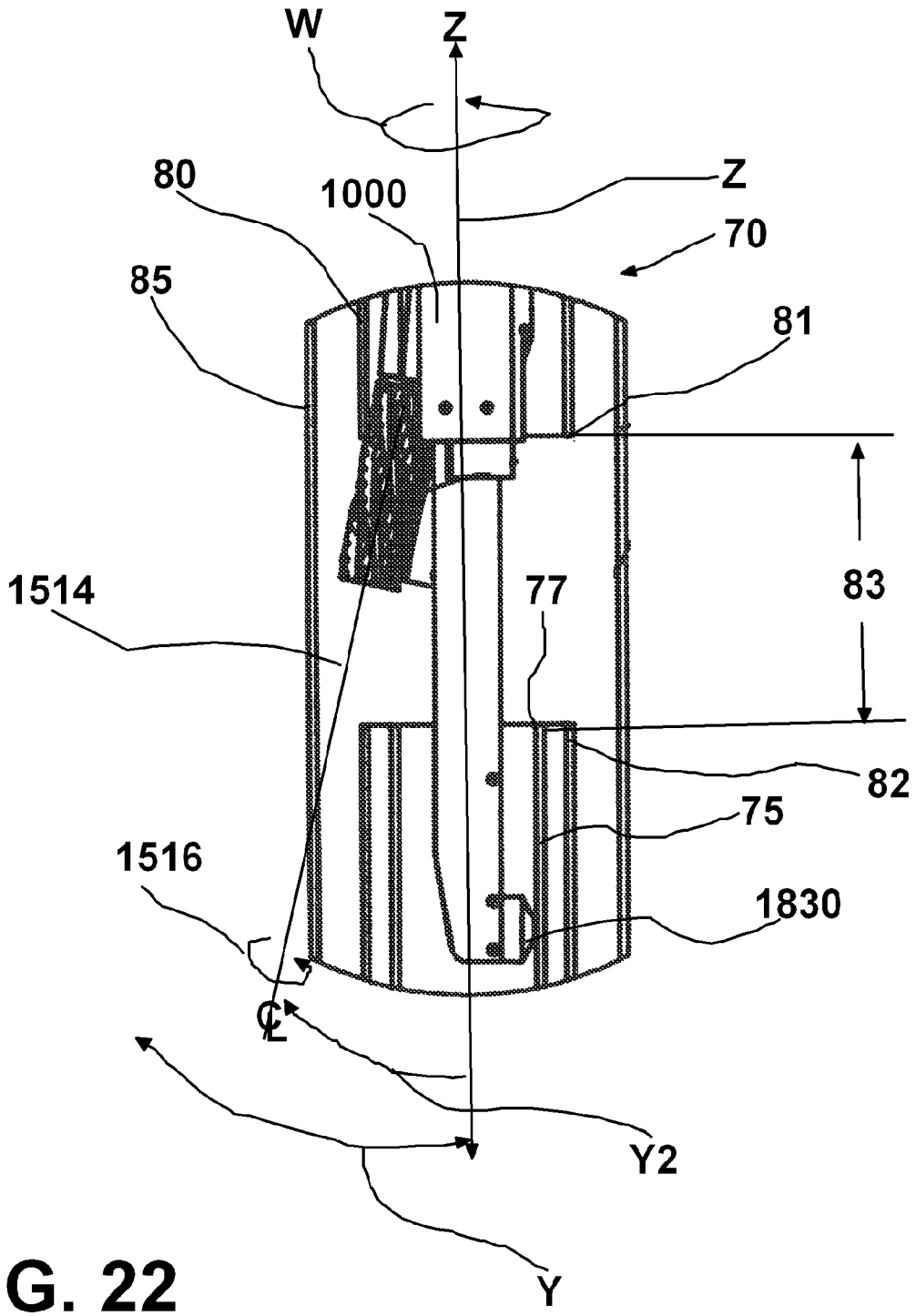
FIG. 22 is an enlarged view of the cutting head portion of the cutting apparatus shown in FIG. 21.

FIG. 21 is a view schematically showing the end of cut being made by cutting apparatus 100 in the second tubular 80, after having completed the cut in the first tubular 75 (with a cut depth 78 in the first tubular 75). FIG. 22 is an enlarged view of cutting head 1000 portion of cutting apparatus 100 in the position shown in FIG. 21. While making this cut, cutting head 1000 was pulled up in the direction of arrow 2010 along the Z-axis from Z-axis location Z3 to Z-axis location Z4 (which is more retracted compared to position Z3). Now a swath or cut has been made in nested tubular 80 from bottom 82 to top 83 making a gap 84. It is noted that in FIG. 22 length 1850 of reaction arm 1800 is shown where contact member 1830 does not lose contact with tubular 75 as cutting head 1000 is retracted along the Z-axis (from position Z3 to position Z4).

Figure 23:
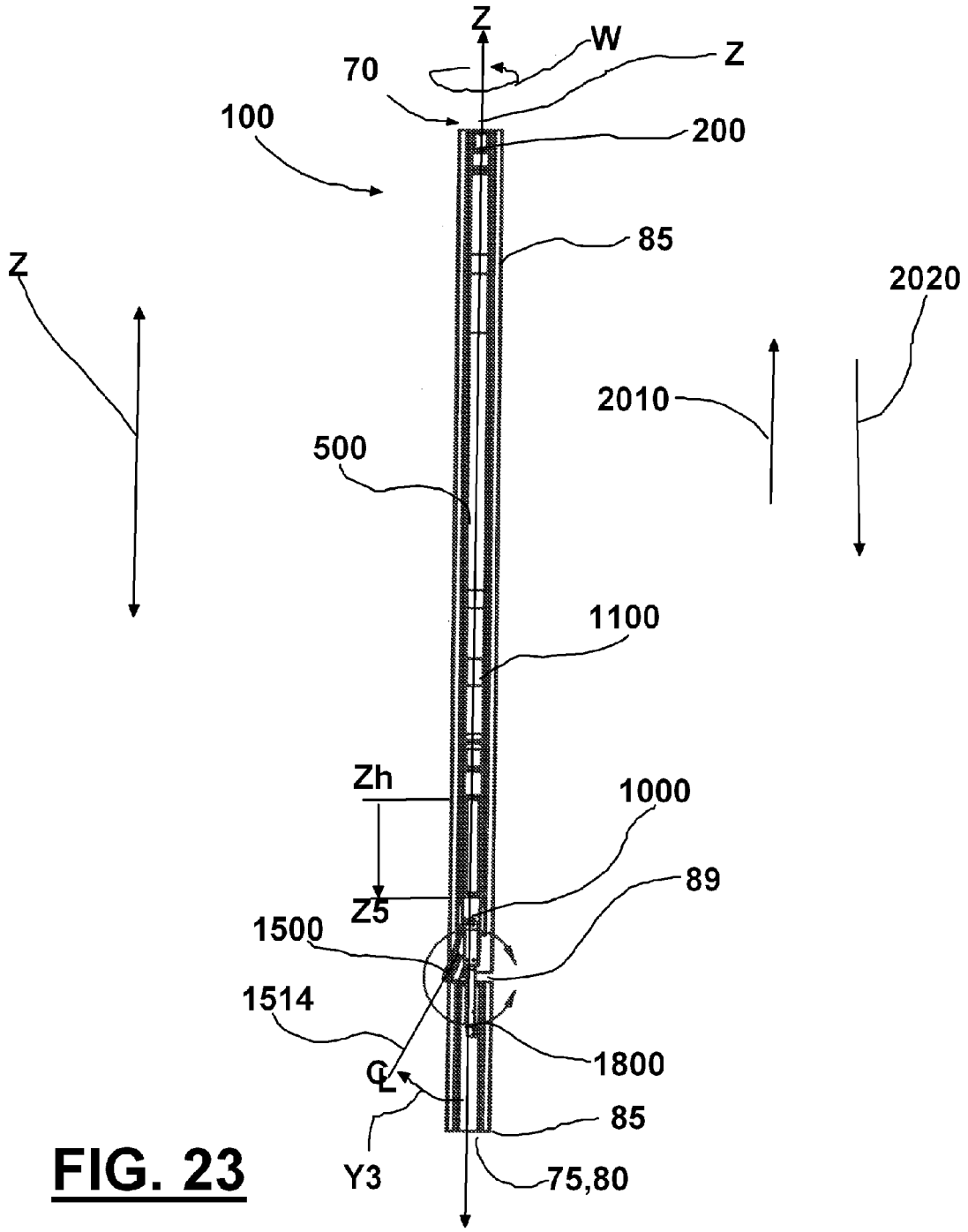
FIG. 23 is a view schematically showing the cut made by the cutting apparatus of FIG. 11 in the third tubular, after having completed the cuts in the first and second tubulars.
Figure 24:
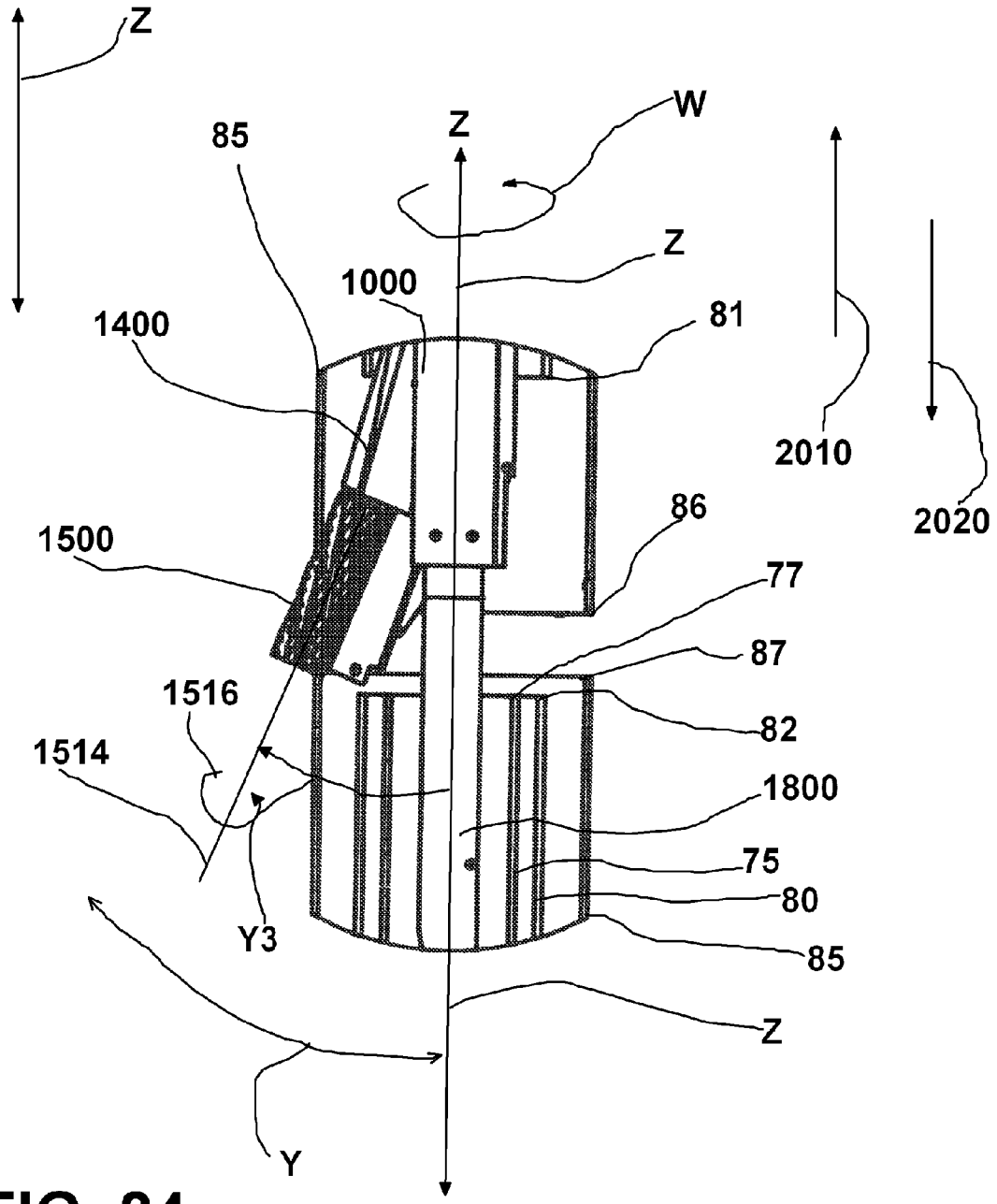
FIG. 24 is an enlarged view of the cutting head portion of the cutting apparatus shown in FIG. 23.

FIGS. 23 and 24 schematically illustrate various steps using cutting apparatus 100 to make a cut in the third tubular 85 of the plurality of nested tubulars 70.

FIG. 23 is a view schematically showing a cut being made by cutting apparatus 100 in the third tubular 85, after having completed the cuts in the first and second tubulars (with a cut depth 78 in the first tubular 75, and a cut depth 83 in the second tubular 80). FIG. 24 is an enlarged view of cutting head 1000 portion of cutting apparatus 100 in the position shown in the FIG. 23. In these figures cutting head 1000 has extended in the Z-axis from the home position (Zh) to the position to start the first cut (Z5). Also in these figures cutting member 1500 has pivoted to the Y-axis position Y3 to make the second cut (schematically indicated by arrow Y3). While making the cut cutting member 1500 will be rotated about its longitudinal axis 1514 (schematically indicated by the arrow about axis 1514) at a controlled rotational speed. Also while making the cut cutting head 1000 will be rotated in the W-axis at a controlled rotational speed (schematically indicated by the W-arrow). Also while making this cut, in one embodiment, cutting head 1000 will be pulled up in the direction of arrow 2010 along the Z-axis from Z-axis location Z5 to Z-axis location Z6. In this manner cutting member 1500 will traverse an upward helical or spiral pathway cutting a swath in tubular 85. In one embodiment cutting head 1000 is maintained at a constant position Z5 and cutting member 1500 makes a cut through tubular 85 (and no spiral motion is seen by cutting member 1500).

Figure 25:
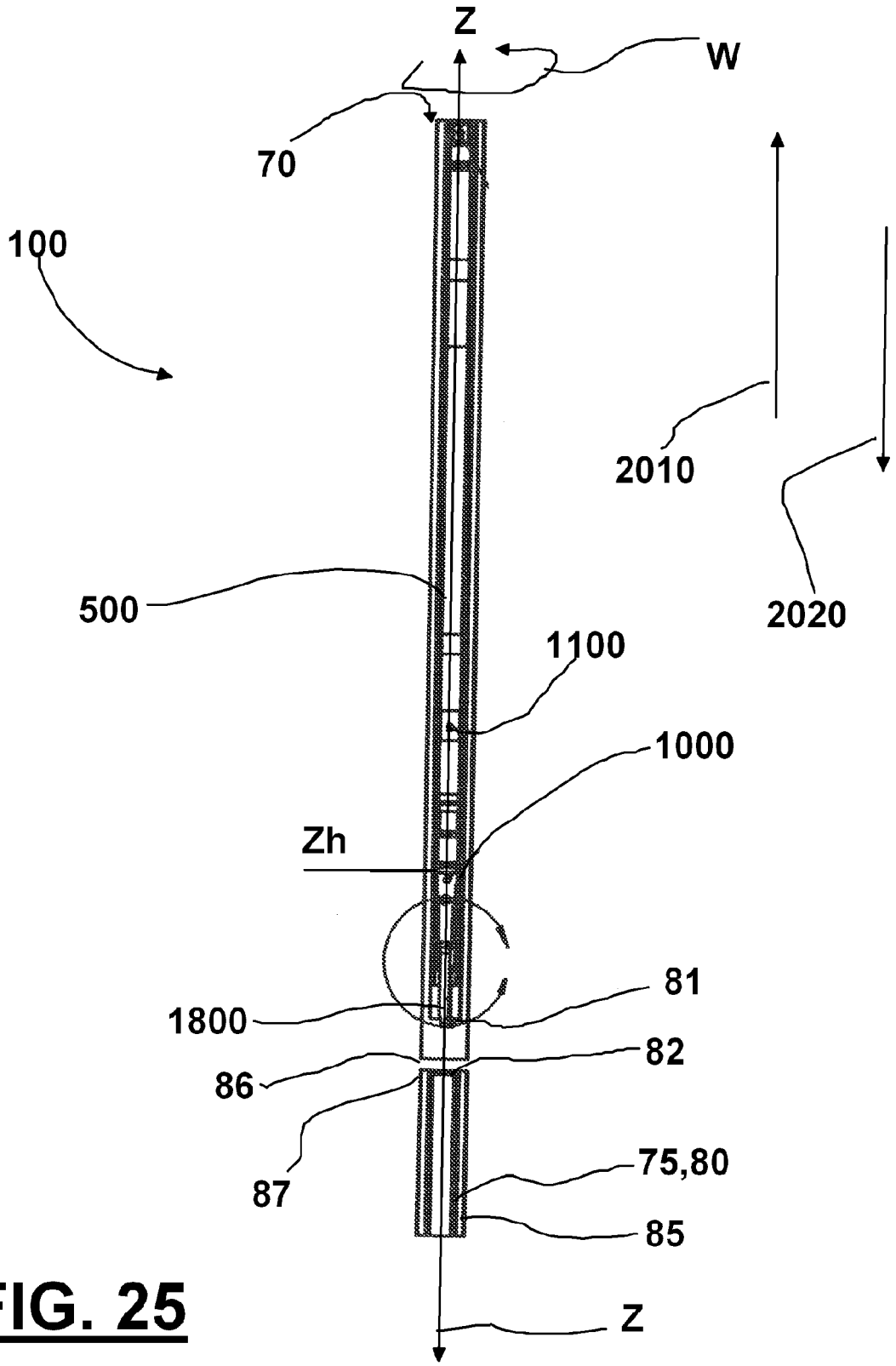
FIG. 25 is a view schematically showing the cutting apparatus of FIG. 11 being pulled up after having completed the cuts in the first, second, and third tubulars.
Figure 26:
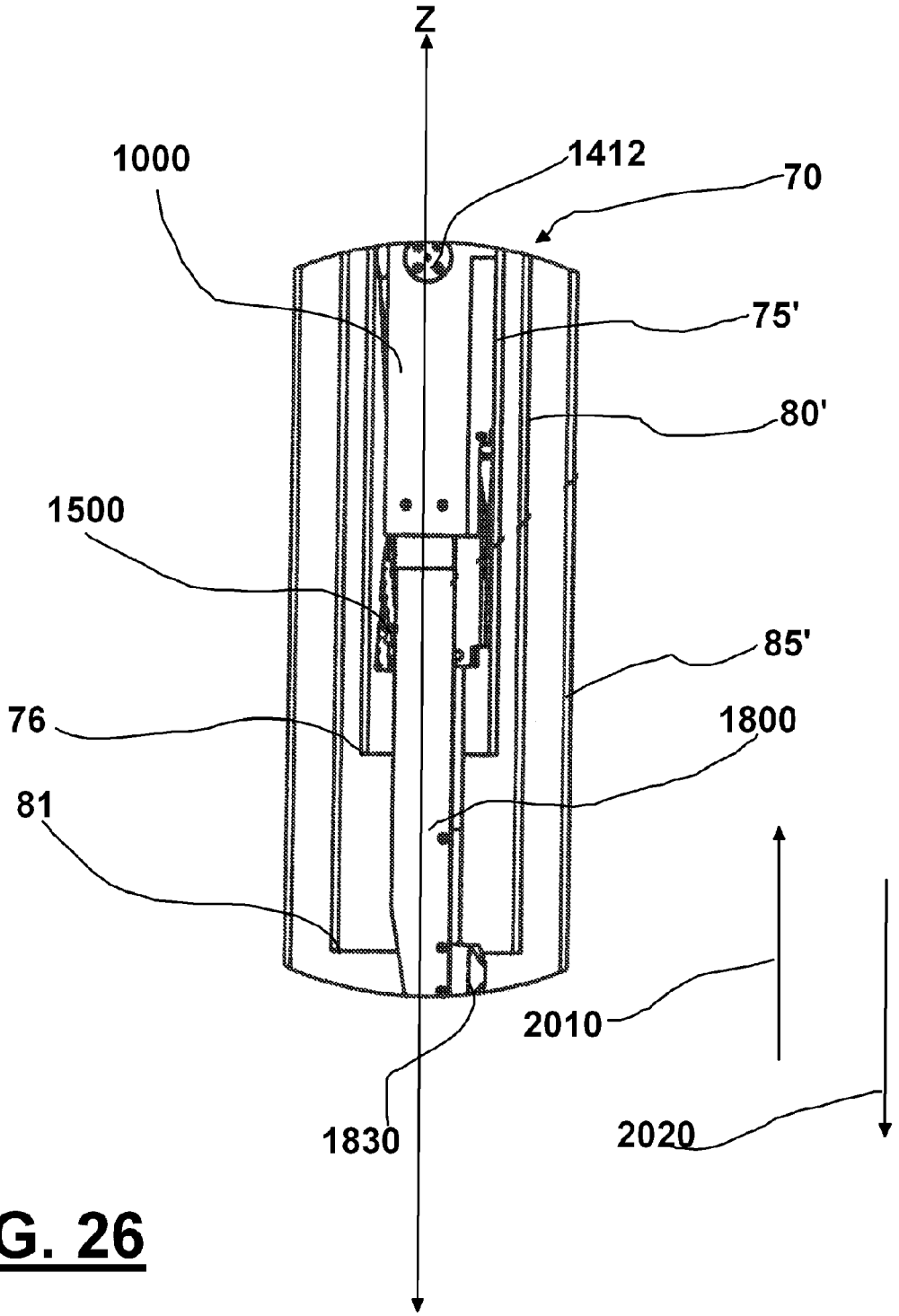
FIG. 26 is an enlarged view of the cutting head portion of the cutting apparatus shown in FIG. 25.

FIG. 25 is a view schematically showing cutting apparatus 1000 being pulled up (schematically indicated by arrow 2010) after having completed the cuts in the first 75, second 80, and third 85 tubulars—completely severing the plurality of nested tubulars 70 (with a cut depth 78 in the first tubular 75, a cut depth 83 in the second tubular 80, and a cut depth 87 in the third tubular 85). FIG. 26 is an enlarged view of cutting head 1000 portion of cutting apparatus 100 in the position shown in FIG. 25. The upper portions of the plurality of the plurality of nested tubulars 70 now ready to be pulled out of wellbore 60. In these figures cutting head 1000 has been retracted to its home position in the Z-axis (to Zh), and cutting member 1500 has also been pivoted in the Y-axis to its home position. Additionally, hydraulic packer 1100 has been released causing cutting apparatus to enter a non-anchored state. Cutting apparatus 100 is now in a condition to be pulled up by vessel 3000 in the direction of arrow 2010 to the surface.

In one embodiment from the beginning of the cut of the first tubular 75 to the completion of the cut of the outermost tubular 85, cutting apparatus remained below the surface of the water 30. In one embodiment, during this time cutting apparatus remained in well bore 60. In one embodiment, cutting apparatus remained anchored in a single position in innermost tubular 75.

Concentric Tubulars

Figure 27:
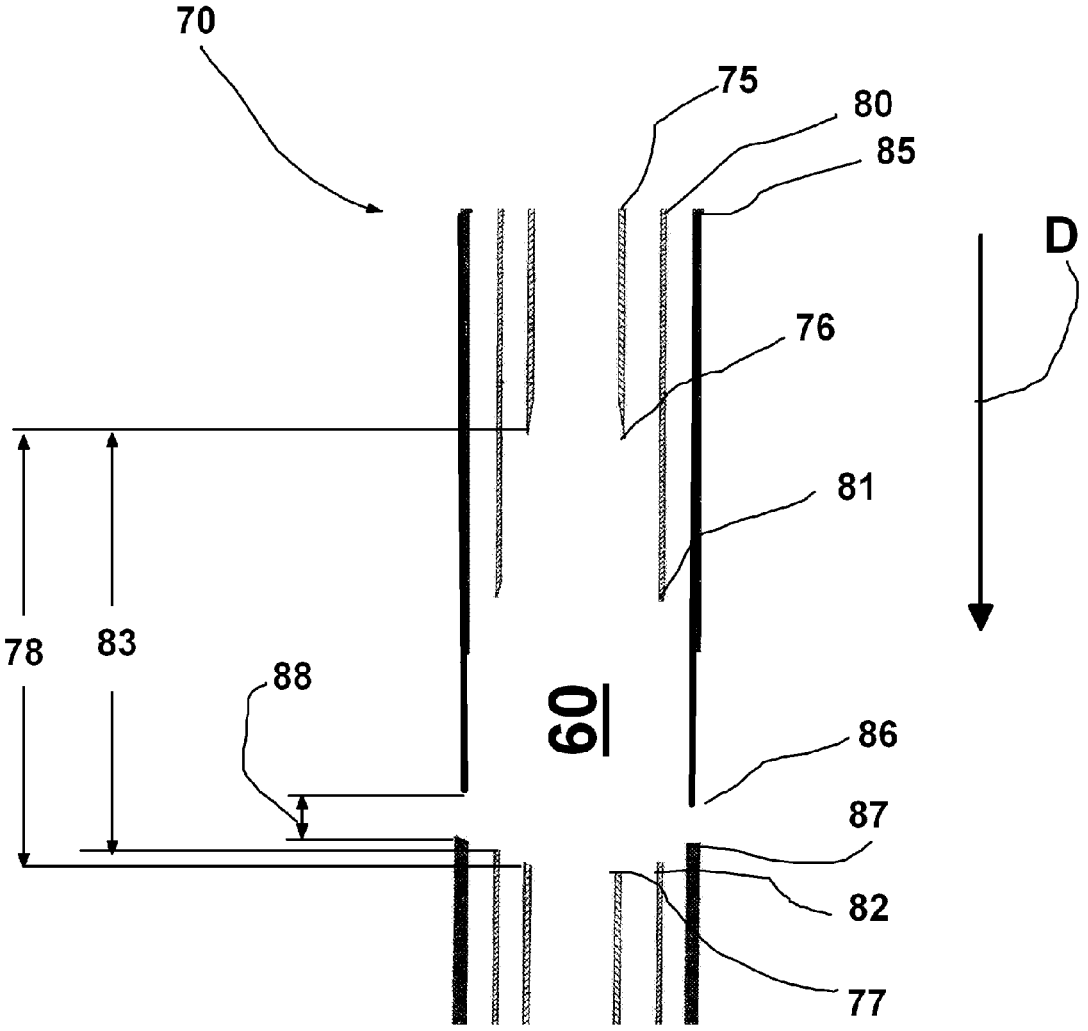
FIG. 27 is a schematic view of the three nested tubulars which were cut by the cutting apparatus of FIG. 11 (where these tubulars were concentrically positioned).

FIG. 27 is a schematic view of the three nested tubulars 75, 80, and 85 of a plurality of nested tubulars 70 which were cut by cutting apparatus 100 (where these tubulars were concentrically positioned). In various embodiments the tubulars can have in their annuluses between them combinations of cement and/or formation rock.

Tubular 75 cut has upper level 76 and lower level 77, with a height or swath of cut 78. Tubular 80 cut has upper level 81 and lower level 82, with a height or swath of cut 83. Tubular 85 cut has upper level 86 and lower level 87, with a height or swath of cut 88.

In one embodiment height of cut 78 is larger than height of cut 83, and height of cut 83 is larger than height of cut 88. In one embodiment lower level 77 is lower than lower level 83, and lower level 83 is lower than lower level 87. In one embodiment upper level 76 is higher than upper level 81, and upper level 81 is higher than upper level 86. In one embodiment lower level 77 is equal to lower level 83, and lower level 83 is equal to lower level 87.

In one embodiment height of cut 78 is larger than height of cut 83, and height of cut 83 is larger than height of cut 88. In one embodiment lower level 77 is lower than lower level 83, and lower level 83 is lower than lower level 87. In one embodiment upper level 76 is higher than upper level 81, and upper level 81 is higher than upper level 86.

In one embodiment lower level 77 is about equal to lower level 83, and lower level 83 is about equal to lower level 87 (and Z1 is about equal to Z3 and Z3 is about equal to Z5).

Eccentric Tubulars

Figure 28:
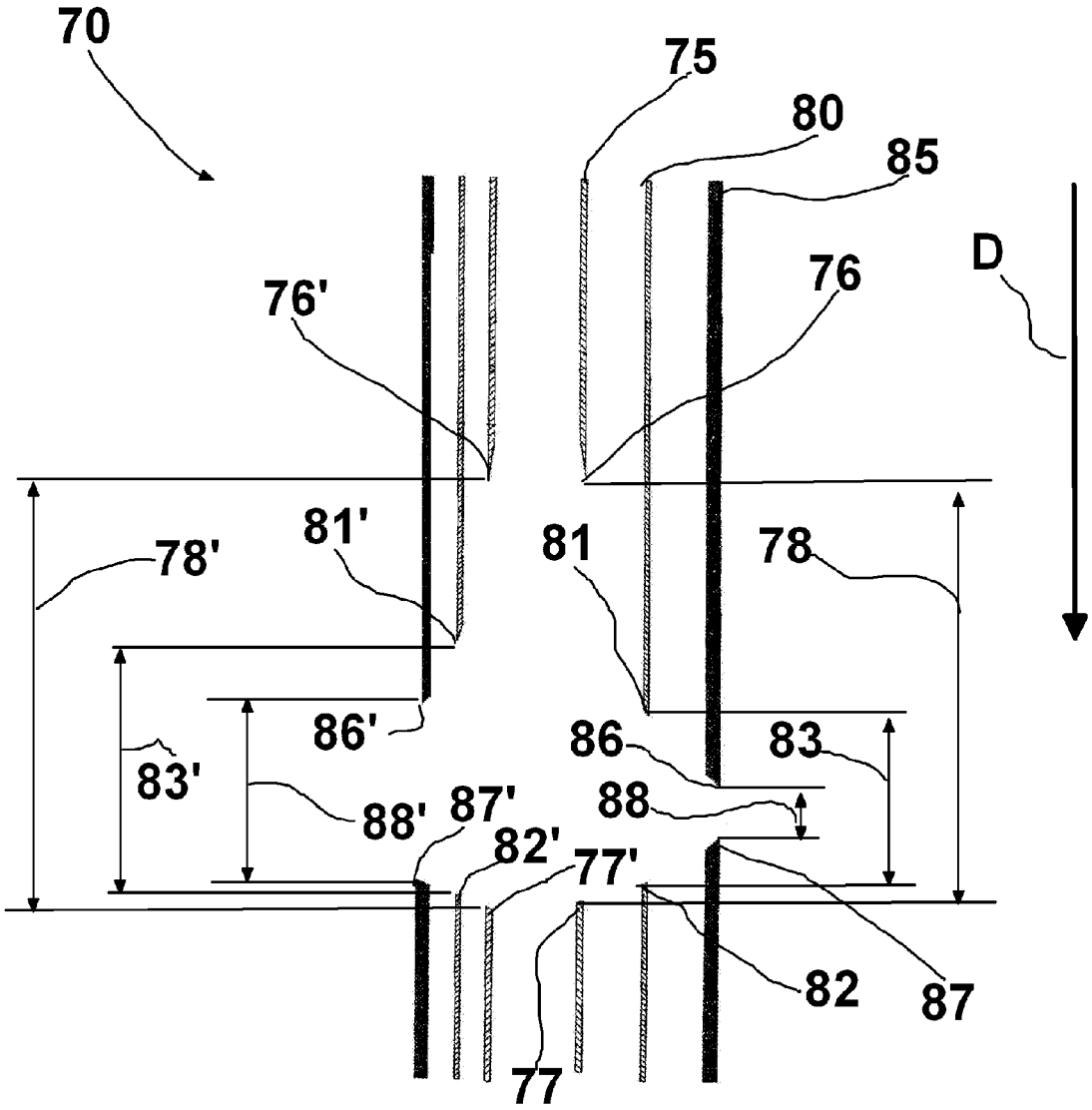
FIG. 28 is a schematic view of the three nested tubulars which were cut by the cutting apparatus of FIG. 11 (where these tubulars were eccentrically positioned).

FIG. 28 is a schematic view of the three nested tubulars 75, 80, and 85 of a plurality of nested tubulars 70 which were cut by cutting apparatus 100 (where these tubulars were eccentrically positioned). In various embodiments the tubulars can have in their annuluses between them combinations of cement and/or formation rock. In various embodiments the tubulars can have in their annuluses between them combinations of cement and/or formation rock.

Tubular 75 cut has upper level 76 and lower level 77, with a height or swath of cut 78. Tubular 75 cut also has upper level 76' and lower level 77', with a height or swath of cut 78'. Tubular 80 cut has upper level 81 and lower level 82, with a height or swath of cut 83. Tubular 80 cut also has upper level 81' and lower level 82', with a height or swath of cut 83'. Tubular 85 cut has upper level 86 and lower level 87, with a height or swath of cut 88. Tubular 85 cut also has upper level 86' and lower level 87', with a height or swath of cut 88'. In one embodiment height of cut 78 is larger than height of cut 83, and height of cut 83 is larger than height of cut 88. In one embodiment height of cut 78' is larger than height of cut 83', and height of cut 83' is larger than height of cut 88'. In one embodiment lower level 77 is lower than lower level 83, and lower level 83 is lower than lower level 87. In one embodiment lower level 77' is lower than lower level 83', and lower level 83' is lower than lower level 87'. In one embodiment upper level 76 is higher than upper level 81, and upper level 81 is higher than upper level 86. In one embodiment upper level 76' is higher than upper level 81', and upper level 81' is higher than upper level 86'. In one embodiment lower level 77 is equal to lower level 83, and lower level 83 is equal to lower level 87. In one embodiment lower level 77' is equal to lower level 83', and lower level 83' is equal to lower level 87'.

Figure 29:
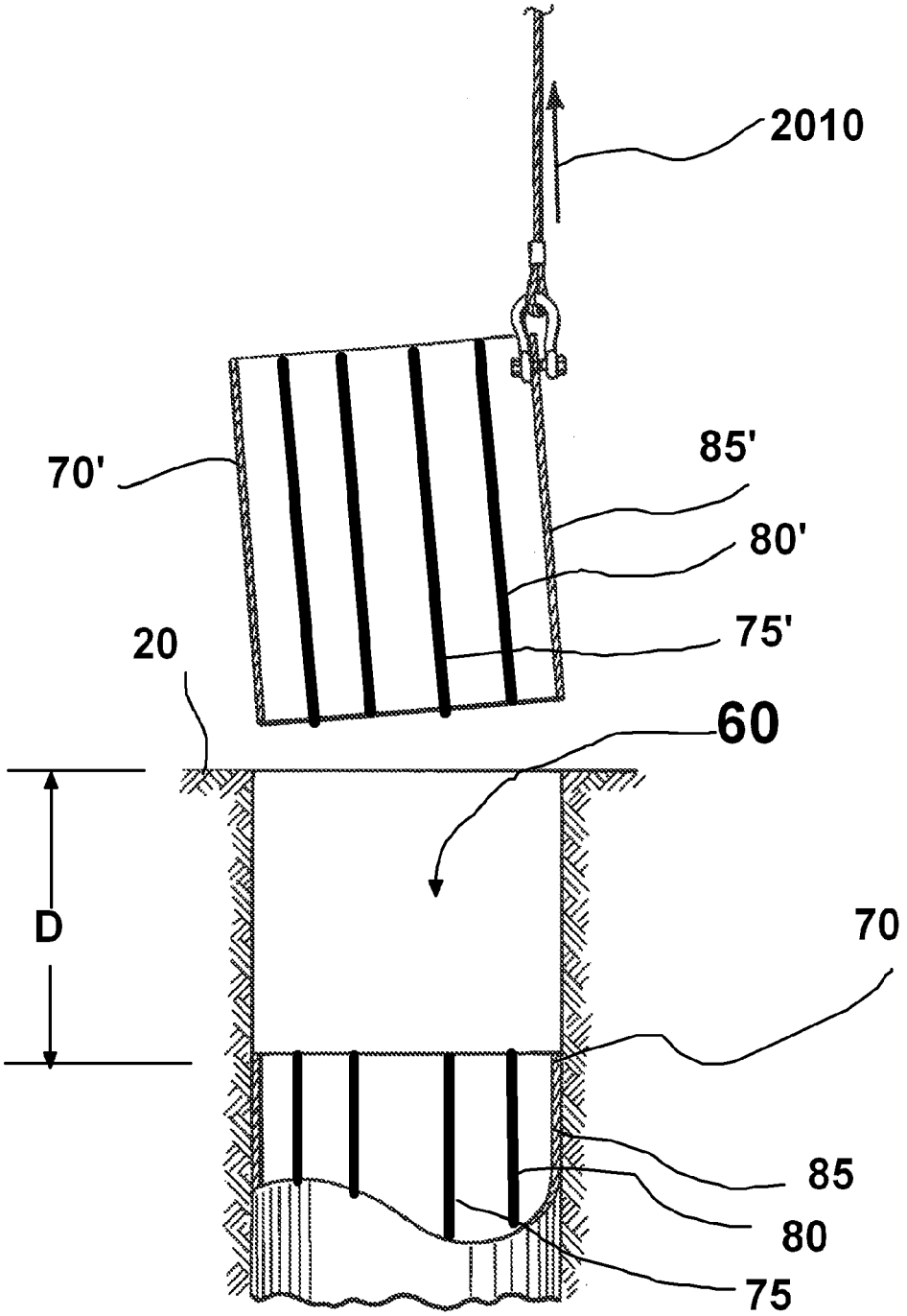
FIG. 29 is a schematic view of the three cut nested tubulars being pulled out of the well bore so that the well can be properly abandoned.

FIG. 29 is a schematic view of the upper portions 75', 80', and 85' of the three cut nested tubulars 70 being pulled out of well bore 60 so that the wellbore can be properly abandoned. Now from the sea floor 20 to the top of the remaining plurality of nested tubulars 70 is at least a depth D.

Figure 31:
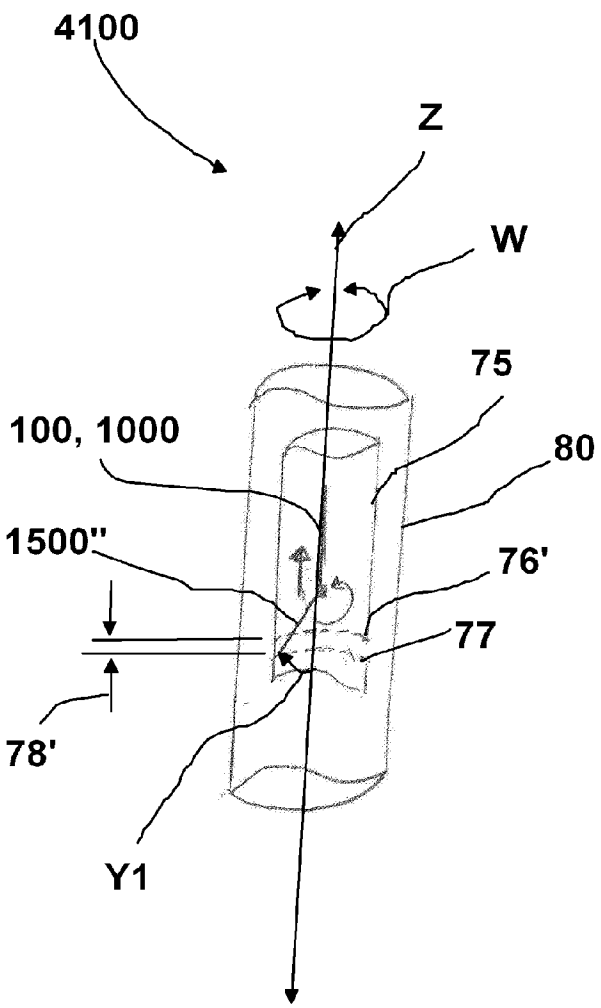
FIG. 31 is a schematic view of one embodiment of a display which can show in substantially real time a schematic representation of the cutting head and the cut or cuts made in one or more nested tubulars, shown in the middle of a cut of the first nested tubular.
Figure 30:
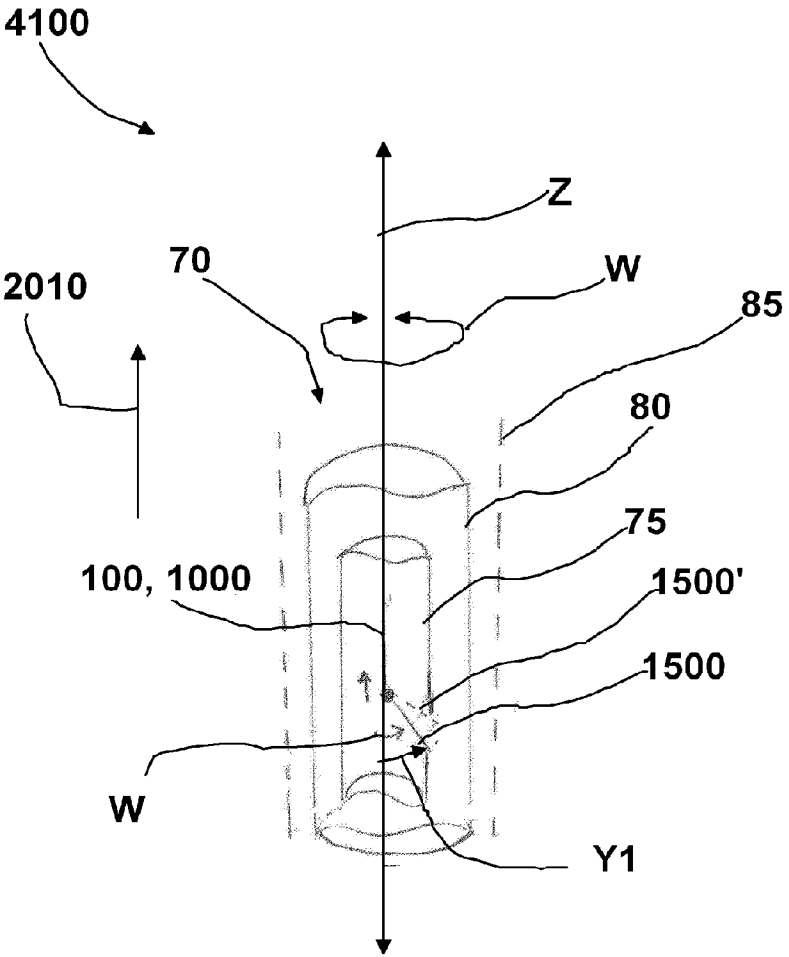
FIG. 30 is a schematic view of one embodiment of a display which can show in substantially real time a schematic representation of the cutting head and the cut or cuts made in one or more nested tubulars, shown in the beginning of a cut of the first nested tubular.

FIG. 30 is a schematic view of one embodiment of a display 4100 showing (in substantially real time) a schematic representation of relative movement of the cutting head 1000 and the cut or cuts made in one or more nested tubulars of a plurality of nested tubulars 70, shown in the beginning of a cut of the first nested tubular 75. FIG. 31 is a schematic view of one embodiment of a display 4100 showing (in substantially real time) a schematic representation of relative movement of the cutting head 1000 and the cut or cuts made in one or more nested tubulars of a plurality of nested tubulars 70, shown in the middle of a cut of the first nested tubular 75.

Estimated Sample Times and W-Axis Times for Cuts

Below are provided some sample estimated cutting times and number of W-axis rotations required for cutting particular sized nested tubulars with the method and apparatus.

TABLE 1

SAMPLE OF ESTIMATED CUTTING PROFILES/TIMES TWO TUBULARS

| 1st size | W-REV | 2nd SIZE | W-REV | TOTAL W-REV | EST. TIME |
|---|---|---|---|---|---|
| 9⅝" | 7 | 13⅝" | 1 | 8 | 4 MIN |
| 9⅝" | 16 | 24" | 1 | 17 | 9 MIN |
| 9⅝" | 18 | 30" | 1 | 19 | 10 MIN |

TABLE 2

SAMPLE OF ESTIMATED CUTTING PROFILES/TIMES 3 TUBULARS

| 1st SIZE/ WREV | 2nd SIZE/W-REV | 3rd SIZE/W-REV | TOTAL | EST. TIME |
|---|---|---|---|---|
| 9⅝"/12 | 13⅜"/6 | 20"/1 | 19 | 10 MIN |

In one embodiment cutter 100 has tool body 500 pressurized with nitrogen with the advantage of pressurization is that changes in temperature in the well formation do not create condensation inside the tool body while the tool is inside the well formation.

In one embodiment, how far in the Z-axis (Z1) cutting head 1000 goes down depends on the outer diameter of the outermost nested tubular to be cut.

In one embodiment the rate of feed in the Z-axis is equal to 2 inches per revolution of the cutting head in the W-axis- or 2 inches per W axis revolution.

Display for Cut of Innermost Tubular

Figure 32:
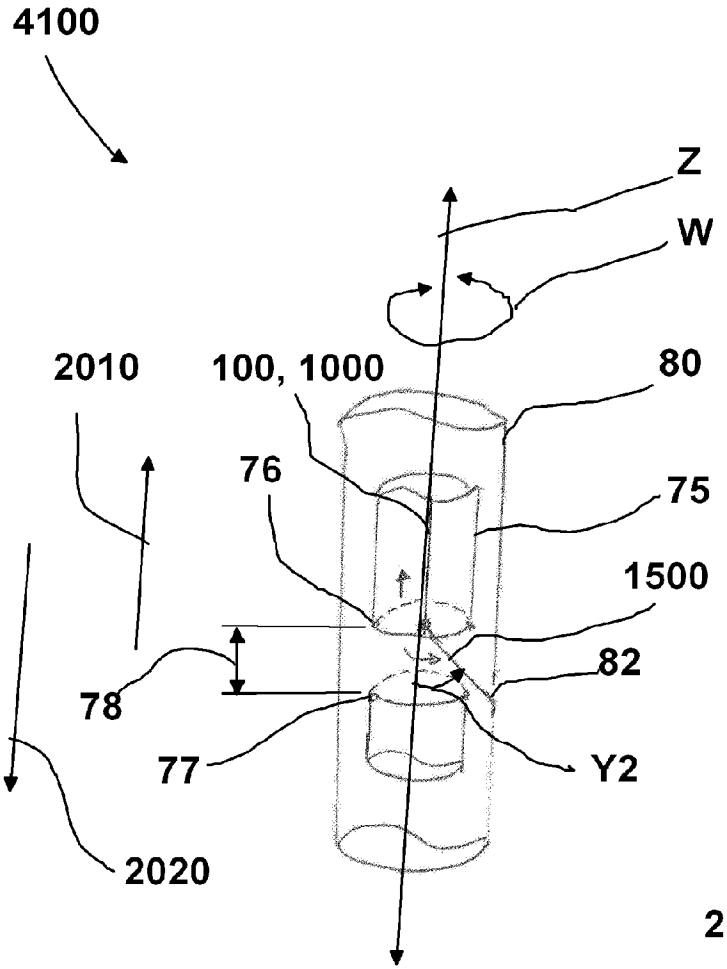
FIG. 32 is a schematic view of one embodiment of a display which can show in substantially real time a schematic representation of the cutting head and the cut or cuts made in one or more nested tubulars, shown in the beginning of a cut of the second nested tubular, after completing the cut of the first nested tubular.

Looking at FIGS. 31 and 32 an operator can have a pictorial representation on display 4100 viewing a three dimensional the graphical depiction of the cut being made, along with the relative movements of cutting head 1000 and cutting member 1500 about the Y, Z, and W axes on such display. One can also visualize the swath or cut made in the innermost nested tubular 75 having a gap 78'. FIG. 31 shows cutting head 1000 and cutting member 1500 in a second position for W and Z axes (the Y-axis position remained the same). FIG. 31 also schematically depicts the cut made in tubular 75 from the position shown in FIG. 30 to the position shown in FIG. 31. The relative Y, Z, and W axial positions of cutting head 1000 and cutting member 1500 can be obtained from sensor and positional information and/or data from cutting apparatus 100.

Display for Cut of Second Tubular

Figure 33:
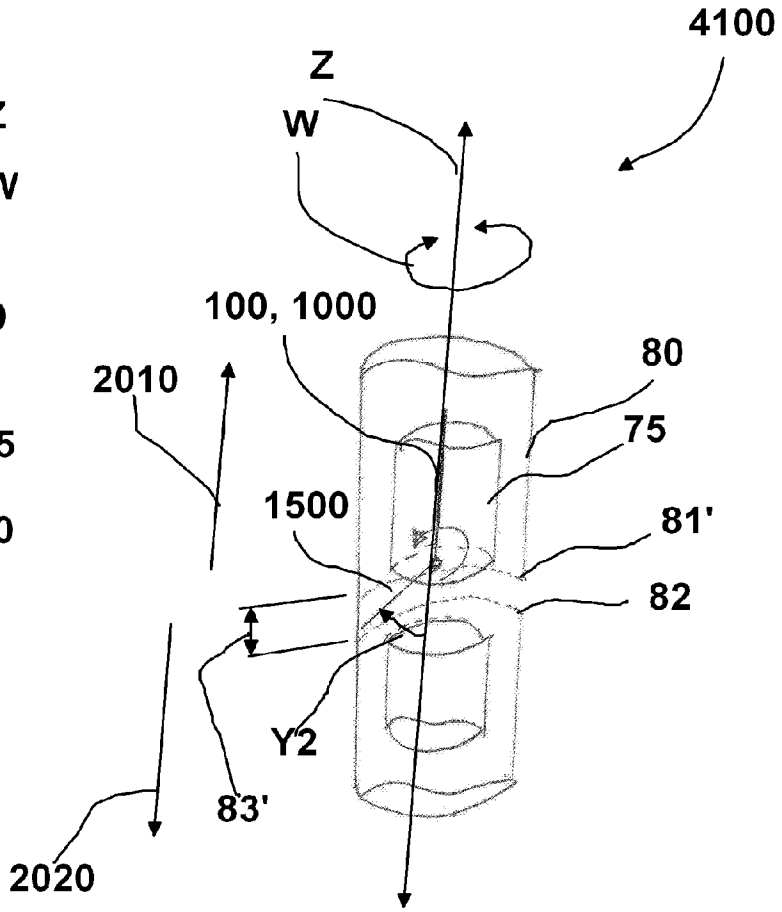
FIG. 33 is a schematic view of one embodiment of a display which can show in substantially real time a schematic representation of the cutting head and the cut or cuts made in one or more nested tubulars, shown in the middle of a cut of the second nested tubular, after completing the cut of the first nested tubular.

FIG. 32 is a schematic view of one embodiment of a display 4100 showing (in substantially real time) a schematic representation of relative movement of the cutting head 1000 and the cut or cuts made in one or more nested tubulars of a plurality of nested tubulars 70, shown in the beginning of a cut of the second nested tubular 80, after completing the cut of the first nested tubular 75. FIG. 33 is a schematic view of one embodiment of a display 4100 showing (in substantially real time) a schematic representation of relative movement of the cutting head 1000 and the cut or cuts made in one or more nested tubulars of a plurality of nested tubulars 70, shown in the middle of a cut of the second nested tubular 80, after completing the cut of the first nested tubular 75.

Looking at FIGS. 32 and 33 an operator can have a pictorial representation on display 4100 viewing a three dimensional the graphical depiction of cut being made in the second tubular 80 (along with the cut already made in the first tubular 75), along with the relative movements of cutting head 1000 and cutting member 1500 about the Y, Z, and W axes on such display. The operator can also see the swath or cut made in the second tubular 80 having a gap 81'. FIG. 33 shows cutting head 1000 and cutting member 1500 in a second position for W and Z axes (the Y-axis position remained the same Y2). FIG. 33 also schematically depicts the cut made in tubular 80 from the position shown in FIG. 32 to the position shown in FIG. 33 (along with the completed cut in the innermost tubular 75). The relative Y, Z, and W axial positions of cutting head 1000 and cutting member 1500 can be obtained from sensor and positional information and/or data from cutting apparatus 100.

Viewing of cuts in third, fourth, etc. tubulars can similarly be displayed on display 4100 of controller 4000. For example, with three nested tubulars 75, 80, and 85, a cut (cut or swath 87') in the third tubular 85 could be displayed on display 4100 with swaths or cuts already shown for the first and second tubulars (first tubular having completed swath or cut 78 and second tubular having completed watch or cut 83).

The following is a table listing the various reference numerals used in this application and a description of each. Note that this table describes only the reference numerals for FIGS. 1 through 33. In later figures, similar or identical parts may be identified by different numerals.

TABLE OF REFERENCE NUMERALS AND DESCRIPTIONS

| Reference | Description |
|---|---|
| 10 | method and apparatus |
| 20 | sea floor |
| 30 | water surface |
| 40 | oil and gas rig |
| 44 | collapsed portion |
| 48 | remaining support structure |
| 50 | riser |
| 60 | well bore |
| 70 | plurality of nested tubulars |
| 75 | first tubular |
| 76 | upper portion |
| 77 | lower portion |
| 78 | height of cut |
| 80 | second tubular |
| 81 | upper portion |
| 82 | lower portion |
| 83 | height of cut |
| 85 | third tubular |
| 86 | upper portion |
| 87 | lower portion |
| 88 | height of cut |
| 100 | apparatus |
| 110 | arrow |
| 190 | controls |
| 200 | collar |
| 210 | wireline |
| 300 | Z-axis motor and controls |
| 310 | driving nut |
| 320 | drive cylinder |

-continued

TABLE OF REFERENCE NUMERALS AND DESCRIPTIONS

| Reference | Description |
|---|---|
| 350 | mounting plate or bracket for Z-axis motor |
| 360 | telescoping tubing |
| 370 | support bracket |
| 380 | vertical arrows |
| 400 | driving screw |
| 500 | tool body or housing |
| 510 | interior space |
| 600 | W-axis motor |
| 700 | transmission system |
| 800 | coupling |
| 900 | rotary hydraulic coupling |
| 1000 | cutting head (connected to W-axis rotating body and Z-axis movable bar) |
| 1010 | cutting head tube |
| 1100 | packer (for anchoring system) |
| 1110 | packer in expanded condition |
| 1120 | expanding arrows |
| 1130 | connection point for packer |
| 1200 | milling spindle swing arm |
| 1220 | motor for cutting bit 15 |
| 1300 | pivot bearing |
| 1400 | milling spindle swing arm housing |
| 1404 | wall |
| 1410 | first end |
| 1412 | pivot point |
| 1420 | second end |
| 1424 | arrows |
| 1500 | cutting bit |
| 1505 | body |
| 1508 | opening or bore |
| 1510 | first end |
| 1514 | axis of rotation |
| 1516 | arrow schematically indicating rotation about axis of rotation |
| 1520 | second end |
| 1530 | milling bit teeth |
| 1540 | bar (under tension) |
| 1550 | plunger |
| 1560 | socket head cap screw |
| 1562 | socket head cap screw |
| 1570 | cap |
| 1580 | heavy oil |
| 1585 | O-ring seals |
| 1600 | Y axis hydraulic cylinder |
| 1610 | first end |
| 1612 | pivot point |
| 1620 | second end |
| 1622 | pivot point |
| 1630 | cylinder |
| 1634 | arrows schematically indicating ability to pivot |
| 1640 | rod |
| 1644 | arrows schematically indicating the ability to extend and retract |
| 1700 | connection housing to W-axis rotating body |
| 1710 | first end |
| 1720 | second end |
| 1800 | reaction bar |
| 1810 | first end |
| 1820 | second end |
| 1830 | contact surface |
| 1840 | reaction bending force arrow |
| 2000 | step of lowering |
| 3000 | vessel |
| 3010 | surface of vessel |
| 3020 | control area |
| 3050 | crane |
| 4000 | remote controller |
| 4100 | display |
| H | height above sea floor |
| D | depth of cut below sea floor |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

Although described with reference to specific embodiments, one skilled in the art could apply the principles discussed herein to other areas and/or embodiments.

Throughout this disclosure casing(s) and tubular(s) are used interchangeably.

This invention provides a method and apparatus for efficiently severing installed tubing, pipe, casing, and liners, as well as cement or other encountered material in the annuli between the tubulars, in one trip into a well bore.

Reference will now be made in detail to the present embodiments of the disclosure, examples of which are illustrated in the accompanying drawings. Wherever possible, the same reference numbers will be used throughout the drawings to refer to the same or like parts (elements).

To help understand the advantages of this disclosure the accompanying drawings will be described with additional specificity and detail.

The method generally is comprised of the steps of positioning a robotic rotary mill cutter inside the innermost tubular in a pre-selected tubular or plurality of multiple, nested tubulars to be cut, simultaneously moving the rotary mill cutter in a predetermined programmed vertical X-axis, and also 360 degree horizontal rotary W-axis, as well as the spindle swing arm in a pivotal Y-axis arc.

In one embodiment of the present disclosure the vertical (Z axis) and horizontal (W axis) movement pattern(s) and the spindle swing arm (Y axis) are capable of being performed independently of each other, or programmed and operated simultaneously in conjunction with each other. The robotic rotary mill cutter is directed and coordinated such that the predetermined pattern is cut through the innermost tubular beginning on the surface of said tubular, with the cut proceeding through it to form a shape or window profile(s), or to cut through all installed multiple, nested tubulars into the formation beyond the outermost tubular by making multiple passes and cutting away layer by layer of tubulars and cement until the largest (outermost) nested tubular has been severed.

In one embodiment of the present disclosure the robotic rotary mill cutter, will cut from the inside of a 8.5 inch tubular and cut away layer by layer nested tubulars and cement thus generating larger and larger voids, that will allow the Y-axis milling spindle swing arm (see 5014 of FIG. 39B) and cutting device (see 5015 of FIG. 39B) progressively greater swing angles and reach. In three to four passes of cutting away layer by layer of nested tubulars (see FIG. 38B) and cement as above, the cutting device 5015 can cut away tubulars and cement inside a 42-inch diameter circle.

A profile generation system simultaneously moves the robotic rotary mill cutter in a vertical Z-axis, and a 360-degree horizontal rotary W-axis, and the milling spindle swing arm (see 5014 of FIG. 39B) in a pivotal Y-axis arc to allow cutting the tubulars, cement, and formation rock in any programmed shape or window profile(s).

The robotic rotary mill cutter apparatus is programmable to simultaneously or independently provide vertical X-axis movement, 360-degree horizontal rotary W-axis movement, and spindle swing arm pivotal Y-axis arc movement under computer control. A computer having a memory and operating pursuant to attendant software, stores shape or window profile(s) templates for cutting and is also capable of accepting inputs via a graphical user interface, thereby providing a system to program new shape or window profile(s) based on user criteria. The memory of the computer can be one or more of but not limited to RAM memory, flash memory, ROM memory, EPROM memory, EEPROM memory, registers, hard disk, a removable disk, a CD-ROM, floppy disk, DVD-R, CD-R disk or any other form of storage medium known in the art. In the alternative, the storage medium may be integral to the processor. The processor and the storage medium may reside in an ASIC or microchip.

The computer controls the profile generation servo drive systems as well as the cutting device speed. The robotic rotary mill cutter requires load data to be able to adjust for conditions that cannot be seen by the operator. The computer receives information from torque sensors (see 5052, and 5053 of FIGS. 35A and 35B) attached to Z-axis, W-axis, Y-axis, and milling spindle drive motor, and makes immediate adaptive adjustments to the feed rate and speed of the vertical Z-axis, the 360 degree horizontal rotary W-axis, the spindle swing arm pivotal Y-axis and the RPM of the milling spindle motor.

Software in communication with sub-programs gathering information from the torque devices, such as a GSE model Bi-Axial transducer Model 6015 or a PCB model 208-M133, directs the computer, which in turns communicates with and monitors the downhole robotic rotary mill cutter and its attendant components, and provides feeds and speeds simultaneously or independently along the vertical Z-axis, the 360 degree horizontal rotary W-axis, as well as the pivotal spindle swing arm Y-axis arc movement.

The shape or window profile(s) are programmed by the operator using a program logic controller (PLC), or a personal computer (PC), or a computer system designed or adapted for this specific use. The integrated software via a graphical user interface (GUI) or touch screen, such as a Red Lion G3 Series HMI, accepts inputs from the operator and provides the working parameters and environment by which the computer directs and monitors the robotic rotary mill cutter.

In the preferred embodiment, the vertical Z-axis longitudinal computer-controlled servo axis uses a hydraulic cylinder, such as the Parker Series 2HX hydraulic cylinder, housing the MTS model M-series absolute analog sensor for ease of vertical Z-axis longitudinal movements, although other methods may be employed to provide up and down vertical movement of the robotic rotary mill cutter.

In a still further embodiment of the present disclosure the vertical Z-axis longitudinal computer-controlled servo axis may be moved with a ball screw and a computer controlled electric servo axis motor, the Fanuc D2100/150 servo, with encoder feedback to the computer system by an encoder (see 5050 in FIG. 35A) such as the BEI model H25D series incremental optical encoder. Servomotors and ball screws are known in the art and are widely available from many sources.

In a still further embodiment of the present disclosure the vertical Z-axis longitudinal computer-controlled servo axis may be moved with a ball screw and a hydraulic motor, such as a Parker TC0045, with encoder feedback to a motion controller, similar to a Galil DMC-21X3 series motion controller, that operates a hydraulic servo valve, similar to a Parker Series DY12 servovalve, or hydraulic proportional valve, that powers the hydraulic motor. Servo valves, proportional valves, and motion controllers are known in the art and are widely available from many sources.

In a still further embodiment of the present disclosure, the vertical Z-axis longitudinal computer-controlled servo axis may be moved with a rack and pinion, either electrically or hydraulically driven. Rack and pinion drives are known in the art and are widely available from many sources.

In the preferred embodiment, the rotational computer controlled W-axis rotational movement is an electric servomotor, The rotational computer-controlled W-axis servomotor, such as a Fanuc model D2100/150 servo, provides 360-degree horizontal rotational movement of the robotic rotary mill cutter through a specially manufactured slewing gear.

In a still further embodiment of the present disclosure, the rotational computer controlled W-axis rotational movement is controlled by a hydraulic servo valve that drives a hydraulic motor coupled to the W-axis and has a sensor position feedback encoder connected to the rotational computer controller for closed loop servo operation.

Closed loop servo hydraulic drives are a known art and are widely available from many sources.

Also in the preferred embodiment, the Y-axis pivotal milling spindle swing arm computer-controlled servo axis uses a hydraulic cylinder for ease of use, although other methods may be employed. The Y-axis pivotal milling spindle swing arm computer-controlled servo axis, may utilize the Parker Series 2HX hydraulic cylinder, housing the MTS model M-series absolute analog sensor (see 5051 in FIG. 35B) inside the hydraulic cylinder to provide position feedback to the computer controller for pivotal spindle swing arm Y-axis arc movement.

In a still further embodiment of the present disclosure an inertia reference system such as, Clymer Technologies model Terrella6 v2, can provide information that the robotic rotary mill cutter is actually performing the movements sent by the computer controller as a verification reference. The Clymer Technologies model Terrella6 v2 is mounted in the milling spindle swing arm (see 5014 in FIG. 39B) and provides temperature and vibration monitoring to the operators display monitor in real time where that information will be used by the operator to make feed and speed adjustments for best cutting operations. If the reference shows a sudden stop, or any axis is not responding to the programmed feeds and speeds the computer can go into a hold action stopping the robotic rotary mill cutter and requiring operator intervention before resuming milling operations. Alarms may be visually shown on the operator's monitor and/or may have an audible warning.

The methods and systems described herein are not limited to specific sizes, shapes, or models. Numerous objects and advantages of the disclosure will become apparent as the following detailed description of the multiple embodiments of the apparatus and methods of the present disclosure are depicted in conjunction with the drawings and examples, which illustrate such embodiments.

Figure 34:
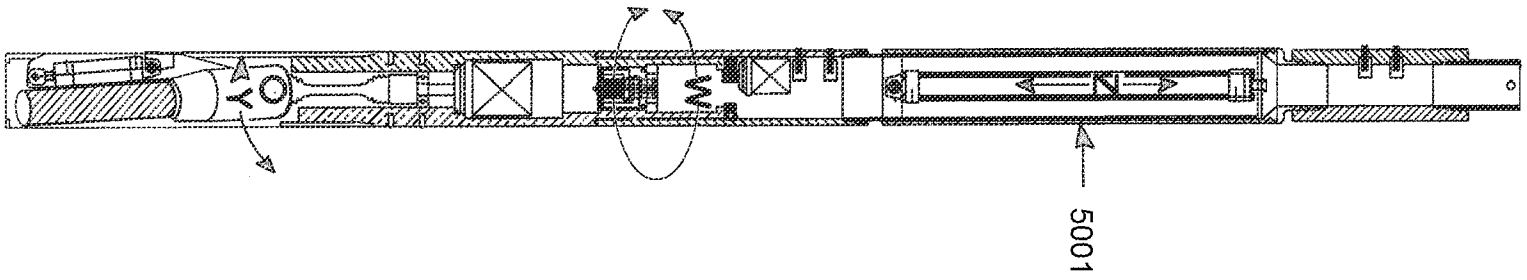
FIG. 34 depicts the robotic rotary mill cutter of one embodiment.

FIG. 34 depicts the robotic rotary mill cutter 5001. The robotic rotary mill cutter 5001, shows the position of the vertical Z-axis, and the 360-degree horizontal rotary W-axis, and the Y-axis pivotal milling spindle swing arm.

Figures 35A, 35B:
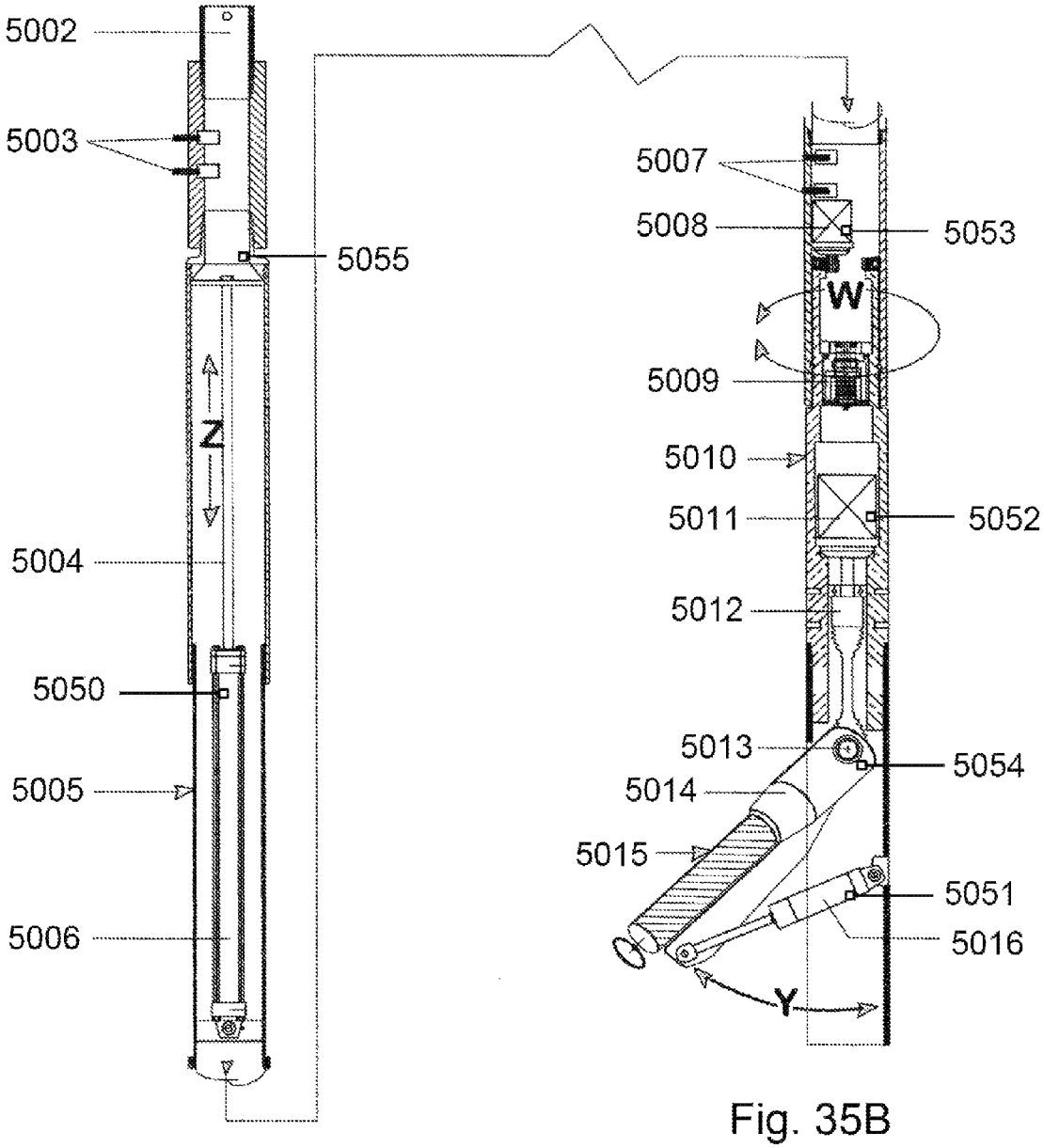
FIGS. 35A and 35B, depict the upper and lower portions, respectively, of the robotic rotary mill cutter.

FIGS. 35A and 35B, depict the upper and lower portions, respectively, of the robotic rotary mill cutter of the preferred embodiment.

Referring to FIG. 35A, a collar 5002 is used to attach the umbilical cord (not shown) and cable (not shown) to the body of robotic rotary mill cutter 5001. Collar 5002 may be exchanged to adapt to different size work strings (not shown). Additionally, the collar 5002 provides a quick disconnect point in case emergency removal of the robotic rotary mill cutter 5001 is necessary. In one embodiment, the collar 5002 may be a spring centralizer about three feet long. After the robotic rotary mill cutter 5001 is in the cut location, locking hydraulic cylinders 5003 are energized to lock the robotic rotary mill cutter 5001 into the well bore (not shown). In the preferred embodiment, after the locking hydraulic cylinders 5003 have been energized, Z-axis hydraulic cylinder 5006 is moved to a down position by extending piston rod 5004 allowing the Z-axis slide 5005 to extend. This permits the robotic rotary mill cutter 5001 to begin cutting at the lowest point of the cut and be raised as needed to complete the severance.

Referring to FIG. 35B, additional locking hydraulic cylinders 5007 are available should additional stabilization (if energized) or movement (if not energized) is desired. W-axis servomotor 5008 rotates the W-axis rotating body 5010 under control of the computer (not shown). W-axis rotating body 5010 houses the milling spindle swing arm 5014 and the milling spindle swing arm 5014 is driven by motor 5011 also housed in the W-axis rotating body 5010. Milling spindle swing arm 5014 is driven by motor 5011 through a half-shaft 5012 such as Motorcraft model 6L2Z-3A427-AA.

Half-shaft 5012 has a C.V. joint (not shown) that allows milling spindle swing arm 5014 to pivot in an arc from pivot bearing 5013 that goes through W-axis rotating body 5010. Milling spindle swing arm 5014 is moved by Y-axis hydraulic cylinder 5016. The rotation of W-axis rotating body 5010 requires a swivel joint 5009, such as Rotary Systems, Inc. Model DOXX multiple-passage rotary union, to allow power and sense lines (not shown) to motor 5011, Y-axis hydraulic cylinder 5016, and load cell 5054 sense wires (not shown). Cutting device 5015 (for example, carbide milling cutter or solid carbide cutter) is mounted to the milling spindle swing arm 5014 and is moved by Y-axis hydraulic cylinder 5016 into the cut under computer control.

Figure 36:
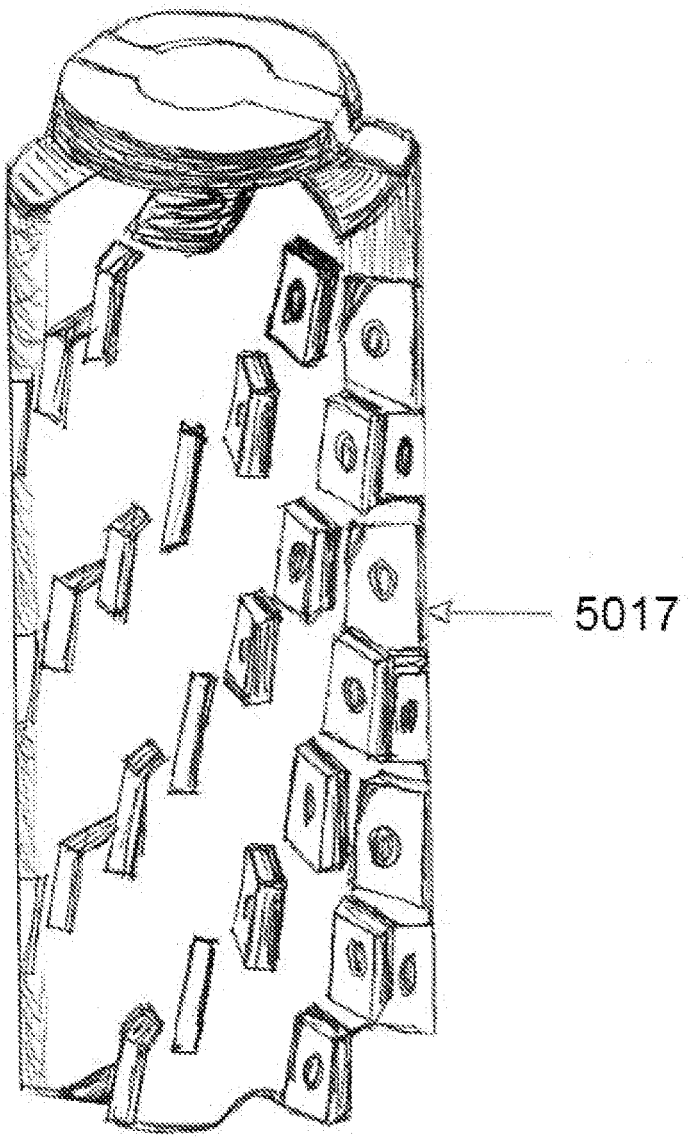
FIG. 36 depicts an expanded view of an inserted carbide mill of one embodiment.

FIG. 36 depicts an expanded view of one embodiment of an inserted carbide mill 5017 that could be attached to milling spindle swing arm 5014. Other milling units with different material and/or cutting orientation could be utilized depending on the particular characteristics of the severance to be performed.

Figure 37A:
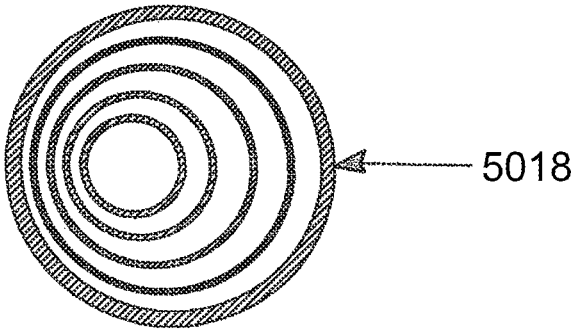
FIG. 37A depicts a top view of multiple casings (tubulars) that are non-concentric.

FIG. 37A depicts a top view of nested multiple casings (tubulars) 5018 that are positioned non-concentrically.

Figure 37B:
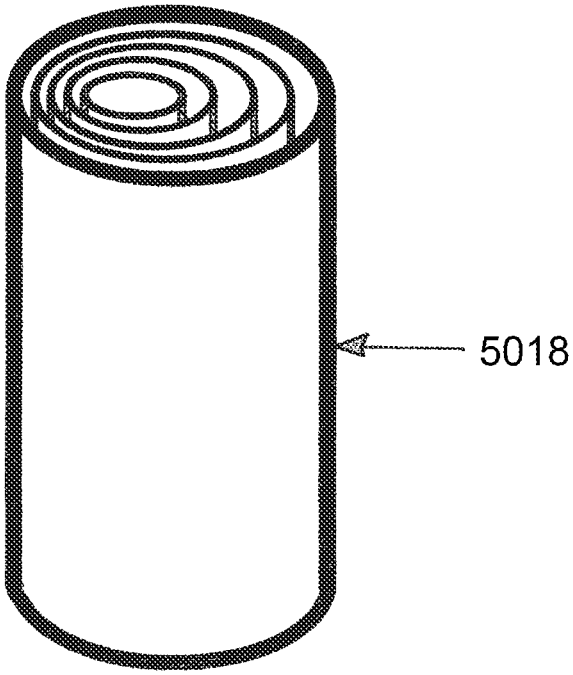
FIG. 37B depicts an isometric view of non-concentric casings (tubulars).

FIG. 37B depicts an isometric view of nested multiple casings (tubulars) 5018 that are positioned non-concentrically.

Figure 38A:
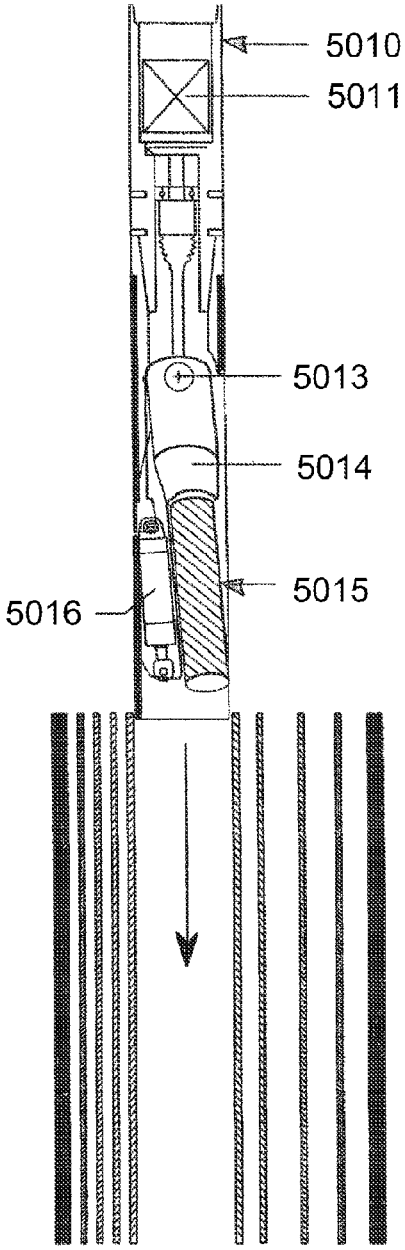
FIG. 38A depicts a portion of the robotic rotary mill cutter as it enters the tubulars.

FIG. 38A depicts a portion of the robotic rotary mill cutter 5001 as it enters the nested multiple casings (tubulars) 5018.

Figure 38B:
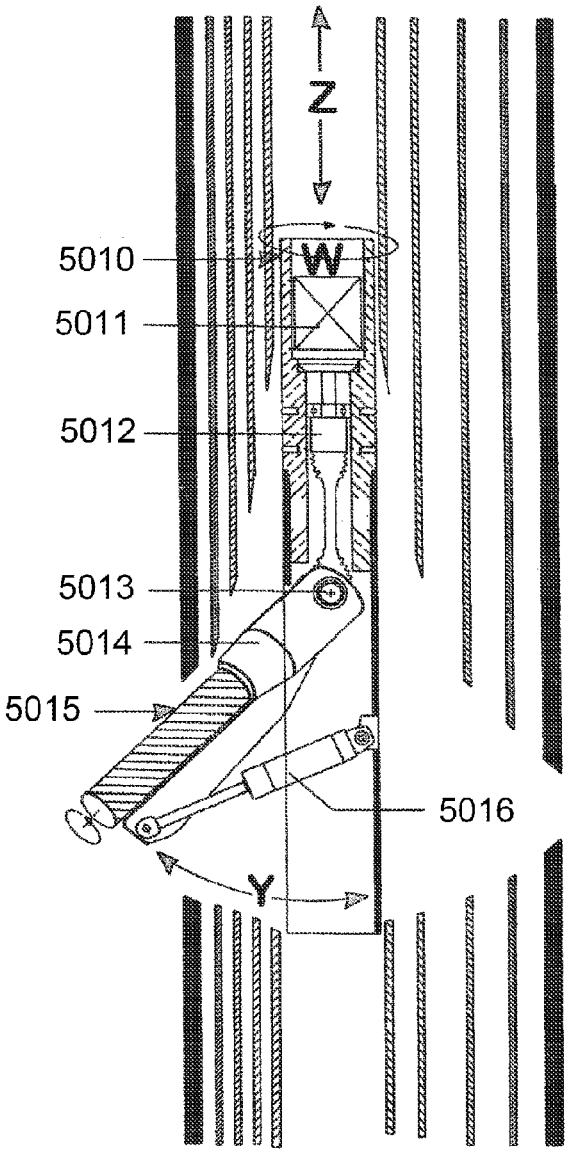
FIG. 38B depicts a portion of the robotic rotary mill cutter as it is severing multiple casings.

FIG. 38B shows the nested multiple casings (tubulars) 5018 with the void that has been created by the robotic rotary mill cutter 5001. The profile generation system (not shown) simultaneously moved the robotic rotary mill cutter 5001 in a vertical Z-axis, and a 360-degree horizontal rotary W-axis, and the milling spindle swing arm 5014 in a pivotal Y-axis arc to allow cutting of the tubulars, cement (not shown), and formation rock (not shown) in any programmed shape or window profile(s) thereby cutting through the multiple casing (tubulars) 5018, cement (not shown) or other encountered material in casing annuli (not shown) by making multiple successfully larger voids created by the robotic mill cutter as above.

Figures 39A, 39B:
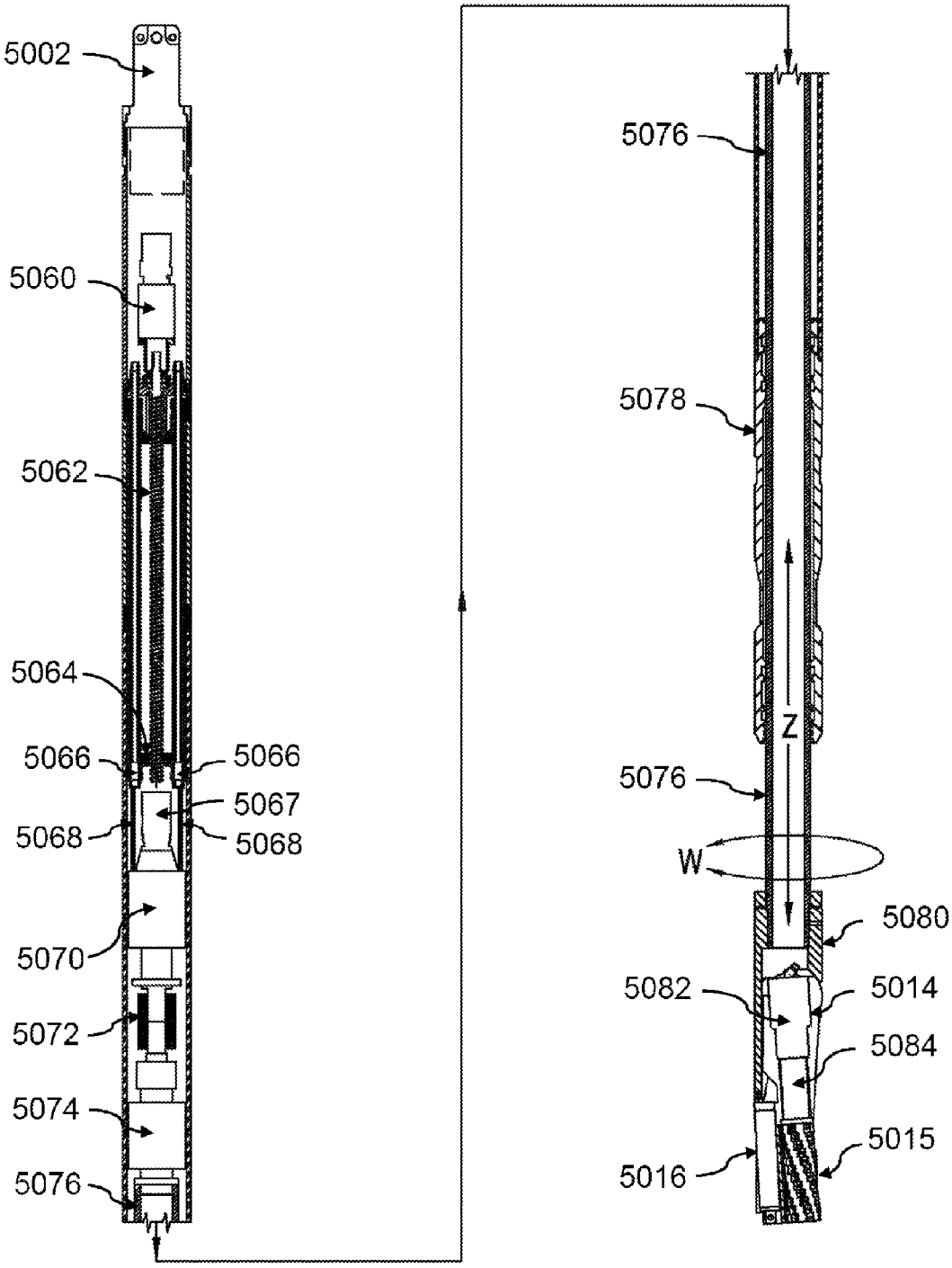
FIGS. 39A and 39B depict the upper and lower portions, respectively, of an alternative embodiment of the robotic rotary mill cutter.

FIGS. 39A and 39B depict the upper and lower portions, respectively, of an alternative embodiment of the robotic rotary mill cutter. Referring first to FIG. 39A, the Z-axis motor 5060 rotates the ball screw 5062 through the Z-axis nut 5064, which raises or lowers the remainder of the tool. A trombone slide 5066 resides on either side of the ball screw 5062. The trombone slide 5066 is hollow and carries pressured hydraulic fluid to the remainder of the tool. The trombone slide 5066 is capable of containing and transmitting hydraulic fluid pressurized to around 1,000 lbs/in$^2$. The W-axis hydraulic motor drives rotation about the Z-axis (W-axis rotation). Anti-torque rails (not shown) stop the tool from rotating when the ball screw 5062 is rotated. Additionally, tie rods 5068 provide support for the W-axis transmission 5070.

The W-axis transmission 5070 rotates the drive bar 5076 within the packer 5078 thereby providing rotation about the Z-axis (W-axis rotation). In one embodiment, a transmission is employed. In one embodiment, the transmission is a cluster gear transmission. The transmission is used because of the size and power constraints (e.g. relatively small size and relatively high power). Additionally, in one embodiment, the hydraulic fluid is returned through the W-Axis transmission for lubrication of the transmission 5070. The shaft coupling 5072 couples the W-axis transmission 5070 to the rotary coupling 5074 that couples to the drive bar 5076. The rotary coupling 5074 also provides a path for the hydraulic fluid to pass to the remainder of the tool. In one embodiment, the space between the drive bar 5076 and the packer 5078 is filled with pressurized hydraulic fluid (up to around 1,000 lbs/in$^2$). This hydraulic fluid acts as an anti-vibration device. Bearings may also be employed between the drive bar 5076 and the packer 5078 to reduce vibration and center the drive bar 5076. The packer 5078 can be fitted with additional bushings (not shown) to accommodate different size tubulars. Furthermore, the packer 5078, when pressurized expands/inflates against the wellbore to provide additional stability and vibration reduction. Additionally, for larger wellbores, a spacer or sleeve can be attached about the tool (relatively near the packer) to act a centralizer until the packer has expanded/inflated to impact the innermost tubular. In yet another embodiment, a spacer or sleeve could even be placed about the packer to more closely match the inner diameter of a wellbore before expanding/inflating the packer.

Occasionally a tear or other obstruction or flow anomaly may occur in the fluid delivery lines of a downhole cutter. Traditionally, the level of a large fluid tank, for example hydraulic fluid, would be monitored. If the level started decreasing, then the operators knew there was a problem. Unfortunately, this routinely occurs only after some significant amount of fluid is lost downhole (e.g. 20-30 gallons). Furthermore, the operators only know there is a problem but; they have no idea which hose had the leak.

Contrary to traditional models, in addition to the traditional "level" monitoring, each hose to and from the tool is fitted with turbine flow meters to continuously monitor the flow of fluid through each hose. This provides a very early warning system to alert operators to any flow anomalies. For example, should a hose develop a tear and begin leaking fluid into the wellbore, the "delivery" hose would have a flow rate in excess of the "return" hose. If the difference in the flow meters exceeded a defined threshold, an operator could be alerted. This is an improvement over traditional fluid "level" monitoring which could only detect tears after a significant amount of fluid was lost downhole, wasting money and creating potential environmental hazards. Further, traditional "level" monitoring could only detect flow anomalies that resulted in the loss of fluid. By utilizing turbine flow meters, pinched, partially blocked/clogged, and/or completely blocked/clogged hoses can be detected. Also, because each hose has its own turbine flow meter, the operator can immediately identify which hose is having the flow anomaly and how serious the flow anomaly is.

The spindle housing 5080 is rigidly attached to the drive bar 5076 such that as the drive bar 5076 rotates, the spindle housing 5080 also rotates in the W-axis (about the Z-axis). This rotation can occur while the drive bar 76 is moved longitudinally (up and down along the Z-axis) by the action of the ball screw 5062. The spindle hydraulic motor 5082 rotates the shaft 5084 and the cutting device 5015. Although indicated as separate items, in one embodiment the shaft 5084 and the cutting device 5015 are made from the same piece of material. This provides the advantage of increased strength and vibration reduction with no connections between the shaft 5084 and the cutting device 5015. Finally, the Y-axis hydraulic cylinder 5016 swings the cutting device 5015 away from the spindle housing 5080.

In one embodiment the ratio of shaft 5084 length to cutting device 5015 length is 1:1 to increase the strength of the assembly and reduce vibrations. In another embodiment, the cutting device 5015 may swing away from the spindle housing 5080 to an angle of 45 degrees (measured from the vertical center line of the spindle housing 5080 to the center line of the cutting device 5015) by the extension of the hydraulic cylinder 5016; however a wider angle is also achievable.

Additionally, in one embodiment, a pressure relief hose (not shown) is attached to the Y-axis hydraulic cylinder 5016. This pressure relief hose has a valve (not shown) located at the surface that when actuated releases the pressure from the Y-axis hydraulic cylinder 5016. This could be used for example to allow the cutting device 5015 to retract back (see FIG. 39B) within the spindle housing 5080 should a hydraulic or electrical failure occur while the tool is deployed downhole and cutting. Without such a failsafe pressure relief, if the tool failed while cutting, the cutting device 5015 could be extended so far into the formation as to interfere with tool recovery. The pressure relief hose and valve are independent of any electronics on the tool itself or within the wellbore; therefore, a failure on the tool itself will not interfere with the failsafe pressure relief because it is controlled solely from the surface. Another such independent pressure relief hose (not shown) and valve (not shown) is attached to the packer for similar reasons.

In one embodiment, the Y-axis hydraulic cylinder 5016 is capable of providing over 10,000 lbs of force.

Figure 40A:
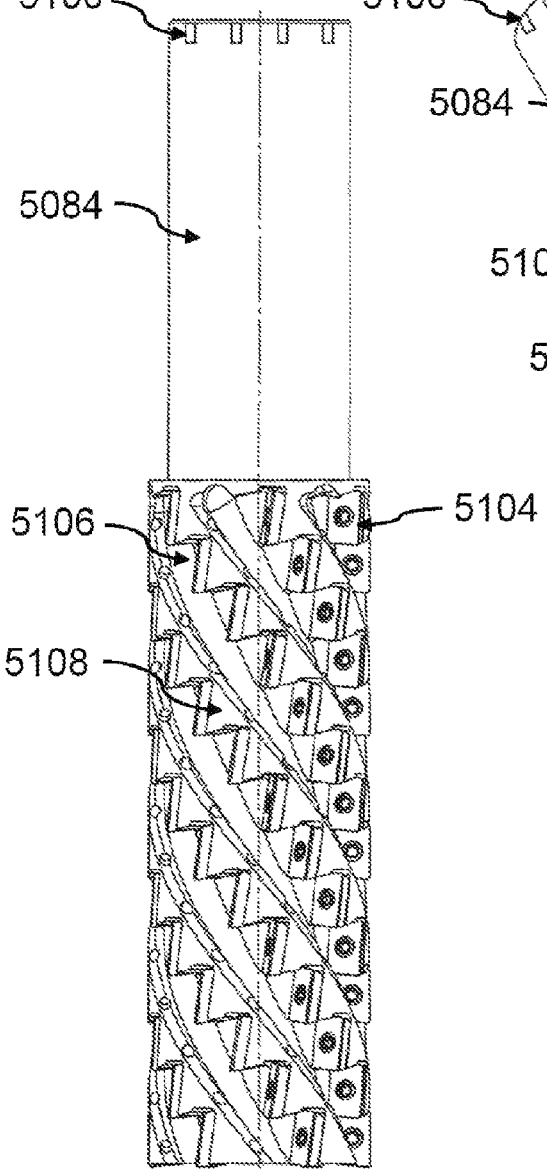
FIGS. 40A, 40B, and 40C depict side view, isometric view, and a bottom view of an alternative embodiment of a cutting device.
Figure 40B:
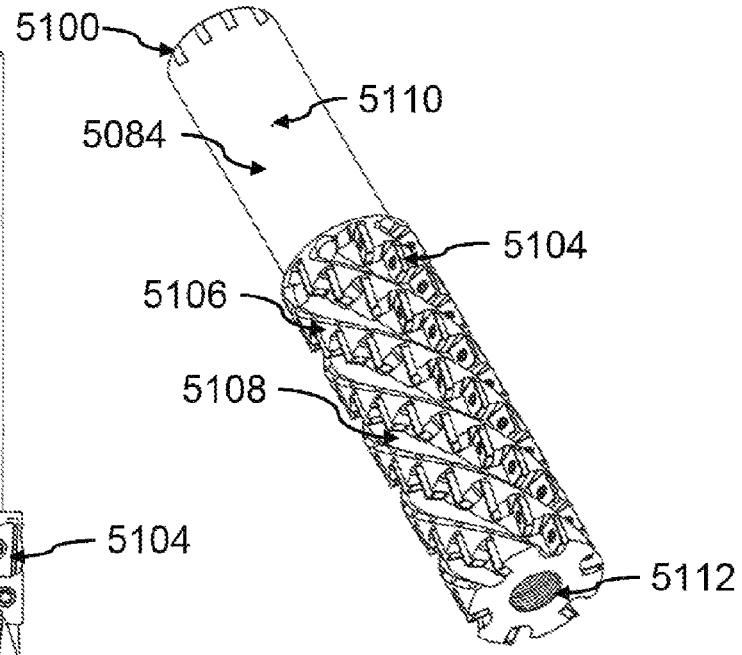
Figure 40C:
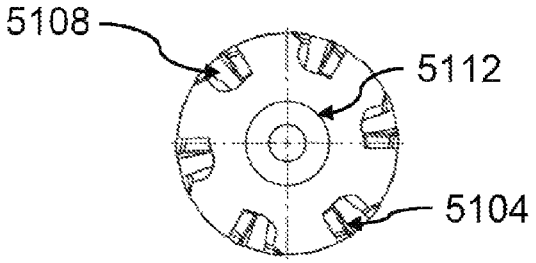

FIGS. 40A, 40B, and 40C depict side view, isometric view, and a bottom view of an alternative embodiment of the cutting device 5015. The shaft 5084 has notches 5100 to enable a sensor (e.g. proximity switch) to monitor the cutting device's 5015 rotational speed. The cutting device of this embodiment has 84 milling inserts 5104 (although alternate numbers of milling inserts 5104 could be used with success). In this particular embodiment, the milling inserts 5104 are arranged in 6 rows of 14; however, alternative configurations could be used with success. Each of the milling inserts 5104 are mounted on individual insert faces 5106 and are removable in case of breakage or wear. The milling inserts 5104 extend partially above the insert faces 5106 to mill away the material being cut.

Each milling insert 5104 has a life expectancy of about 15 minutes of cutting. By careful technique and using a milling insert 5104 layout and number similar to that disclosed herein, one can make the milling inserts last on the cutting device 5015 for about two hours of cutting (e.g. each milling insert 5104 sees less than 15 minutes of actual cut time during a two hour cutting episode). It is important to note that milling through the steel tubulars degrades the milling inserts 5104; therefore, to maximize cutting potential, the cutting of the steel tubulars is apportioned across the entire cutting device 5015.

This technique of spreading the tubular cutting across the entire cutting device 5015 is accomplished by making the first cut only using the lower most milling inserts 5104 of the cutting device 5015 for a short period of time by feeding the cutting device 5015 out with hydraulic cylinder 5016 completely through the innermost tubular. Once the cutting device 5015 is through the innermost tubular, the spindle housing 5080 is rotated 360-degrees severing the first tubular. After the first tubular is severed, the spindle housing 5080 is raised vertically up the Z-axis while simultaneously rotating in the W-axis to spiral mill cut the innermost tubular the height required to remove the innermost tubular. For example, this would remove the first tubular and a small portion of the cement between the first tubular and the second tubular. When the first upward cut is complete, the spindle housing 5080 would be lowered back down along the Z-axis to the start position of the first cut and the Y-axis hydraulic cylinder 5016 would move the cutting device 5015 further into the nested tubulars now that the innermost first tubular has been removed. The next cut would use milling inserts 5104 further up the cutting device 5015 to cut the tubulars as the spindle housing 5080 is then feed vertically up the Z-axis a height programmed while simultaneously rotating in the W-axis to spiral mill cut the length of the next tubular and cement.

This technique is repeated until the final cut. The remaining life of the lower most inserts 5104 are reserved to make the final cut through the tubular that is the farthest into the formation, as the lower most milling inserts are used mostly for cutting cement until the final cut. By continuing in this manner, the tubular cutting is spread across the entire cutting device 5015 to maximize the cutting ability.

Additionally, this embodiment acts as a type of pump, directing the fluid flow into the wellbore while ejecting any chips or debris resulting from the cutting process down the wellbore. This ejecting action is accomplished by orienting the troughs 5108 between the rows of inserts 5104 backwards (e.g. reverse cutter) and rotating the rotary mill cutter 5015 clockwise. Traditional cutters are oriented with a "forward" cutter.

Traditional systems have to feed pressurized lubricant from the surface into the bearing assemblies or use sealed bearings. In contrast, this embodiment has a lubricant hole 5110 in the shaft 5084 that traverses from the outside of the shaft 5084 to the inside opening 5112 which allows lubricant to flow onto the shaft 5084 and coat the shaft 5084 to reduce friction as the rotary mill cutter 5015 and shaft 5084 rotates. The rotary mill cutter 5015 and the shaft 5084 contain pressurized lubricant in a reservoir. A piston (not shown) is attached to an opening 5112 in the base of the rotary mill cutter 5015 to pressurize the lubricant. When the shaft 5084 is connected to the spindle hydraulic motor 5082 a seal is created below the lubricant hole 5110 such that the lubricant does not leak. When the cutting device 5015 needs to be serviced, the lubricant can be changed by removing the piston. By filling the rotary mill cutter 5015 with pressurized lubricant, additional vibration reduction can be achieved.

Unlike traditional cutters this embodiment has no connection point between the shaft 5084 and the cutting device 5015 (e.g. it is made from a single piece of metal). This increases the strength and decreases the complexity thereby making this embodiment more reliable than traditional cutters.

In one embodiment the cutting device 5015 measures approximately one foot in length and approximately four inches in diameter, however other lengths and diameters could be employed depending on the particular application. Also in this embodiment, the insert face 5106 is angled about nine degrees off the centerline, although other angles could also be employed depending on the particular application.

Figure 41A:
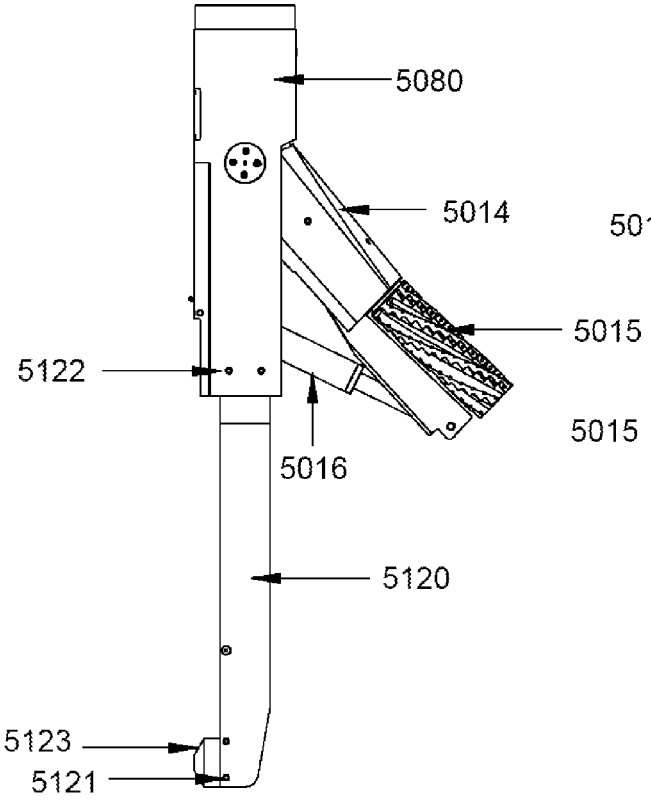
FIGS. 41A and 41B depict embodiments of a steady rest attached to one embodiment of the robotic rotary mill cutter.
Figure 41B:
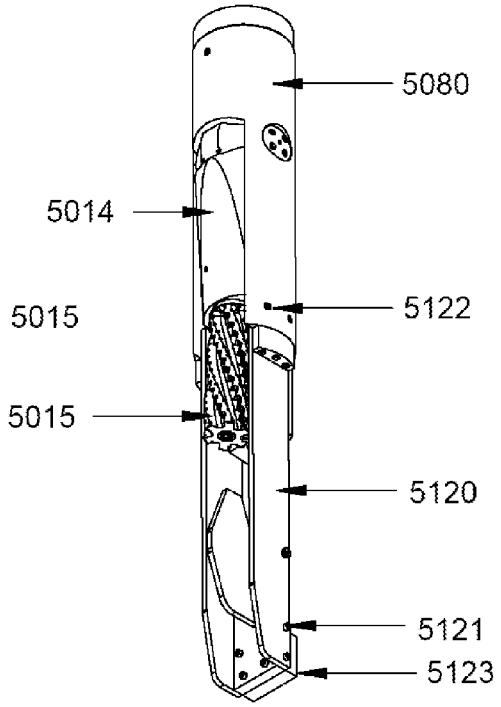

FIGS. 41A and 41B depict the tool with the steady rest 5120. The steady rest 5120 provides an offset point to reduce vibration, provide stability for the cutting device 5015, and counteract the force of the cutting device 5015 pushing against the tubulars and/or formation. As such, the steady rest is positioned such that it impacts the wellbore on the opposite side from the arcing motion of the spindle swing arm 5014. Additionally, the steady rest 5120 provides a safety mechanism in case one or more tubulars shifts during cutting.

It is not uncommon for tubulars to shift during cutting for example if the tubular was not cemented well. These shifts could pin the tool in the wellbore and make retrieval difficult or impossible. In one embodiment, the steady rest 5120 is coupled to the tool with shear bolts 5121 and 5122 and extends below the cutting device 5015. In one embodiment there are two levels of shear bolts. If the first level of shear bolts 5121 gives way, the steady rest 5120 will shift inward (e.g. the steady rest pivots out of the way of the shifting tubular. This would represent a minor shift in the tubular. If this occurs, the tool and the steady rest are still retrievable. If the second level of shear bolts 5122 gives way, which represents a significantly more violent shift, the steady rest will separate from the spindle housing 5080 and the steady rest 5120 will remain in the wellbore; however, the robotic rotary mill (downhole assembly) would still be retrievable.

The steady rest bearing 5123 provides the third major contact point between the tool and the wellbore. The first being the exposed portion of the spindle swing arm 5014 while cutting the first innermost tubular, the second being the milling spindle housing 5080 rubbing on the first innermost tubular as the mill cutter 5015 is cutting the first innermost tubular, and the third being the steady rest bearing 5123. These three major points of contact provide a very stable cutting platform and significantly reduce unwanted vibration.

In one embodiment, the steady rest 5120 is about 42" long. This permits the steady rest to engage against the inner wall of the innermost tubular for the majority, if not all, of the cut. In other embodiments, the steady rest 5120 may be more or less than 42" long. In order to make cuts with a vertical distance (e.g. along the Z-axis) in excess of 54" (e.g. 42" travel with the steady rest engaged+12" for the length of one embodiment of the cutting device 5015 itself): (i) a longer steady rest 5120 could be employed, (ii) the top most 54" of the cut may be completed, then the tool repositioned about 54" below the bottom of the first cut to begin a new series of cuts; (iii) the steady rest 5120 could be engaged against the innermost tubular wall only for a portion of the cut (e.g. the first cut, because it is generally the longest cut, could have some portion of its cut made without the steady rest 5120 engaged); and/or (iv) a longer rotary mill cutter 5015 could be used. It is preferable for the largest diameter cuts that the steady rest be engaged against the innermost wall.

In one embodiment, the steady rest is not used if the cutting device 5015 vibrations are small. The Clymer Technologies model Terrella6 v2 (not shown) provides vibration graphical displays to the operators monitor (not shown).

The disclosed subject matter covers the scope of functionality in a holistic way. Although described with reference to particular embodiments, those skilled in the art, with this disclosure, will be able to apply the teachings in principles in other ways. All such additional embodiments are considered part of this disclosure and any claims to be filed in the future.

What is claimed is:

1. A method of programmably severing a plurality of nested tubulars, each tubular having a tubular bore, the nested tubulars being disposed in a well bore and wherein there is an outer tubular and an at least one inner tubular inside the bore of the outer tubular, the method comprising the steps of:

(a) providing a cutting tool, the cutting tool including:

(i) a tool body configured to be lowered into the tubular bore of the innermost nested tubular, the tool body having a longitudinal Z-axis, a W-axis of rotation rotating about the Z-axis, and an anchoring system attached to the tool body, the anchoring system having engaged and non-engaged conditions, wherein during the engaged condition the tool body is anchored relative to the innermost tubular, and during the non-engaged position the tool body is not anchored relative to the innermost tubular;

(ii) the tool body including a cutting head movably connected to the tool body in both the Z and W axes;

(iii) the cutting head being coupled to a first motor drive, wherein the first motor drive causing the cutting head to be moved in the W-axis of rotation relative to the tool body;

(iv) the cutting head being coupled to a second motor drive, wherein the second motor drive causing the cutting head to be moved in the Z-axis relative to the tool body;

(v) the cutting head including: a spindle housing pivotally connected to the cutting head at a pivot axis allowing pivoting in a Y-axis, the spindle housing having:

(1) an elongated cutting member with distal and proximal ends, and the elongated cutting member being rotationally connected to the spindle housing, the elongated cutting member having a longitudinal axis, the longitudinal axis being perpendicular to the pivot axis of the spindle housing, (2) a third motor drive operably connected to the elongated cutting member causing the elongated cutting member to rotate about the elongated cutting member's longitudinal axis and relative to the spindle housing;

(3) an arcuate actuator operatively connected to the spindle housing and elongated cutting member, the actuator causing the elongated cutting member to move about the Y-axis; and (vi) a programmable controller operably connected to the cutting tool and controlling movement of the cutting head or elongated cutting member in the Z-axis, W-axis, Y-axis, and rotation about the elongated cutting member's longitudinal axis;

(b) from a surface location lowering the cutting tool into an innermost tubular of a plurality of nested tubulars;

(c) engaging the anchoring system such that the tool body is anchored relative to the innermost tubular;

(d) the second drive motor extending the cutting head to a first Z axis cutting position Z1;

(e) the third drive motor causing the elongated cutting member to rotate about the rotational cutting axis;

(f) the actuator causing the elongated cutting member to move to a first Y-axis arcuate position Y1;

(g) while the elongated cutting member is at the Y1 arcuate angle, the second drive motor rotating the cutting head in the W-axis at least one complete revolution;

(h) during step "g", the second drive motor causing the cutting head to retract in the Z axis to a second Z-axis cutting position Z2, wherein Z2 is less than Z1;

(i) after step "h", the second drive motor extending the cutting head to a third Z axis cutting position Z3, wherein Z3 is greater than Z2;

(j) after step "h", the actuator causing the elongated cutting member to move to a second Y-axis arcuate position Y2, wherein Y2 is greater than Y1;

(k) while the elongated cutting member is at the Y2 arcuate angle, the second drive motor rotating the cutting head in the W-axis at least one complete revolution;

(l) after step "b", and without raising the tool body to the surface location, completely severing the plurality of the nested tubulars with the elongated cutting member; and (m) inputting size information for each of a plurality of nested tubulars, and based on the inputted size information, the controller controlling steps "d" through "k".

2. The method of claim 1, wherein during step "m", for any of the tubulars to be cut, the controller accepts input regarding: a target Y-axis cutting position of the elongated cutting member relative to a preselected Y-axis home position.

3. The method of claim 1, wherein during step "m", for any of the tubulars to be cut, the controller accepts input regarding target starting and finishing Z-axis cutting positions for the cutting head (e.g., for the tubular being cut to provide a desired finished gap or swath or cut), relative to a preselected Z-axis home position.

4. The method of claim 1, wherein during step "m", for any of the tubulars to be cut, the controller accepts input regarding the diameters of the tubulars.

5. The method of claim 1, wherein during step "m", for any of the tubulars to be cut, the controller accepts input regarding the thickness of the tubulars.

6. The method of claim 1, wherein during step "m", for any of the tubulars to be cut, the controller accepts input regarding the eccentricity or out of roundness of the tubulars.

7. The method of claim 1, wherein during step "m", for any of the tubulars to be cut, the controller accepts input regarding the amount of offset of one or the tubulars related to another tubular.

8. The method of claim 1, wherein the controller is operably connected to a display, and, based on input regarding the nested tubulars to be cut, the controller determines and displays on the display target values for one or more of the nested tubulars to be cut, and the user can override one or more target values for movements in Y-axis (e.g., target cutting position for a particular tubular), Z-axis (e.g., starting and finishing Z-axis locations for a particular tubular), W-axis (e.g., angular rotational speed), and/or ECMLAR (e.g., angular rotational speed).

9. The method of claim 1, wherein the controller is operably connected to a display, and, based on input regarding the nested tubulars to be cut, the controller displays on the display a pictorial representation of the cuts which will be made in the plurality of nested tubulars by the elongated cutting member.

10. The method of claim 9, wherein the pictorial display made on a tubular by tubular basis.

11. The method of claim 10, wherein an operator is provided an option to select which of the set of tubulars a pictorial display will be made.

* * * * *